US007229751B2

(12) United States Patent
Kimura et al.

(10) Patent No.: US 7,229,751 B2
(45) Date of Patent: Jun. 12, 2007

(54) SILVER SALT PHOTOTHERMOGRAPHIC DRY IMAGING MATERIAL AND IMAGE FORMING METHOD USING THE SAME

(75) Inventors: Soc Man Ho Kimura, Musashino (JP); Narito Goto, Sagamihara (JP)

(73) Assignee: Konica Minolta Medical & Graphic, Inc. (JP)

( * ) Notice: Subject to any disclaimer, the term of this patent is extended or adjusted under 35 U.S.C. 154(b) by 116 days.

(21) Appl. No.: 10/990,311

(22) Filed: Nov. 16, 2004

(65) Prior Publication Data

US 2005/0136366 A1 Jun. 23, 2005

(30) Foreign Application Priority Data

Nov. 20, 2003 (JP) ..... 2003-390870
Mar. 9, 2004 (JP) ..... 2004-065273

(51) Int. Cl.
*G03C 1/00* (2006.01)

(52) U.S. Cl. ..... 430/617; 430/618; 430/619; 430/620

(58) Field of Classification Search ..... 430/617–620
See application file for complete search history.

(56) References Cited

U.S. PATENT DOCUMENTS

2006/0057508 A1* 3/2006 Fukui et al. ..... 430/348
2006/0127826 A1* 6/2006 Fukui ..... 430/619

FOREIGN PATENT DOCUMENTS

JP 2003-140290 5/2003
JP 2003-177489 6/2003

OTHER PUBLICATIONS

English Abstract for JP 2003-140290 dated May 14, 2003.
English Abstract for JP 2003-177489 dated Jun. 27, 2003.

* cited by examiner

*Primary Examiner*—Geraldina Visconti
(74) *Attorney, Agent, or Firm*—Cantor Colburn LLP

(57) ABSTRACT

A photothermographic imaging material including a support having thereon an image forming layer containing light-insensitive organic silver salt grains, photosensitive silver halide grains, a reducing agent for silver ions and a binder, wherein: (i) each of the photosensitive silver halide grains produces a larger number of latent images in a surface portion of the grain than in an inner portion of the grain by exposure to light; (ii) each of the photosensitive silver halide grains produces a larger number of latent images in the inner portion of the grain than in the surface portion of the grain after being subjected to a thermal development; (iii) a surface photographic speed of each of the photosensitive silver halide grains decreases after being subjected to the thermal development; and (iv) the photothermographic imaging material contains a reducible silver salt compound represented by Formula (I) described in the specification.

11 Claims, 1 Drawing Sheet

SILVER SALT PHOTOTHERMOGRAPHIC DRY IMAGING MATERIAL AND IMAGE FORMING METHOD USING THE SAME

FIELD OF THE INVENTION

The present invention relates to a silver salt photothermographic dry imaging material and an image forming method using the same. The imaging material (hereafter is also called as a photothermographic material or a thermal developing photosensitive material) contains a photosensitive emulsion having light-insensitive organic silver salt grains and photosensitive silver halide grains; a reducing agent for silver ions; and a binder.

BACKGROUND OF THE INVENTION

In recent years, in the medical and graphic arts fields, a decrease in the processing effluent has been increasingly demanded from the viewpoint of environmental protection as well as space saving.

As a result, techniques have been sought which relate to photothermographic materials which can be effectively exposed, employing laser imagers and laser image setters, and can form clear black-and-white images exhibiting high resolution.

Such techniques are described in, for example, U.S. Pat. Nos. 3,152,904 and 3,487,075, both by D. Morgan and B. Shely, or D. H. Klosterboer et al., "Dry Silver Photographic Materials", (Handbook of Imaging Materials, Marcel Dekker, Inc. page 48, 1991). Also known are silver salt photothermographic dry imaging materials (hereinafter occasionally referred to simply as photothermographic materials) which comprise a support having thereon organic silver salts, photosensitive silver halide and reducing agents.

Since any solution-based processing chemicals are not employed for the aforesaid silver salt photothermographic dry imaging materials, they exhibit advantages in that it is possible to provide a simpler environmentally friendly system to customers.

These silver salt photothermographic dry imaging materials are characterized in that photosensitive silver halide grains, which are incorporated in a photosensitive layer, are utilized as a photo-sensor and images are formed in such a manner that silver halide grains are thermally developed, commonly at 80 to 140° C., utilizing the incorporated reducing agents while using organic silver salts as a supply source of silver ions, and fixing need not be carried out.

However, the aforesaid silver salt photothermographic dry imaging materials tend to result in fogging during storage prior to thermal development, due to incorporation of organic silver salts, photosensitive silver halide grains and reducing agents. Further, after exposure, thermal development is commonly carried out at 80 to 250° C. followed by no fixing. Therefore, since all or some of the silver halide, organic silver salts, and reducing agents remain after thermal development, problems occur in which, during extended storage, image quality such as silver image tone tends to vary due to formation of metallic silver by heat as well as light.

The photothermographic material contains all of the materials required for development in advance, therefore, its shelf-keeping property tends to be lower compared to the conventional photosensitive material for wet development. Further, it is still to be improved in basic properties such as sensitivity and fog. Another problems to be improved is a silver tone in case it is applied to a medical diagnostic use.

There is disclosed a technology to solve the above-described problems by using a silver salt of a dicaroboxylic acid for an organic silver salt (e.g., Patent Document No. 1).

They improve storage stability and image stability after development. Another technology to achieve high speed is also disclosed (e.g., Patent Document No. 2). However, they are not fully sufficient to satisfy all the requirements in the market. Another technology to adjust silver tone yielding a preferable tone is also disclosed. Examples are, Japanese Patent Publication Open to Public Inspection (JP-A) Nos. 50-36110, 59-206831, 5-204087, 11-231460, 2002-169249, and 2002-236334. Here again, the adjusting technologies disclosed are not fully efficient to prevent the color change of the image during preservation.

Patent Document No. 1: JP-A No. 2003-177489

Patent Document No. 2: JP-A No. 2003-140290

SUMMARY OF THE INVENTION

An object of the present invention is to provide a silver salt photothermographic dry imaging material having high speed, low fogging and good silver tone as well as exhibiting excellent image stability and storage stability. Also, the present invention also provide an image forming method using the aforesaid imaging material.

The object of the present invention can be achieved by the following embodiments.

An embodiment of the present invention includes a photothermographic imaging material containing a support having thereon an image forming layer containing light-insensitive organic silver salt grains, photosensitive silver halide grains, a reducing agent for silver ions and a binder, wherein:

(i) each of the photosensitive silver halide grains produces a larger number of latent images in a surface portion of the grain than in an inner portion of the grain by exposure to light;

(ii) each of the photosensitive silver halide grains produces a larger number of latent images in the inner portion of the grain than in the surface portion of the grain after being subjected to a thermal development;

(iii) a surface photographic speed of each of the photosensitive silver halide grains decreases after being subjected to the thermal development; and (iv) the photothermographic imaging material contains a specific reducible silver salt of a compound having dicarboxyl groups in the molecule.

Another embodiment of the present invention includes a photothermographic imaging material containing a support having thereon an image forming layer containing light-insensitive organic silver salt grains, photosensitive silver halide grains, a reducing agent for silver ions and a binder, wherein:

(i) each of the photosensitive silver halide grains produces a larger number of latent images in a surface portion of the grain than in an inner portion of the grain by exposure to light;

(ii) each of the photosensitive silver halide grains produces a larger number of latent images in the inner portion of the grain than in the surface portion of the grain after being subjected to a thermal development;

(iii) a surface photographic speed of each of the photosensitive silver halide grains decreases after being subjected to the thermal development; and (iv) the photothermographic imaging material contains a compound capable of releasing at least one electron after formation of one-electron oxidation product formed by one electron oxidation of the compound and then subjected to a bond cleavage process or a bond forming process.

DESCRIPTION OF THE PREFERRED EMBODIMENTS

Figure 1:
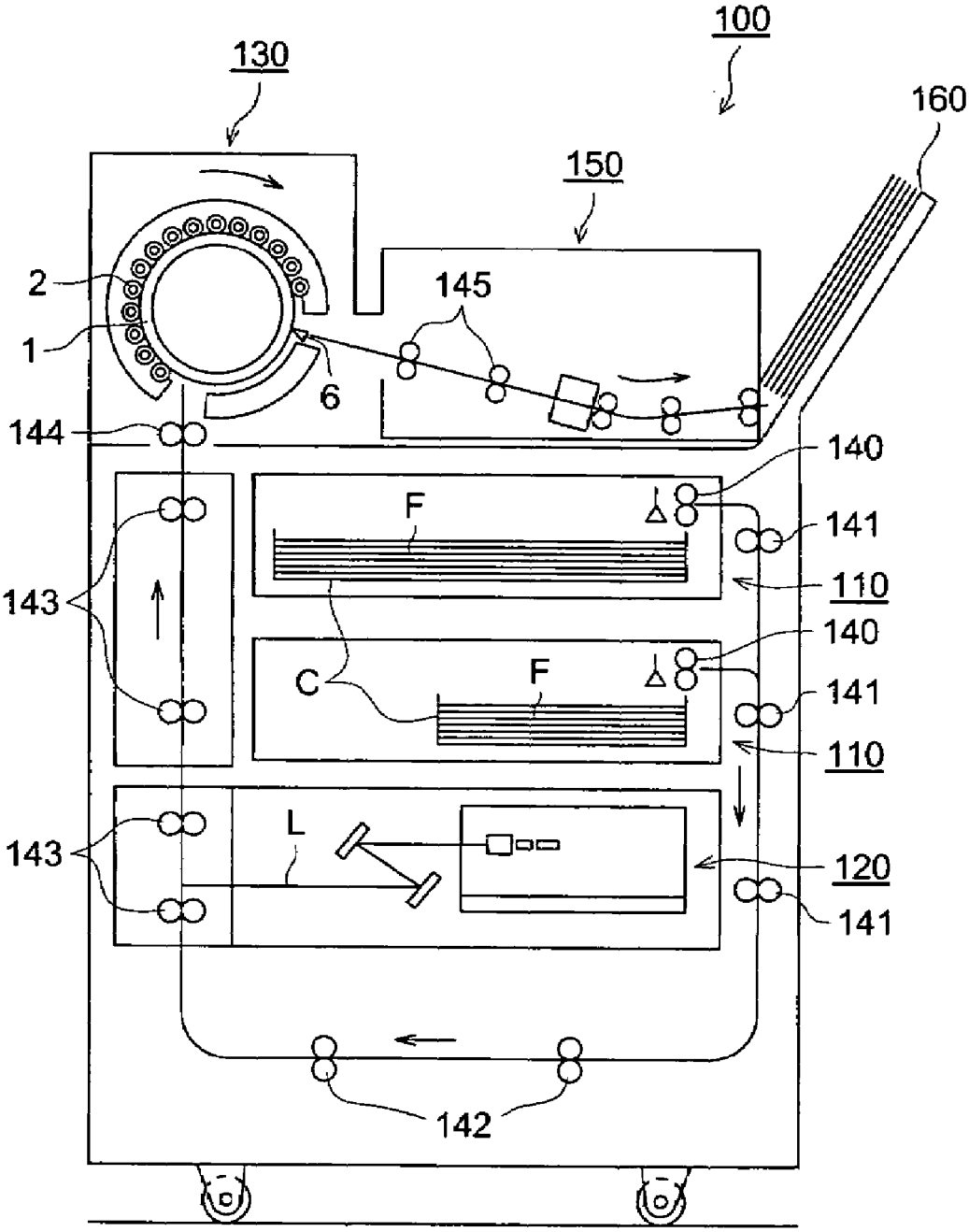
FIG. 1 is a view showing one example of the thermal processor which processes the heat developable light-sensitive material of the present invention.

The present invention can be achieved by the following structures.

(1) A photothermographic imaging material comprising a support having thereon an image forming layer containing light-insensitive organic silver salt grains, photosensitive silver halide grains, a reducing agent for silver ions and a binder, wherein:

(i) each of the photosensitive silver halide grains produces a larger number of latent images in a surface portion of the grain than in an inner portion of the grain by exposure to light;

(ii) each of the photosensitive silver halide grains produces a larger number of latent images in the inner portion of the grain than in the surface portion of the grain after being subjected to a thermal development;

(iii) a surface photographic speed of each of the photosensitive silver halide grains decreases after being subjected to the thermal development; and (iv) the photothermographic imaging material contains a reducible silver salt compound represented by General Formula (I):

$$M^1O_2C\text{-}L^1\text{-}CO_2M^2 \qquad \text{General Formula (I)}$$

wherein $L^1$ represents a divalent group selected from the group consisting of an alkylene group, an alkenylene group, an alkynylene group, a cycloalkylene group, an arylene group, a divalent heterocyclic group, —C(=O)—, —O—, —S—, —S(=O)—, —S(=O)$_2$—, and —N($R^1$)— or a combined group thereof; $R^1$ represents a hydrogen atom, an alkyl group, an alkenyl group, an alkynyl group, an aryl group, a heterocyclic group, an acyl group or a sulfonyl group; $M^1$ and $M^2$ each represents a hydrogen atom or a counter ion, provided that at least one of $M^1$ and $M^2$ represents a silver ion.

(2) A photothermographic imaging material comprising a support having thereon an image forming layer containing light-insensitive organic silver salt grains, photosensitive silver halide grains, a reducing agent for silver ions and a binder, wherein:

(i) each of the photosensitive silver halide grains produces a larger number of latent images in a surface portion of the grain than in an inner portion of the grain by exposure to light;

(ii) each of the photosensitive silver halide grains produces a larger number of latent images in the inner portion of the grain than in the surface portion of the grain after being subjected to a thermal development;

(iii) a surface photographic speed of each of the photosensitive silver halide grains decreases after being subjected to the thermal development; and (iv) the photothermographic imaging material contains a compound represented by one of the following General Formulas (1-1) to (1-5), (2-1), (3-1) and (4-1) to (4-2):

General Formula (1-1)

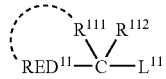

wherein $RED^{11}$ represents a reducing group which undergoes one electron oxidation; $L^{11}$ represents a releasing group; $R^{112}$ represents a hydrogen atom or a substituent; and $R^{111}$ represents a group of non-metallic atoms capable of forming a 5- or 6-membered ring with $RED^{11}$ and a carbon atom bonded with $RED^{11}$, General Formula (1-2)

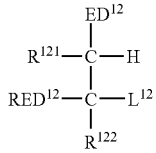

wherein $RED^{12}$ represents a reducing group which undergoes one electron oxidation; $L^{12}$ represents a releasing group; $R^{121}$ and $R^{122}$ independently represent a hydrogen atom or a substituent; and $ED^{12}$ represents an electron donating group, provided that $R^{121}$ and $RED^{12}$, $R^{121}$ and $R^{122}$ or $ED^{12}$ and $RED^{12}$ may join to form a ring, General Formula (1-3)

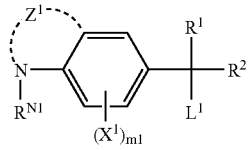

wherein $Z^1$ represents a group of atoms capable of forming a 6-membered ring together with two carbon atoms of a benzene ring and a nitrogen atom; $R^1$, $R^2$, and $R^{N1}$ independently represent a hydrogen atom or a substituent; $X^1$ represents a substitute capable of being substituted on a benzene ring; m1 represents an integer of 0-3; and $L^1$ represents a releasing group, General Formula (1-4)

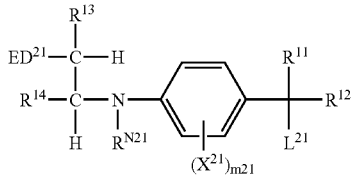

wherein $ED^{21}$ represents an electron donating group; $R^{11}$, $R^{12}$, $R^{N21}$, $R^{13}$, and $R^{14}$ independently represent a hydrogen atom or a substituent; $X^{21}$ represents a substituent capable of being substituted on a benzene ring; m2 represents an integer of 0-3; $L^{21}$ represents a releasing group, provided that $R^{N21}$, $R^{13}$, $R^{14}$, $X^{21}$, and $ED^{21}$ may join to form a ring.

General Formula (1-5)

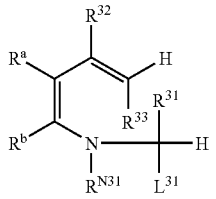

wherein $R^{32}$, $R^{33}$, $R^{31}$, $R^{N31}$, $R^a$ and $R^b$ independently represents a hydrogen atom or a substituent; $L^{31}$ represents a releasing group, provided that when $R^{N31}$ represents a group other than the aryl group, $R^a$ and $R^b$ join to form an aromatic ring, General Formula (2-1)

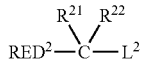

wherein $RED^2$ represents a reducing group which undergoes one electron oxidation; $L^2$ represents a releasing group, provided that when $L^2$ represents a silyl group, a nitrogen containing heterocyclic ring having two or more mercapto groups are present in the molecule; $R^{21}$ and $R^{22}$ independently represent a hydrogen atom or a substituent, provided that $RED^2$ and $R^{21}$ may join to form a ring, $RED^3$-$L^3$-$Y^3$ General Formula (3-1)

wherein $RED^3$ represents a reducing group which undergoes one electron oxidation; $Y^3$ represents a reactive group portion which undergoes reaction after $RED^3$ undergoes one-electron oxidation; and $L^3$ represents a linking group, General Formula (4-1)

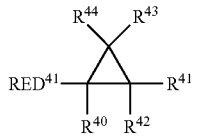

wherein $RED^{41}$ represents a reducing group which undergoes one electron oxidation; $R^{40}$ to $R^{44}$ independently represents a hydrogen atom or a substituent, General Formula (4-2)

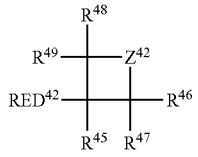

wherein $RED^{42}$ represents a reducing group which undergoes one electron oxidation; $R^{45}$ to $R^{49}$ independently represents a hydrogen atom or a substituent; $Z^{42}$ represents —$CR^{420}R^{421}$—, —$NR^{423}$—, or —O—, wherein $R^{420}$ and $R^{421}$ each represent a hydrogen atom or a substituent, while $R^{423}$ represents a hydrogen atom, an alkyl group, an aryl group, or a heterocyclic group.

(3) The photothermographic imaging material of Item 2, further contains a reducible silver salt compound represented by Formula (I) in the image forming layer:

$M^1O_2C$-$L^1$-$CO_2M^2$ Formula (I)

wherein $L^1$ represents a divalent group selected from the group consisting of an alkylene group, an alkenylene group, an alkynylene group, a cycloalkylene group, an arylene group, a divalent heterocyclic group, —C(=O)—, —O—, —S—, —S(=O)—, —S(=O)$_2$—, and —N($R^1$)— or a combined group thereof; $R^1$ represents a hydrogen atom, an alkyl group, an alkenyl group, an alkynyl group, an aryl group, a heterocyclic group, an acyl group or a sulfonyl group; $M^1$ and $M^2$ each represents a hydrogen atom or a counter ion, provided that at least one of $M^1$ and $M^2$ represents a silver ion.

(4) The photothermographic imaging material of Item 1, wherein an average equivalent circle diameter of the photosensitive silver halide grains is 10 to 100 nm.

(5) The photothermographic imaging material of Item 2, wherein an average equivalent circle diameter of the photosensitive silver halide grains is 10 to 100 nm.

(6) The photothermographic imaging material of Item 1, wherein the binder is water-soluble.

(7) The photothermographic imaging material of Item 2, wherein the binder is water-soluble.

(8) A method of forming an image comprising the steps of:

exposing the photothermographic imaging material of Item 1 to a laser having a wavelength of 600 to 900 nm; and thermally developing the exposed photothermographic imaging material.

(9) A method of forming an image comprising the steps of:

exposing the photothermographic imaging material of Item 2 to a laser having a wavelength of 600 to 900 nm; and thermally developing the exposed photothermographic imaging material.

(10) The method of forming an image of Item 8, wherein the thermally developing step is carried out under a temperature of 80 to 150° C. for a period of 5 to 20 seconds.

(11) The method of forming an image of Item 9, wherein the thermally developing step is carried out under a temperature of 80 to 150° C. for a period of 5 to 20 seconds.

(12) A photothermographic imaging material comprising a support having thereon an image forming layer containing light-insensitive organic silver salt grains, photosensitive silver halide grains, a reducing agent for silver ions and a binder, wherein:

(i) the organic silver salt grains contain a silver salt of a polymer having a molecular weight of 1,000 to 500,000, the polymer being derived from a monomer unit having a carboxyl group or a salt thereof;

(ii) each of the photosensitive silver halide grains produces a larger number of latent images in a surface portion of the grain than in an inner portion of the grain by exposure to light;

(iii) each of the photosensitive silver halide grains produces a larger number of latent images in the inner portion of the grain than in the surface portion of the grain after being subjected to a thermal development; and (iv) a surface photographic speed of each of the photosensitive silver halide grains decreases after being subjected to the thermal development.

(13) The photothermographic imaging material of Item 12, wherein the imaging material has a first photographic sensitivity value and a second photographic sensitivity value and the second photographic sensitivity value is not more than 1/10 of the first photographic sensitivity value, the first photographic sensitivity value being derived from a first characteristic curve obtained from the imaging material subjected to a first measuring method comprising the following steps in the order named:

(1a) exposing the imaging material to white light or infrared light using an optical wedge; and (1b) applying heat to the exposed imaging material under a predetermined condition so as to develop the exposed imaging material, and the second photographic sensitivity value being derived from a second characteristic curve obtained from the imaging material subjected to a second measuring method comprising the following steps in the order named:

(2a) applying heat to the imaging material under the same condition as (1b);

(2b) exposing the heated imaging material to white light or infrared light using the optical wedge; and (2c) applying heat to the exposed imaging material under the same condition as (1b).

(14) The photothermographic imaging material of Item 12, wherein the silver halide grains comprise a dopant capable of trapping an electron inside of the grains after being applied heat for developing the imaging material.

(15) The photothermographic imaging material of Item 12, wherein the silver halide grains are covered with a spectral sensitizing dye on surfaces of the grains so as to exhibit a spectral sensitivity, and the spectral sensitivity disappears after thermally developing the imaging material.

(16) The photothermographic imaging material of Item 12, wherein the silver halide grains are chemically sensitized on surfaces of the grains so as to exhibit an increase of sensitivity and the increase of sensitivity substantially disappears after thermally developing the imaging material.

(17) The photothermographic imaging material of Item 12, wherein the silver halide grains are covered with a spectral sensitizing dye on surfaces of the grains so as to exhibit a spectral sensitivity and the silver halide grains are chemically sensitized on the surfaces of the grains so as to exhibit an increase of sensitivity, and the spectral sensitivity and the increase of sensitivity by the chemical sensitization substantially disappear after thermally developing the imaging material.

(18) The photothermographic imaging material of Item 12, wherein the photosensitive silver halide grains contain silver iodide in an amount of 5 to 100 mol % based on the total mol of the silver halide grains.

(19) The photothermographic imaging material of Item 18, wherein the photosensitive silver halide grains contain silver iodide in an amount of 40 to 100 mol % based on the total mol of the silver halide grains.

(20) The photothermographic imaging material of Item 12, further comprises a first matting agent and a second matting agent on two sides of the support, the first matting agent being provided on one side of the support having the image forming layer; and the second matting agent being provided on the opposite-side of the support to the image forming layer, wherein a ratio of Lb (μm) to Le (μm) is between 2:1 and 10.0:1, provided that:

Lb is an average particle diameter of the second matting agent when the second matting agent is prepared by matting particles having a single peak particle diameter and Lb is a maximum average particle diameter of the second matting agent when the second matting agent is prepared by matting particles having a plurality of peaks in particle diameters; and Le is an average particle diameter of the first matting agent when the first matting agent is prepared by matting particles having a single maximum peak of particle diameter and Le is a maximum average particle diameter of the first matting agent when the first matting agent is prepared by matting particles having a plurality of peaks of particle diameters.

(21) The photothermographic imaging material of Item 12, wherein a ratio of a first ten-point average surface roughness Rz(E) to a second ten-point average surface roughness Rz(B) is between 0.1:1 and 0.70:1, the first ten-point average surface roughness being obtained at an outermost surface of one side of the support having the image forming layer; and the second ten-point average surface roughness being obtained at the opposite side of the support to the image forming layer.

(22) A method of forming an image comprising the steps of:

exposing the photothermographic imaging material of Item 12 to a light source; and thermally developing the exposed photothermographic imaging material with an thermal developing apparatus adjusted a conveying speed of the imaging material to be 20 to 200 mm/seconds.

(23) A method of forming an image comprising the steps of:

exposing the photothermographic imaging material of Item 12 to a laser having a maximum peak of emission strength in a wavelength of 350 to 450 nm; and thermally developing the exposed photothermographic imaging material.

The present invention enables to provide a photothermographic material exhibiting excellent storage stability and high image stability, with having high speed, low fogging and superior silver tone. Further the present invention provides an image forming method using the same.

The present invention will now be further detailed.

The photothermographic material of the present invention contains a reducible silver salt represented by General Formula (I) in addition to a light-insensitive organic silver salt.

$$M^1O_2C\text{-}L^1\text{-}CO_2M^2 \qquad \text{General Formula (I)}$$

wherein $L^1$ represents a divalent group selected from the group consisting of an alkylene group, an alkenylene group, an alkynylene group, a cycloalkylene group, an arylene group, a divalent heterocyclic group, —C(═O)—, —O—, —S—, —S(═O)—, —S(═O)$_2$—, and —N($R^1$)— or a combined group thereof; $R^1$ represents a hydrogen atom, an alkyl group, an alkenyl group, an alkynyl group, an aryl group, a heterocyclic group, an acyl group or a sulfonyl group; $M^1$ and $M^2$ each represents a hydrogen atom or a counter ion, provided that at least one of $M^1$ and $M^2$ represents a silver ion.

In General Formula (I), L1 is preferably an alkylene group of 1-40 carbon atoms, more preferably 2-30 carbon atoms, still more preferably 2-24 carbon atoms (for example, methylene group, ethylene group, trimethylene group, tetramethylene group, pentamethylene group, hexamethylene group, heptamethylene group, octamethylene group, nanomethylene group, decamethylene group, undecamethylene group, dodecamethylene group, tridecamethylene group, tetradecamethylene group, pentadecamethylene group, hexadecamethylene group, 1-methyl ethylene group, 1-ethyl ethylene group, cyclohexyl methylene group); an alkenylene group of 2-40 carbon atoms, more preferably 2-30 carbon atoms, still more preferably 2-24 carbon atoms (for example, vinylene group, propenylene group, butylene group, pentenylene group, 4-methylpentenylene group); an alkynylene of 2-40 carbon atoms, more preferably 2-30 carbon atoms, still more preferably 2-24 carbon atoms (for example, ethynylene group, propnylene group, pentynylene group); a cycloalkylene group of 3-40 carbon atoms, more preferably 5-30 carbon atoms, still more preferably 5-24 carbon atoms (for example, 1,2-cyclo propylene group, 1,3-cyclopentylene group, 1,4-cyclohexylene group); an arylene group of 6-40 carbon atoms, more preferably 6-30 carbon atoms, still more preferably 6-24 carbon atoms (for example, 1,2-phenylene group, 1,3-phenylene group, 1,4-phenylene group, 1,8-naphtylene group, 1,5-naphtylene group); a divalent heterocyclic group (2,3-thiophenediyl group, 3,4-thiophenediyl group, 3,4-francs-diyl-group, 2,3-pyrrole-diyl group, 1,3-pyrrole-diyl group, 1,4-glyoxaline-diyl group, 2,4-glyoxaline-diyl group, 3,4-pyrazole-diyl group, 2,3-pyridine-diyl group, 2,4-pyridine-diyl group, 2,5-pyridine-diyl group, 2,6-pyridine-diyl group, 3,4-pyridine-diyl group, 3,5-pyridine-diyl group, 2,3-pyrazine-diyl group, 3,6-pyridazine-diyl group, 1,2-indole-diyl group, 2,8-purine-diyl group, 2,4-quinoline-diyl group, 1,4-phthalazine-diyl group, 2,7-naphtylidine-diyl group, 2,3-quinoxaline-diyl group, 2,4-quinazoline-diyl group, 6,7-pteridine-diyl group, 2,9-carbazole-diyl group, 2,7-carbazole-diyl group, 1,2-pyrrolidine-diyl group, 1,3-imidazoline-diyl group, 1,2-pyrazolidine-diyl group, 3,5-pyrazolidine-diyl group, 1,4-piperidine-diyl group, 2,4-piperidine-diyl group, 1,3-isoindoline-diyl group, 3,4-morpholine-diyl group; a divalent group such as, —C(═O)—, —O—, —S—, —S(═O)—, 2 —S(═O)— and —N(R1)- or a divalent group formed by combination of them.

These bivalent groups may further have a substituent, Listed examples of substituents are as follows: halogen atom, alkyl group (including cycloalkyl group, bicycloalkyl group), alkenyl group (including cycloalkenyl group, bicycloalkenyl group), alkynyl group, aryl group, heterocycle group, cyano group, hydroxyl group, nitro group, carboxyl group, alkoxy group, aryl oxy group, silyl oxy group, heterocycle oxy group, acyl oxy group, carbamoyl oxy group, carbalkoxy oxy group, aryloxy carbonyl oxy-, amino group (including anilino group), acylamino-group, aminocarbonyl amino group, carbalkoxy amino group, aryloxy carbonyl amino group, sulfamoyl amino group, alkyl and arylsulfonyl amino group, mercapto group, alkylthio group, arylthio group, heterocycle thio group, sulfamoyl group, sulfo group, alkyl and aryl sulfinyl group, alkyl and aryl sulfonyl group, acyl group, aryloxy carbonyl group, alkoxycarbonyl group, carboxyl group, carbamoyl group, aryl and heterocycle azo group, imido group, phosphino group, phosphinyl group, phosphinyl oxy group, phosphinyl amino group, and silyl group.

When a carboxyl group is provided as a substituent, a compound expressed by General Formula (I) may further have a silver ion as a counter ion.

The groups will now be listed and detailed below: a halogen atom (e.g., a chlorine atom, a bromine atom, and an iodine atom); an alkyl group [including straight or branched chain or cyclic substituted or unsubstituted alkyl groups, these alkyl groups preferably including an alkyl group (having 1-30 carbon atoms such as methyl, ethyl, n-propyl, isopropyl, t-butyl, n-octyl, icosyl, 4-chloroethyl, 2-cyanoethyl, or 2-ethylhexyl), a cycloalkyl group (preferably a substituted or unsubstituted cycloalkyl group, having 3-30 carbon atoms, such as a cyclohexyl, cyclopentyl, 4-n-dodecylcyclohexyl), a bicycloalkyl group (a substituted or unsubstituted bicycloalkyl group, namely a univalent group which is formed by removing one hydrogen atom from bicycloalkane having 5-30 carbon atoms, such as [bicycle[1,2,2]heptane-2-yl, and alkyl bicycle[2,2,2]octane-yl and tricycle structures having many ring structures and the alkyl groups in a substituent described below (e.g., an alkyl group in an alkylthio group) also representing an alkyl group based on such concept]; an alkenyl group [including a straight or branched chain, or cyclic substituted or unsubstituted alkenyl group, including an alkenyl group (preferably a substituted or unsubstituted alkenyl group having 2-30 carbon atoms such as vinyl, allyl, prehnyl, geranyl, or oleyl), a cycloalkenyl group (preferably a cycloalkenyl group having 3-30 carbon atoms, namely a univalent group which is formed by removing one hydrogen atom from cycloalkane having 3-30 carbon atoms, such as 2-cyclopentane-21-yl or 2-cyclohexane-1-yl), a bicycloalkenyl group (a substituted or unsubstituted bicycloalkenyl group, preferably a substituted or unsubstituted bicycloalkenyl group having 5-30 carbon atoms, namely a univalent group which is formed by removing one hydrogen atom from bicycloalkane having one double bond, such as bicycle[2,2,1]hepto-2-ene-1-yl and bicycle[2,2,2]octo-2-ene-4-yl)]; an alkynyl group, preferably an alkynyl group including an substituted or unsubstituted alkynyl group having 2-30 carbon atoms such as an ethynyl, propagyl, or trimethylsylylethynyl group; an aryl group (preferably a substituted or unsubstituted aryl group having 6-30 carbon atoms, such as p-tolyl, naphthyl, m-chlorophenyl, o-hexadecanoylaminophenyl); a heterocyclyl group (preferably a univalent group which is formed by removing one hydrogen atom from a 5- or 6-membered substituted or unsubstituted aromatic or non-aromatic heterocyclic compound and more preferably a 5- or 6-membered aromatic heterocyclyl group, such as 2-furyl, 2-thenyl, 2-pyrimidyl, or 2-benzothiazoyl); a cyano group; a hydroxyl group; a nitro group; a carboxyl group, an alkoxy group (preferably a substituted or unsubstituted alkoxy group having 1-30 carbon atoms, such as methoxy, ethoxy, isoproxy, t-butoxy, n-octyloxy, or 2-methoxy; an aryloxy group (preferably a substituted or unsubstituted aryloxy group such as phenoxy, 2-methylphenoxy, 4-t-butylphnoxy, 3-nitrophenoxy, or 2-tetradecanoylaminophenoxy); a silyloxy group (preferably a silyloxy group having 3-20 carbon atoms-such as trimethylsilyloxy or t-butyldimethylsilyloxy); a heterocyclic oxy group (preferably a substituted or unsubstituted heterocyclic oxy group having 2-20 carbon atoms such as 1-penyltetrazole-5-oxy or 2-tetrahydropyranyloxy); an acyloxy group (preferably, a formyloxy group, a substituted or unsubstituted alkylcarbonyloxy group having 6-30 carbon atoms, a substituted or unsubstituted arylarylcarbonyloxy group having 6-30 carbon atoms such as formyloxy, acetyloxy, pivaroyloxy, stearoyloxy, benzoyloxy, or p-methoxyphenylcarbonyloxy); a carbamoyloxy group (preferably a substituted or unsubstituted carbamoyl group having 1-30 carbon atoms such as N,N-dimethylcarbamoyloxy, N,N-diethylcarbamoyloxy, morpholinocarbonyloxy, N,N-di-n-octylaminocarbonyloxy, or N-n-octylcarbamoyloxy), an alkoxycarbonyloxy group (preferably a substituted or unsubstituted alkoxycarbonyloxy group having 2-30 carbon atoms such as methoxycarbinyloxy, ethoxycarbonyloxy, t-butoxycarbonyloxy, or n-octylcarbonyloxy); an aryloxycarbonyloxy group (preferably a substituted or unsubstituted aryloxycarbonyloxy group having 7-30 carbon atoms such as phenoxycarbonyloxy, p-methoxyphenoxycarbonyloxy, or p-n-hexadecyloxypenoxycarbonyloxy); an amino group (preferably a substituted or unsubstituted amino group having 1-30 carbon atoms and a substituted or unsubstituted anilino group having 6-30 carbon atoms such amino, methylamino, dimethylamino, anilino, N-methyl-anilino, or dipenylamino); an acylamino group (preferably a formylamino group, a substituted or unsubstituted alkylcarbonylamino group having 1-30 carbon atoms, or a substituted, or unsubstituted arylcarbonylamino group having 6-30 carbon atoms such as formylamino, acetylamino, pivaloylamino, lauroylamino, benzoylamino, or 3,4,5-tri-n-octyloxyphenylcarbonylamino); an aminocarbonylamino group (preferably a substituted or unsubstituted aminocarbonylamino group having 1-30 carbon atoms such as carbamoyl, N,N-dimethylaminocarbonylamino, N,N-diethylaminocarbonylamino, or morphlinocarbonylamino); an alkoxycarbonylamino group (preferably a substituted or unsubstituted alkoxycarbonylamino group having 2-30 carbon atoms such as methoxycsarbonylamino, ethoxycarbonylamino, t-butoxycarbonylamino, n-octadecyloxycarbonylamino, or N-methylmethoxycarbonylamino); an aryloxycarbonylamino group (preferably a substituted or unsubstituted aryloxycarbonylamino group having 7-30 carbon atoms such as penoxycarbonylamino, p-chlorophenoxycsarbonylamino, or m-(n-octyloxy)phenoxycarbonylamino); a sulfamoylamino group (preferably a substituted or unsubstituted sulfamoylamino group having 0-30 carbon atoms such as sulfamoylamino, N,N-dimethylaminosulfonylamino, or N-n-octylaminosulfonylamino), an alkyl and arylsulfonylamino group (preferably a substituted or unsubstituted alkylsulfonylamino group having 6-30 carbon atoms such as methylsulfonylamino, butylaulfonylamino, phenylsulfonylamino, 2,3,5-trichlorophenylsulfonylamino, orp-methylphenylsulfonylamino), a mercapto group; an alkylthiogroup (preferably a substituted or unsubstituted alkylthio group having 1-30 carbon atoms such as methylthio, ethylthio, or n-hexadecylthio); an arylthio group (preferably a substituted or unsubstituted arylthio group having 6-30 carbon atoms such as phenylthio, p-chlorophenylthio, or m-methoxyphenylthio); a heterocyclicthio group (preferably a substituted or unsubstituted heterocycxlicthio group having 2-30 carbon atoms such as 2-bvenzothiazolylthio or 1-phenyltrtrazole-5-ylthio); a sulfamoyl group (preferably a substituted or unsubstituted sulfamoyl group having 0-30 carbon atoms such as N-ethylsulfamoyl, N-(3-dodecyloxypropyl)sulfamoyl, N,N-dimethylsulfamoyl, N-acetylsulfamoyl, N-benzoylsulfamoyl, or N-(N'-phenylcarbamoyl)sulfamoyl); a sulfo group; an alkyl and arylsulfinyl group (preferably a substituted or unsubstituted alklsulfinyl group having 1-30 carbon atoms or a substituted or unsubstituted alkylsulfinyl group having 6-30 carbon atoms such as methylsulfinyl, ethylsulfinyl, phenylsulfonyl, or p-methylphenylsulfinyl); an alkyl and arylsulfonyl group (preferably a substituted or unsubstituted alkylsulfonyl group having 1-30 carbon atoms or a substituted or unsubstituted arylsulfonyl group having 6-30 carbon atoms such as methylsulfonyl, ethylsulfonyl, phenylsulfonyl, or p-methylphenylsulfonyl); an acyl group (preferably a formyl group, a substituted or unsubstituted alkylcarbonyl group having 2-30 carbon atoms, a substituted or unsubstituted arylcarbonyl group having 7-30 carbon atoms, or a substituted or unsubstituted heterocyclic carbonyl group having 4-30 carbon atoms, which bonds to a carbonyl group via a carbon atom, such as acetyl pivaloyl, 2-chloroacetyl, stearoyl, benzoyl, p-(n-octyloxy)phenylcarbonyl, 2-pyridylcarbonyl, or 2-furylcarbonyl); an aryloxycarbonyl group (preferably a substituted or unsubstituted aryloxycarbonyl group having 7-30 carbon atoms such as penoxycarbonyl, o-chlorophenoxycarbonyl, m-nitrophenoxycarbonyl, or p-t-butylphenoxycarbonyl); an alkoxycarbonyl group (preferably a substituted or unsubstituted alkoxycarbonyl group having 2-30 carbon atoms such as methoxycarbonyl, ethoxycarbonyl, t-butoxycarbonyl, or n-octadecyloxycarbonyl); a carboxyl group; a carbamoyl group (preferably a substituted or unsubstituted carbamoyl group having 1-30 carbon atoms such as carbamoyl, N-methylcarbamoyl, N,N-dimethylcarbamoyl, N,N-di-n-octylcarbamoyl, N-(methylsulfonyl)carbsamoyl, N,N-di-n-octylcarbamoyl, or N-(methylsulfonyl)carbamoyl), an aryl and heterocyclic azo group (preferably a substituted or unsubstituted arylazo group having 6-30 carbon atoms or a substituted or unsubstituted heterocyclic azo group having 3-30 carbon atoms such as such as phenylazo, p-chlorophenylazo, or 5-ethylthio-1,3,4-thiadiazole-2-ylazo); an amido group (preferably a N-succinimido or N-phthalimido); a phosphino group (preferably a substituted or unsubstituted phosphino group having 2-30 carbon atoms such as dimethylphosphino, diphenylphosphino, or methylphenoxyphosphino); a phosphinyl group (preferably a substituted or unsubstituted phosphinyl group having 2-30 carbon atoms such as phosphynyl, dioctyloxyphosphinyl, or diethoxyphosphinyl); a phosphinyloxy group (preferably a substituted or unsubstituted phosphinyloxy group having 2-30 carbon atoms such as diphenoxyphosphinyloxy or dioctyloxyphosphinyloxy); a phosphinylamino group (preferably a substituted or unsubstituted phosphinylamino group having 2-30 carbon atoms such as dimethoxyphosphinylamino or dimethylaminophosphinylamino), or a silyl group (preferably a substituted or unsubstituted silyl group having 3-30 carbon atoms such as trimethylsilyl, t-butylmethylsilyl, phenyldimethylsilyl). Of the above functional groups, those having a hydrogen atom(s) may be removed and may be further substituted with the above group. Examples of such functional groups include an alkylcarbonylaminosulfonyl group, an arylcarbonylaminosulfonyl group, an alkylsulfonylaminocarbonyl group, and an arylsulfonylaminocsrbonyl group. Listed as those examples are a methylsulfonylaminocabonyl group, a p-methylphenylsulfonylaminocarbonyl group, an acetylaminosulfonyl group, and a benzoylaminosulfonyl group.

$R^1$ represents a hydrogen atom, an alkyl group, an alkenyl group, an alkynyl group, an aryl group, a heterocyclyl group, an acyl group, or a sulfonyl group. The alkyl group, the alkenyl group, the alkynyl group, the aryl group, the heterocyclyl group, the acyl group, or the sulfonyl group may further have a substituent. Listed as examples of preferred substituents may be those of the aforesaid $L^1$.

$R^1$ is preferably an alkyl group (preferably a substituted or unsubstituted alkyl group having 1-30 carbon atoms, such as methyl, ethyl, n-propyl, isopropyl, t-butyl, n-octyl, t-octyl, nonyl, decyl undecyl, dodecyl, tridecyl, tetradecyl, pentadecyl, hexadecyl, heptadecyl, octadecyl, icosyl, henicosyl, docosyl, 2-chloroethyl, 2-cyanoethyl, 2-ethylhexyl, cyclohexyl, cyclopentyl, or 4-n-dodecylcyclohexycyl), an aryl group (preferably a substituted or unsubstituted aryl group having 6-30 carbon atoms, such as phenyl, p-tolyl, naphthyl, m-chlorophenyl, or o-hexadecanoylaminophenyl), an acyl group, or a sulfonyl group. Of these, the alkyl group, the aryl group, and the acyl group are more preferred and the acyl group is particularly preferred.

When $L^1$ represents a composite substituent formed by combinations of divalent groups, listed as examples of composite substituents may be esters (alkyloxycarbonyl, aryloxycarbonyl, or carbonic acid esters, thiocarboxylic acid esters, dithiocarboxylic acid esters, amides (carbamoyl), substituted ureas (ureylene), substituted thiourea, sulfonamides (sulfamoyl), imides, hydrazines, hydrazides (hydrazinocarbonyl), amidines, ethers, thioethers, and acyls. These groups may further be combined and may possess a substituent.

Listed as preferred examples of the compounds represented by General Formula (I) are groups having at least one divalent composite group which is formed by combining a group in which $L^1$ represents —$N(R^2)$— and an alkylene group, wherein $R^2$ represents an alkyl group (having preferably 1-40 carbon atoms, more preferably 4-30 carbon atoms, and most preferably 6-25 carbon atoms), an alkenyl group (having preferably 2-40 carbon atoms, more preferably 4-30 carbon atoms, and most preferably 6-25 carbon atoms), an alkynyl group (having preferably 2-40 carbon atoms, more preferably 4-30 carbon atoms, and most preferably 6-25 carbon atoms), an aryl group (having preferably 5-50 carbon atoms, more preferably 6-40 carbon atoms, and most preferably 6-30 carbon atoms), an acyl group (having preferably 1-40 carbon atoms, more preferably 4-30 carbon atoms, and most preferably 6-25 carbon atoms), or a sulfonyl group (having preferably 1-40 carbon atoms, more preferably 4-30 carbon atoms, and most preferably 6-25 carbon atoms).

Listed as divalent composite groups formed by combining —$N(R^2)$— represented by$l^1$ and an alkylene group are —$(CH)_m N(R^2)$—$(CH)_m$— (n and m are each preferably 1-30) and —$(CH)_1 N(R^2)$—$(CH)_n N(R^2)$—$(CH)_m$— (l, m, and n are each preferably 1-30). These alkylene groups may have a substituent.

Listed as preferred examples of the compounds represented by General Formula (I) are those in which $L^1$ represents at least one group selected from an alkylene group (having preferably 1-40 carbon atoms, more preferably 4-30 carbon atoms, and most preferably 6-25 carbon atoms), an alkynylene group (having preferably 2-40 carbon atoms, more preferably 4-30 carbon atoms, and most preferably 6-25 carbon atoms), a cycloalkylene group (having preferably 3-20 carbon atoms, more preferably 5-20 carbon atoms, and most preferably 6-15 carbon atoms), an arylene group (having preferably 6-40 carbon atoms, more preferably 6-30 carbon atoms, and most preferably 6-20 carbon atoms), and a divalent heterocyclyl group (having preferably 1-30 carbon atoms, more preferably 1-20 carbon atoms, and most preferably 2-15 carbon atoms), at least one of these groups has, as a substituent, an —$NHCOR^3$ group, an —$NHCOR^4$ group, an —$NHCOR^5$ group, a —$CO_2R^6$ group, an —$NHSO_2R^7$ group, a —$SO_2NHR^8$ group, a —$SO_3R^9$ group, an —$OSO_2R^{10}$ group (wherein $R^3$-$R^{10}$ are each as defined for $R^2$). $L^1$ may be a straight or branched chain.

Listed as preferred examples of the compounds represented by General Formula (I) are those in which $L^1$ represents an alkylene group having at least one substituent. Listed as examples of preferred substituents of the alkylene group are a halogen atom, an alkyl group (including a cycloalkyl group and a bicycloalkyl group), an alkenyl group, an alkenyl group (including a cycloalkenyl group, and a bicycloalkenyl group), an alkynyl group, an alkenyl group (including a cycloalkenyl group and a bicycloalkenyl group), an alkynyl group, an aryl group, a heterocyclyl group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), —$NHCOR^3$ group ($R^3$ is as defined for $R^2$), an aminocarbonylamino group, an alkoxycarbonylamino group, an aryloxycarbonylamino group, a sulfamoylamino group, an alkyl- and arylsulfonylamino group, a mercapto group, an alkylthio group, an arylthio group, a heterocyclic thio group, a sulfamoyl group, a sulfo group, an alkyl- and arylsulfinyl group, an alkyl- and arylsulfonyl group, an acyl group, an aryloxycarbonyl group, an alkoxycarbonyl group, a carbamoyl group, an aryl- and heterocyclicazo group, an imido group, a phosphino group, a phosfinyl group, a phosfinyloxy group, a phsofinylamino group, and a silyl group. Preferably listed are an alkyl group (having preferably 1-40 carbon atoms, more preferably 4-30 carbon atoms, and most preferably 6-25 carbon atoms), an alkenyl group (having preferably 2-40 carbon atoms, more preferably 4-30 carbon atoms, and most preferably 6-25 carbon atoms), an alkynyl group (having preferably 2-40 carbon atoms, more preferably 4-30 carbon atoms, and most preferably 6-25 carbon atoms), an aryl group (having preferably 6-40 carbon atoms, more preferably 6-30 carbon atoms, and most preferably 6-25 carbon atoms), a heterocyclyl group, an alkoxy group (having preferably 2-40 carbon atoms, more preferably 4-30 carbon atoms, and most preferably 6-25 carbon atoms), an aryloxy group (having preferably 6-40 carbon atoms, more preferably 6-30 carbon atoms, and most preferably 6-25 carbon atoms), a heterocyclic oxy group, an acyloxy group (having preferably 2-40 carbon atoms, more preferably 4-30 carbon atoms, and most preferably 6-25 carbon atoms), a carbamoyloxy group (having preferably 2-40 carbon atoms, more preferably 4-30 carbon atoms, and most preferably 6-25 carbon atoms), an amino group (having preferably 1-40 carbon atoms, more preferably 4-30 carbon atoms, and most preferably 6-25 carbon atoms), an —$NHCOR^3$ group ($R^3$ is as defined for $R^2$) (having preferably 1-40 carbon atoms, more preferably 4-30 carbon atoms, and most preferably 6-25 carbon atoms), a sulfamoylamino group (having preferably 1-40 carbon atoms, more preferably 4-30 carbon atoms, and most preferably 6-25 carbon atoms), an alkyl- and arylsulfonylamino group (having preferably 1-40 carbon atoms, more preferably 4-30 carbon atoms, and most preferably 6-25 carbon atoms), a sulfamoyl group (having preferably 1-40 carbon atoms, more preferably 4-30 carbon atoms, and most preferably 6-25 carbon atoms), an alkyl-arylsulfonyl group (having preferably 1-40 carbon atoms, more preferably 4-30 carbon atoms, and most preferably 6-25 carbon atoms), an acyl group (having preferably 1-40 carbon atoms, more preferably 4-30 carbon atoms, and most preferably 6-25 carbon atoms), an aryloxycarbonyl group (having preferably 6-40 carbon atoms, more preferably 6-30 carbon atoms, and most preferably 6-25 carbon atoms), an alkoxycarbonyl group (having preferably 1-40 carbon atoms, more preferably 4-30 carbon atoms, and most preferably 6-25 carbon atoms), and a carbamoyl group (having preferably 1-40 carbon atoms, more preferably 4-30 carbon atoms, and most preferably 6-25 carbon atoms).

Listed as particularly preferred groups are an alkyl group (having preferably 1-40 carbon atoms, more preferably 4-30 carbon atoms, and most preferably 6-25 carbon atoms), an alkenyl group (having preferably 2-40 carbon atoms, more preferably 4-30 carbon atoms, and most preferably 6-25 carbon atoms), an alkynyl group (having preferably 2-40 carbon atoms, more preferably 4-30 carbon atoms, and most preferably 6-25 carbon atoms), an aryl group (having preferably 6-40 carbon atoms, more preferably 6-30 carbon atoms, and most preferably 6-25 carbon atoms), an alkoxy group, an alkoxy group (having preferably 1-40 carbon atoms, more preferably 4-30 carbon atoms, and most preferably 6-25 carbon atoms), an aryloxy group (having preferably 6-40 carbon atoms, more preferably 6-30 carbon atoms, and most preferably 6-25 carbon atoms), and an —NHCOR$^3$ group ($R^3$ is as defined for $R^2$) (having preferably 1-40 carbon atoms, more preferably 4-30 carbon atoms, and most preferably 6-25 carbon atoms).

Listed as preferred examples of the compounds represented by General Formula (I) are those in which $L^1$ is a divalent complex group made by combination of, —C(═O)— and —O— are, an acyloxy, carbamoyloxy, alkoxycarbonyloxy, aryloxycarbonyloxy, alkoxycarbonylamino, aryloxycarbonylamino group.

Listed as preferred examples of the compounds represented by General Formula (I) are those in which $L^1$ is a group having at least one aromatic group. Aromatic groups, as described herein, include an aryl group (preferably a substituted or unsubstituted aryl group having 1-30 carbon atoms, such as phenyl, p-tolyl, naphthyl, m-chlorophenyl, o-hexadecanoylaminophenol), an aromatic heterocyclyl group (preferably a 5- or 6-membered aromatic heterocyclyl group having 3-30 carbon atoms, such as furyl, thienyl, pyridyl, pyrimidyl, pyrazinyl, pyridazinyl, quinolyl, isoquinolyl, indolyl, benzimidazolyl, quinoxalinyl, quinazolyl, indazolyl, phthalazinyl, purynyl, pteridinyl, or carbazolyl). These groups may further have a substituent. Listed as examples of such substituents may be substituents possessed by aforesaid $L^1$.

With regard to the compounds represented by General Formula (I), the ratio obtained by dividing the molecular weight of the compound represented by General Formula (I) by the number of silver(I) ions per molecule of the compound represented by General Formula (I) is preferably 160-400, is more preferably 250-400, but is most preferably 300-400.

The melting point of the free carboxylic acid of the compound represented by General Formula (I) of the present invention is preferably 30-200° C., is more preferably 50-180° C., and is most preferably 65-150° C. Free carboxylic acids of the compounds represented by General Formula (I), as described herein, refer to those in a form in which all the carboxyl groups in the compounds represented by General Formula (I) do not form intermolecular salts with counter ions, namely those which are converted to a structure represented by —COOH.

Further, the phase transformation temperature of the compound represented by General Formula (I) of the present invention is preferably 50-180° C., is more preferably 70-170, and is most preferably 85-150° C.

In the present invention, the amount of compounds represented by General Formula (I) is commonly at least 70 mol percent with respect to the total organic silver, is preferably at least 85 mol percent, and is more preferably at least 95 mol percent.

The compounds represented by General Formula (I) of the present invention may be employed individually or in combinations of at least two types. When the compounds represented by General Formula (I) are employed in combinations, they may be composed of at least two types of compounds which differ in the plane structures or mixtures of isomers such as a geometrical isomer, a stereoisomer, a diastereomer, or an enantiomer.

The compounds represented by General Formula (I) of the present invention may be produced employing any of the known synthetic methods. It is possible for a person skilled in the art to easily produce those compounds while referring to references described on pages 1-43 and 193-227 of Jikken Kagaku Koza Dai 4 Han 22 Kan (Experimental Chemistry lecture 4th Edition, Volume 22) edited by Nihon Kagaku Kai.

Specific examples of the compounds represented by General Formula (I) of the present invention will now be shown below, however the present invention is not limited thereto.

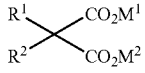

| Compound | $R^1$ | $R^2$ | $M^1$ | $M^2$ |
|---|---|---|---|---|
| I-1 | $C_4H_9$ | H | Ag | H |
| I-2 | $C_4H_9$ | $C_4H_9$ | Ag | Ag |
| I-3 | $C_6H_{13}$ | $C_6H_{13}$ | Ag | Ag |
| I-4 | $C_4H_9$ | $C_6H_{13}$ | Ag | Ag |
| I-5 | $C_8H_{17}$ | $C_8H_{17}$ | Ag | Ag |
| I-6 | $C_{10}H_{21}$ | $C_{10}H_{21}$ | Ag | Ag |
| I-7 | $C_{12}H_{25}$ | $C_{12}H_{25}$ | Ag | Ag |
| I-8 | $C_{16}H_{33}$ | $C_6H_{13}$ | Ag | Ag |
| I-9 | (cyclohexylidene) | | Ag | Ag |
| I-10 | $C_6H_5CH_2$ | $C_6H_5CH_2$ | Ag | Ag |
| I-11 | $C_6H_5$ | $C_6H_5$ | Ag | Ag |
| I-12 | c-$C_6H_{11}$ | c-$C_6H_{11}$ | Ag | Ag |
| I-13 | 4-methoxybenzyl | 4-methoxybenzyl | Ag | Ag |
| I-14 | 4-hexyloxybenzyl | 4-hexyloxybenzyl | Ag | Ag |
| I-15 | 2-ethylhexyl | 2-ethylhexyl | Ag | Ag |

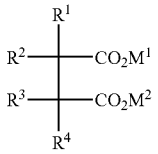

| Compound | $R^1$ | $R^2$ | $R^3$ | $R^4$ | $M^1$ | $M^2$ |
|---|---|---|---|---|---|---|
| I-21 | $C_6H_{13}$ | H | H | H | Ag | Ag |
| I-22 | $C_8H_{17}$ | H | H | H | Ag | Ag |
| I-23 | $C_{10}H_{21}$ | H | H | H | Ag | Ag |
| I-24 | $C_{12}H_{26}$ | H | H | H | Ag | Ag |

-continued

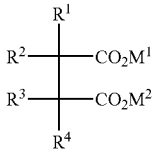

| Compound | $R^1$ | $R^2$ | $R^3$ | $R^4$ | $M^1$ | $M^2$ |
|---|---|---|---|---|---|---|
| I-25 | $C_{14}H_{29}$ | H | H | H | Ag | Ag |
| I-26 | $C_{16}H_{33}$ | H | H | H | Ag | Ag |
| I-27 | $C_{18}H_{37}$ | H | H | H | Ag | Ag |
| I-28 | $C_{20}H_{41}$ | H | H | H | Ag | Ag |
| I-29 | $C_{22}H_{45}$ | H | H | H | Ag | Ag |
| I-30 | $C_2H_5OC_2H_4$— | H | H | H | Ag | Ag |
| I-31 | $C_2H_5OC_2H_4OC_2H_4$— | H | H | H | Ag | Ag |
| I-32 | $HOC_2H_4C_2H_4OC_2H_4$— | H | H | H | Ag | Ag |
| I-33 | $HOC_6H_{12}$— | H | H | H | Ag | Ag |
| I-34 | $HOC_8H_{16}$— | H | H | H | Ag | Ag |
| I-35 | $HOC_{10}H_{20}$— | H | H | H | Ag | Ag |
| I-36 | $HOC_{12}H_{24}$— | H | H | H | Ag | Ag |
| I-37 | $C_6H_{13}NH$— | H | H | H | Ag | Ag |
| I-38 | $C_8H_{17}NH$— | H | H | H | Ag | Ag |
| I-39 | $C_{12}H_{25}NH$— | H | H | H | Ag | Ag |
| I-40 | $C_{16}H_{33}NH$— | H | H | H | Ag | Ag |
| I-41 | $C_{22}H_{45}NH$— | H | H | H | Ag | Ag |
| I-42 | $(C_2H_5)_2N$— | H | H | H | Ag | Ag |
| I-43 | $(C_3H_7)_2N$— | H | H | H | Ag | Ag |
| I-44 | $((i)C_3H_7)_2N$— | H | H | H | Ag | Ag |
| I-45 | $((n)C_4H_9)_2N$— | H | H | H | Ag | Ag |
| I-46 | $((t)C_4H_9)_2N$— | H | H | H | Ag | Ag |
| I-47 | $(C_6H_{13})_2N$— | H | H | H | Ag | Ag |
| I-48 | $(C_8H_{17})_2N$— | H | H | H | Ag | Ag |
| I-49 | $(C_9H_{19})_2N$— | H | H | H | Ag | Ag |
| I-50 | $(C_{10}H_{21})_2N$— | H | H | H | Ag | Ag |
| I-51 | $(C_{12}H_{25})_2N$— | H | H | H | Ag | Ag |
| I-52 | $(C—C_5H_{11})_2N$— | H | H | H | Ag | Ag |
| I-53 | $(C_6H_5)_2N$— | H | H | H | Ag | Ag |
| I-54 | $(C_6H_5CH_2)_2N$— | H | H | H | Ag | Ag |
| I-55 | $C_6H_{13}CONH$ | H | H | H | Ag | Ag |
| I-56 | $C_7H_{15}CONH$ | H | H | H | Ag | Ag |
| I-57 | $C_9H_{19}CONH$ | H | H | H | Ag | Ag |
| I-58 | $C_{11}H_{23}CONH$ | H | H | H | Ag | Ag |
| I-59 | $C_{13}H_{27}CONH$ | H | H | H | Ag | Ag |
| I-60 | $C_{15}H_{31}CONH$ | H | H | H | Ag | Ag |
| I-61 | $C_{17}H_{35}CONH$ | H | H | H | Ag | Ag |
| I-62 | $C_{19}H_{39}CONH$ | H | H | H | Ag | Ag |
| I-63 | $C_{21}H_{43}CONH$ | H | H | H | Ag | Ag |
| I-64 | $C_{23}H_{47}CONH$ | H | H | H | Ag | Ag |
| I-65 | $C_6H_5CONH$ | H | H | H | Ag | Ag |
| I-66 | $C_6H_5CH_2CONH$ | H | H | H | Ag | Ag |
| I-67 | 4-$(CH_3O)$—$C_6H_4CONH$ | H | H | H | Ag | Ag |
| I-68 | 4-$(C_2H_5O)$—$C_6H_4CONH$ | H | H | H | Ag | Ag |
| I-69 | 4-$(C_6H_{13}O)$—$C_6H_4CONH$ | H | H | H | Ag | Ag |
| I-70 | 4-$CH_3$—$C_6H_4CONH$ | H | H | H | Ag | Ag |
| I-71 | 2-$CH_3$—$C_6H_4CONH$ | H | H | H | Ag | Ag |
| I-72 | 2,4-$(CH_3)_2$—$C_6H_3CONH$ | H | H | H | Ag | Ag |
| I-73 | 4-$(i)C_3H_7$—$C_6H_4CONH$ | H | H | H | Ag | Ag |
| I-74 | 4-$(t)C_4H_9$—$C_6H_4CONH$ | H | H | H | Ag | Ag |
| I-75 | 4-$CH_3$—$C_6H_4SO_2NH$ | H | H | H | Ag | Ag |
| I-76 | $C_6H_5SO_2NH$ | H | H | H | Ag | Ag |
| I-77 | $C_{12}H_{25}SO_2NH$ | H | H | H | Ag | Ag |
| I-78 | 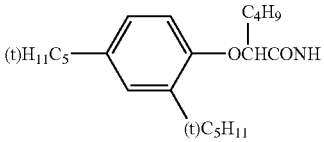 | H | H | H | Ag | Ag |
| I-79 | 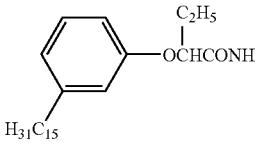 | H | H | H | Ag | Ag |

-continued
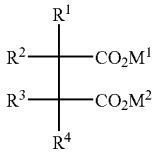
| Compound | $R^1$ | $R^2$ | $R^3$ | $R^4$ | $M^1$ | $M^2$ |
|---|---|---|---|---|---|---|
| I-80 | 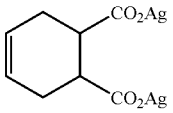 | | | | | |
| I-81 | 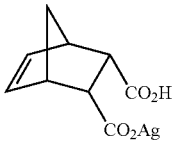 | | | | | |
| I-82 | 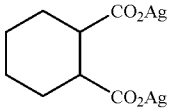 | | | | | |
| I-83 | 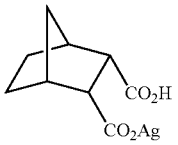 | | | | | |
| I-84 | 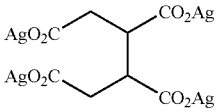 | | | | | |
| I-85 | 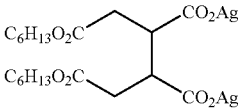 | | | | | |
| I-86 | 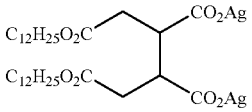 | | | | | |
| I-87 | 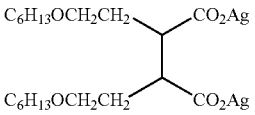 | | | | | |
| I-88 | 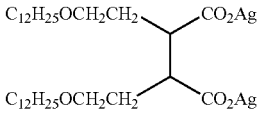 | | | | | |
| I-89 | 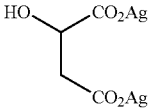 | | | | | |

-continued
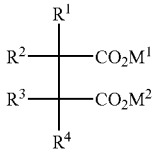
| Compound | $R^1$ | $R^2$ | $R^3$ | $R^4$ | $M^1$ | $M^2$ |
|---|---|---|---|---|---|---|
| I-90 | 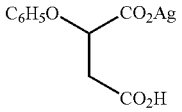 | | | | | |
| I-91 | 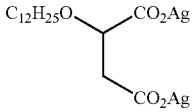 | | | | | |
| I-92 | 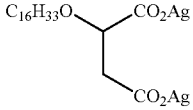 | | | | | |
| I-93 | 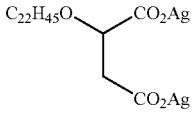 | | | | | |
| I-94 | 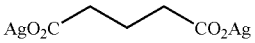 | | | | | |
| I-95 | 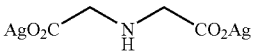 | | | | | |
| I-96 | 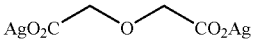 | | | | | |
| I-97 | 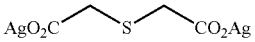 | | | | | |
| I-98 | 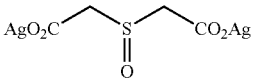 | | | | | |
| I-99 | 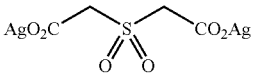 | | | | | |
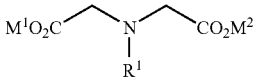
| Compound | $R^1$ | $M^1$ | $M^2$ |
|---|---|---|---|
| I-100 | $C_6H_{13}$ | Ag | H |
| I-101 | $C_{10}H_{21}$ | Ag | Ag |
| I-102 | $C_{12}H_{25}$ | Ag | Ag |
| I-103 | $C_{18}H_{37}$ | Ag | Ag |
| I-104 | $C_{22}H_{45}$ | Ag | Ag |
| I-105 | $COC_6H_{13}$ | Ag | Ag |
-continued
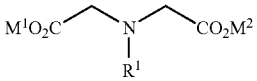
| Compound | $R^1$ | $M^1$ | $M^2$ |
|---|---|---|---|
| I-106 | 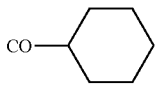 | Ag | Ag |
| I-107 | $COC_{10}H_{21}$ | Ag | Ag |
| I-108 | $COC_9H_{19}$ | Ag | Ag |
| I-109 | $COC_{11}H_{23}$ | Ag | Ag |
| I-110 | $COC_{17}H_{35}$ | Ag | Ag |
| I-111 | $COC_{19}H_{39}$ | Ag | Ag |

-continued

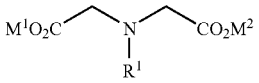

| Compound | $R^1$ | $M^1$ | $M^2$ |
|---|---|---|---|
| I-112 | $COC_{21}H_{43}$ | Ag | Ag |
| I-113 | $COC_{23}H_{47}$ | Ag | Ag |

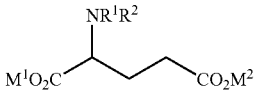

| Compound | $R^1$ | $R^2$ | $M^1$ | $M^2$ |
|---|---|---|---|---|
| I-114 | $C_6H_{13}$ | H | Ag | Ag |
| I-115 | $C_8H_{17}$ | H | Ag | Ag |
| I-116 | $C_{12}H_{25}$ | H | Ag | Ag |
| I-117 | $C_{16}H_{33}$ | H | Ag | Ag |
| I-118 | $C_{18}H_{37}$ | H | Ag | Ag |
| I-119 | $C_{20}H_{41}$ | H | Ag | Ag |
| I-120 | $C_{22}H_{45}$ | H | Ag | Ag |
| I-121 | $C_6H_{13}$ | $C_6H_{13}$ | Ag | Ag |
| I-122 | $C_{10}H_{21}$ | $C_{10}H_{21}$ | Ag | Ag |
| I-123 | $C_6H_5$ | H | Ag | Ag |
| I-124 | $C_9H_{19}CO$ | H | Ag | Ag |
| I-125 | $C_{11}H_{23}CO$ | H | Ag | Ag |
| I-126 | $C_{15}H_{31}CO$ | H | Ag | Ag |
| I-127 | $C_{19}H_{39}CO$ | H | Ag | Ag |
| I-128 | $C_{21}H_{43}CO$ | H | Ag | Ag |
| I-129 | $C_{23}H_{47}CO$ | H | Ag | Ag |
| I-130 | $C_6H_5CO$ | H | Ag | Ag |
| I-131 | $C_{12}H_{25}SO_2$ | H | Ag | Ag |
| I-132 | $C_{22}H_{45}SO_2$ | H | Ag | Ag |
| I-133 | $C_{12}H_{25}NHCO$ | H | Ag | Ag |
| I-134 | 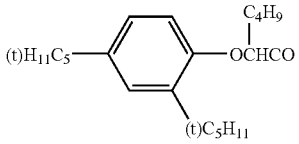 | H | Ag | Ag |
| I-135 | 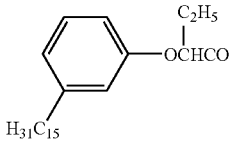 | H | Ag | Ag |

| Compound | m | n |
|---|---|---|
| $AgO_2C(CH_2)_mC{\equiv}C(CH_2)_nCO_2Ag$ | | |
| I-136 | 0 | 0 |
| I-137 | 0 | 5 |
| I-138 | 0 | 11 |
| I-139 | 0 | 17 |
| I-140 | 5 | 5 |
| I-141 | 5 | 9 |
| I-142 | 5 | 11 |
| I-143 | 5 | 17 |
| I-144 | 11 | 11 |
| I-145 | 11 | 17 |
| $AgO_2C(CH_2)_mCH{=}CH(CH_2)_nCO_2Ag$ | | |

-continued

| | | |
|---|---|---|
| I-146 | 0 | 0 |
| I-147 | 0 | 5 |
| I-148 | 0 | 11 |
| I-149 | 0 | 17 |
| I-150 | 5 | 5 |
| I-151 | 5 | 9 |
| I-152 | 5 | 11 |
| I-153 | 5 | 17 |
| I-154 | 11 | 11 |
| I-155 | 11 | 17 |

| Compound | n |
|---|---|
| $AgO_2C(CH_2)_nCO_2Ag$ | |
| I-156 | 4 |
| I-157 | 5 |
| I-158 | 6 |
| I-159 | 8 |
| I-160 | 10 |
| I-161 | 12 |
| I-162 | 14 |
| I-163 | 18 |
| I-164 | 20 |
| I-165 | 22 |

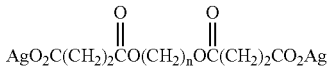

| Compound | n |
|---|---|
| I-166 | 4 |
| I-167 | 6 |
| I-168 | 8 |
| I-169 | 10 |
| I-170 | 12 |
| I-171 | 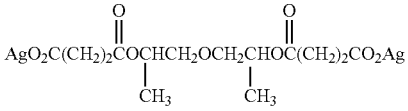 |
| I-172 | 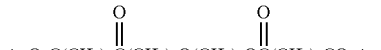 |
| I-173 | 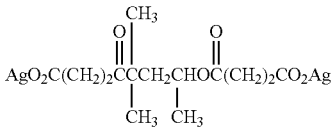 |

| Compound | L |
|---|---|
| | 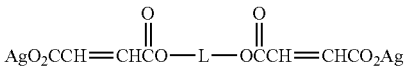 |
| I-174 | $—(CH_2)_4—$ |
| I-175 | $—(CH_2)_6—$ |
| I-176 | $—(CH_2)_8—$ |
| I-177 | $—(CH_2)_{10}—$ |
| I-178 | $—(CH_2)_{12}—$ |
| I-179 | $—(CH_2)_2O(CH_2)_2—$ |
| I-180 | $—CH(CH_3)CH_2OCH_2(CH_3)CH—$ |
| I-181 | $—C(CH_3)_2CH_2CH(CH_3)—$ |

-continued

| Compound | L |
|---|---|
| I-182 | 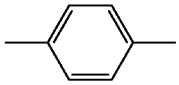 |
| I-183 | 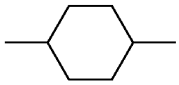 |

$AgO_2C(CH_2)_2\overset{O}{\overset{\|}{C}}NH—L—NH\overset{O}{\overset{\|}{C}}(CH_2)_2CO_2Ag$

| | |
|---|---|
| I-184 | $—(CH_2)_4—$ |
| I-185 | $—(CH_2)_6—$ |
| I-186 | $—(CH_2)_8—$ |
| I-187 | $—(CH_2)_{12}—$ |
| I-188 | $—(CH_2)_2O(CH_2)_2—$ |
| I-189 | $—CH(CH_3)CH_2OCH_2(CH_3)CH—$ |
| I-190 | $—C(CH_2)_2CH_2CH(CH_3)—$ |
| I-191 | $—(CH_2)_2O(CH_2)_2O(CH_2)_2—$ |
| I-192 | 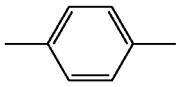 |

-continued

| Compound | L |
|---|---|
| I-193 | 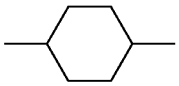 |

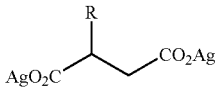

| Compound | R |
|---|---|
| I-194 | $CH_3(CH_2)_5CH═CH—$ |
| I-195 | $CH_3(CH_2)_7CH═CH—$ |
| I-196 | $CH_3(CH_2)_{13}CH═CH—$ |
| I-197 | $CH_3(CH_2)_{15}CH═CH—$ |
| I-198 | $CH_3(CH_2)_{19}CH═CH—$ |
| I-199 | $CH_3(CH_2)_{21}CH═CH—$ |
| I-200 | $CH_2═CH(CH_2)_{15}—$ |
| I-201 | $CH_2═CH(CH_2)_{19}—$ |
| I-202 | $CH_2═CH(CH_2)_{15}CH═CH—$ |
| I-203 | $CH_2═CH(CH_2)_{19}CH═CH—$ |
| I-204 | $CH_3(CH_2)_7C(CH_3)═CH—$ |

| Compound | $R^1$, $R^2$, $R^3$ |
|---|---|
| | 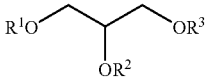 |
| I-205 | $—C\overset{O}{\overset{\|}{C}}(CH_2)_2\overset{O}{\overset{\|}{C}}OAg$ |
| I-206 | $—\overset{O}{\overset{\|}{C}}CH═CH\overset{O}{\overset{\|}{C}}OAg$ |
| I-207 | $—(CH_2)_7CO_2Ag$ |
| I-208 | $—(CH_2)_9CO_2Ag$ |
| I-209 | $—(CH_2)_{11}CO_2Ag$ |
| I-210 | $—(CH_2)_{15}CO_2Ag$ |
| I-211 | $—CH═CH(CH_2)_5CO_2Ag$ |
| I-212 | $—CH═CH(CH_2)_7CO_2Ag$ |
| I-213 | $—CH═CH(CH_2)_9CO_2Ag$ |
| I-214 | $—CH═CH(CH_2)_{13}CO_2Ag$ |

-continued
| Compound | $R^1$, $R^2$, $R^3$ |
|---|---|
| | 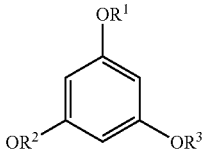 |
| I-215 | $(CH_2)_5CO_2Ag$ |
| I-216 | $(CH_2)_7CO_2Ag$ |
| I-217 | $(CH_2)_8CO_2Ag$ |
| I-218 | $(CH_2)_9CO_2Ag$ |
| I-219 | $(CH_2)_{11}CO_2Ag$ |
| I-220 | $(CH_2)_{13}CO_2Ag$ |
| I-221 | $(CH_2)_2O(CH_2)_2CO_2Ag$ |
| I-222 | $(CH_2)_2O(CH_2)_2O(CH_2)_2CO_2Ag$ |
| I-223 | $(CH_2)_{15}CO_2Ag$ |
| I-224 | $(CH_2)_{17}CO_2Ag$ |
| I-225 | $(CH_2)_{19}CO_2Ag$ |
| I-226 | $(CH_2)_{21}CO_2Ag$ |
| I-227 | 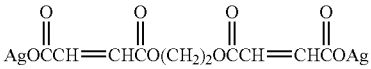 |
| I-228 | 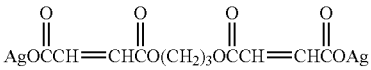 |
| I-229 | 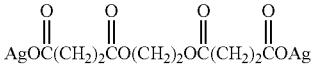 |
| I-230 | 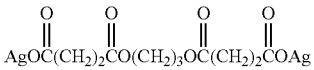 |
| I-231 | 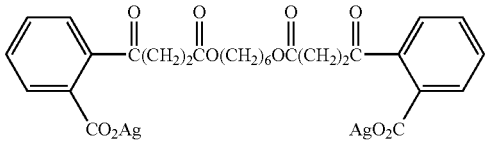 |
| I-232 | 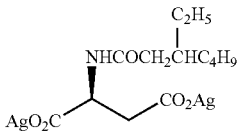 |
| I-233 | 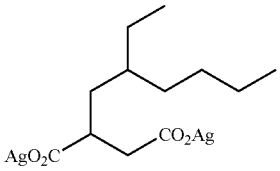 |
| I-234 | 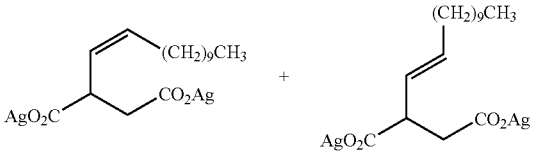 |
(mixture of 1:9)

-continued
| Compound | $R^1$, $R^2$, $R^3$ |
|---|---|
| I-235 | 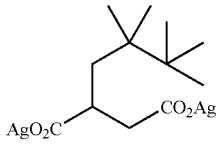 |
| I-236 | 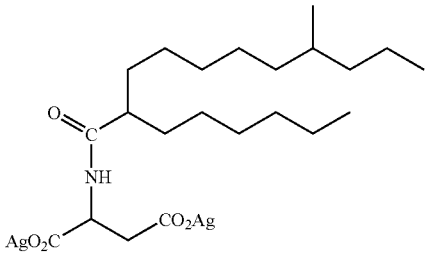 |
| I-237 | 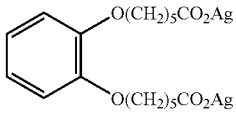 |
| I-238 | 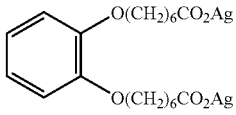 |
| I-239 | 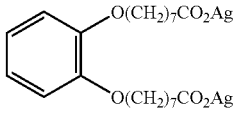 |
| I-240 | 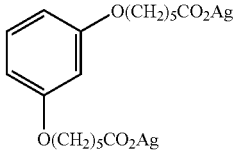 |
| I-241 | 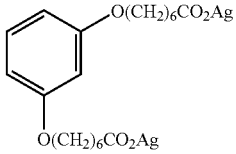 |
| I-242 | 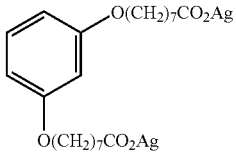 |
| I-243 | 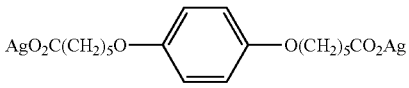 |
| I-244 | 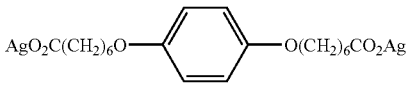 |

-continued
| Compound | $R^1$, $R^2$, $R^3$ |
|---|---|
| I-245 | 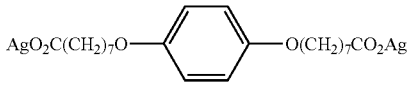 |
| I-246 | 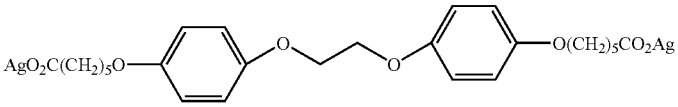 |
| I-247 | 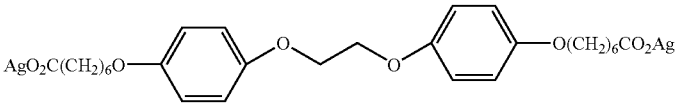 |
| I-248 | 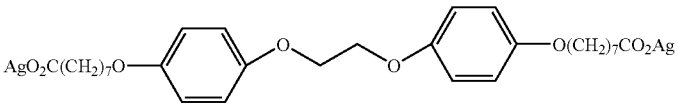 |
| I-250 | 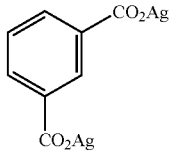 |
| I-251 | 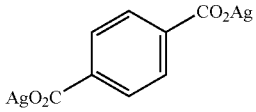 |
| I-252 | 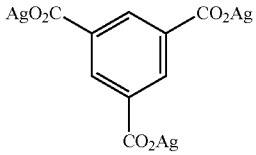 |
| I-253 | 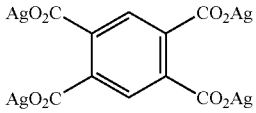 |
| I-254 | 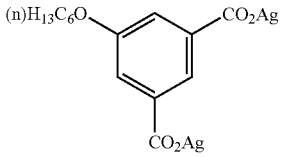 |
| I-255 | 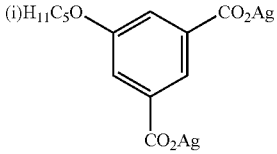 |
| I-256 | 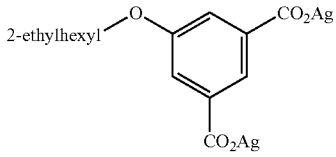 |

-continued
| Compound | $R^1$, $R^2$, $R^3$ |
|---|---|
| I-257 | 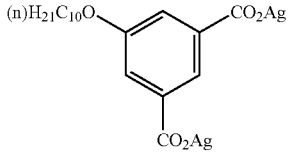 |
| I-258 | 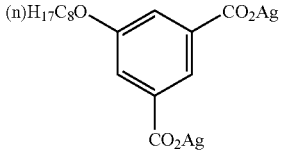 |
| I-259 | 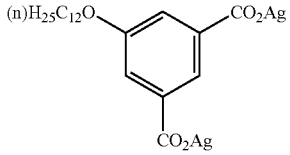 |
| I-260 | 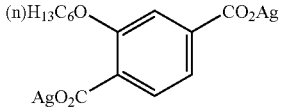 |
| I-261 | 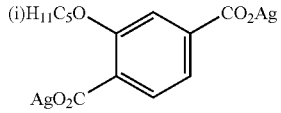 |
| I-262 | 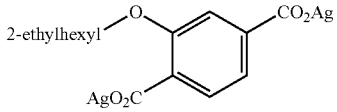 |
| I-263 | 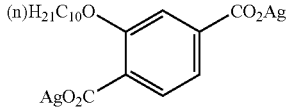 |
| I-264 | 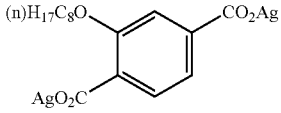 |
| I-265 | 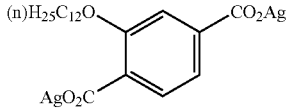 |
| I-266 | 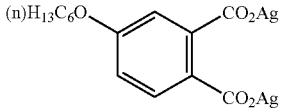 |
| I-267 | 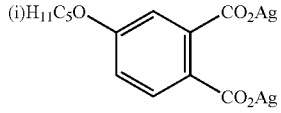 |

-continued
| Compound | $R^1$, $R^2$, $R^3$ |
|---|---|
| I-268 | 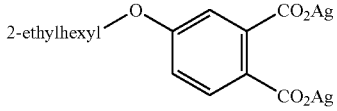 |
| I-269 | 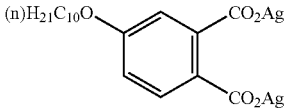 |
| I-270 | 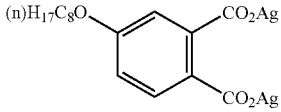 |
| I-271 | 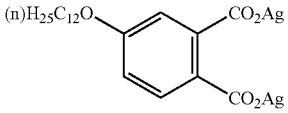 |
| I-272 | 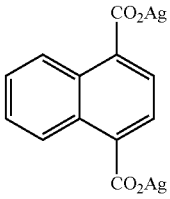 |
| I-273 | 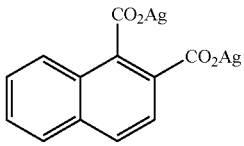 |
| I-274 | 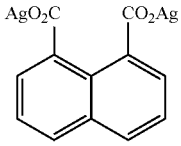 |
| I-275 | 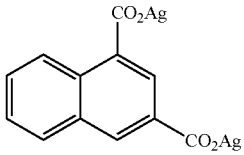 |
| I-276 | 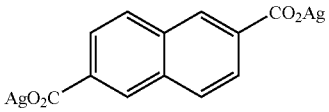 |
| I-277 | 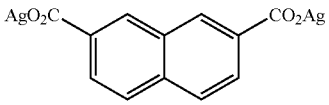 |

-continued

| Compound | $R^1$, $R^2$, $R^3$ |
|---|---|
| I-278 | 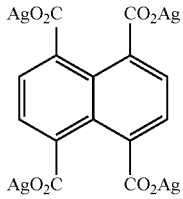 |
| I-279 | 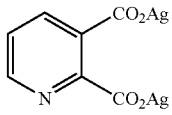 |
| I-280 | 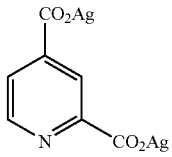 |
| I-281 | 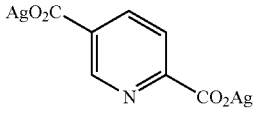 |
| I-282 | 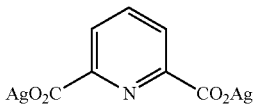 |
| I-283 | 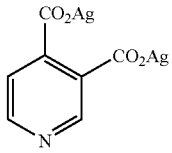 |
| I-284 | 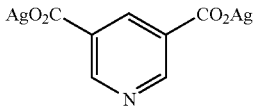 |
| I-285 | 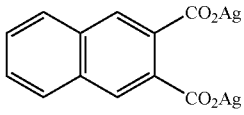 |
| I-286 | 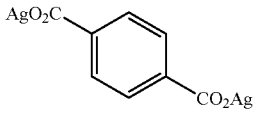 |

It is possible to produce and disperse the reducible silver salts represented by General Formula (I), employing any of the prior art methods. It is possible, for example, to refer to aforesaid JP-A No. 10-62899, European Patent Publication Open to Public Inspection Nos. 803763A1 and 962,812A1, JP-A Nos. 11-349591, 2000-7683, 2000-72711, 2-1-163889, 2001-163890, 2001-163827, 2001-188313, 2001-33907, 2001-83652, 2001-6442, and 2001-31870.

Incidentally, when light-sensitive silver salts are present during dispersion of the reducible silver salts represented by General Formula (I), fog increases and photographic speed markedly decreases. Therefore, it is more preferable that during dispersion, light-sensitive silver salts are not substantially incorporated. The amount of light-sensitive silver salts in a dispersion is commonly at most 0.1 mol percent with respect to mol of the reducible silver salts in the liquid composition, and light-sensitive silver salts are not positively added.

In the present invention, it is possible to produce light-sensitive materials by blending the dispersion of reducible silver salts represented by General Formula (I) and a light-sensitive silver salt dispersion. It is possible to select the mixing ratio (being a mol ratio) of the reducible silver salts to the light-sensitive silver salts based on the purposes. However, the ratio of the light-sensitive silver salts to the reducible silver salts is preferably in the range of 1-30 mol percent, is more preferably in the range of 3-20 mol percent, and is most preferably in the range of 5-15 mol percent. When blended, in order to control photographic characteristics, a method is preferably employed in which at least two types of reducible silver salt dispersions and at least two types of light-sensitive silver salt dispersions are blended.

It is possible to employ the reducible silver salts represented by General Formula (I) of the present invention in the desired amount. However, the amount is preferably 0.1-5 $g/m^2$ in terms of silver, and is more preferably 1-3 $g/m^2$.

In the present invention, of these aliphatic silver salts, it is preferable to use an aliphatic silver salt in which the content of silver behenate is preferably at least 50 mol percent, is more preferably 80-99.9 mol percent, and is still more preferably 90-99.9 mol percent. However, in the case of the use of above aliphatic carboxylic acid silver salts, problems have occurred in which they plasticize the resulting layer to produce a relatively weak layer and when the thickness of the image forming layer is decreased to enhance adaptability for quick processing, abrasion tends to occur, while during storage at relatively high temperatures, fog increases.

In order to overcome such drawbacks, it is possible to use the following silver salts. In the present invention, it is preferable to use polymer silver salts having repeated units derived from monomers having a cyclic structure selected from a cyclohexane ring, a benzene ring, or a naphthalene ring in the main chain. Preferred as polymers in the present invention are polyurethane resins. Further, the glass transition temperature (Tg) is preferably in the range of 100-200° C., and is more preferably in the range of 130-180° C. A Tg of less than 100° C. is disadvantageous because fog increases during storage at relatively high temperatures, and also it becomes difficult to achieve desired tracking properties due to a decrease in layer strength. On the other hand, when Tg exceeds 200° C., image density occasionally decreases due to degradation of dispersibility. The weight average molecular weight (Mw) of the polymers of the present invention, or preferably of polyurethane resins, is preferably in the range of 1,000-500,000, and is more preferably in the range of 5,000-200,000. When the above molecular weight exceeds 30,000, the resultant layer strength increases, while when it is at most 500,000, solvent solubility is enhanced to result in desired dispersibility.

The number of OH groups in polyurethane resins is preferably 2-20 per molecule, and is more preferably suitably 3-15. The presence of at least two OH groups per molecule allows desirable reaction react with isocyanate hardeners. As a result, the resultant layer strength increases, whereby it is possible to achieve desired tracking properties. On the other hand, the presence of at most 15 OH groups enhances solubility in solvents to result in desired dispersibility. Employed as compounds to provide the OH group may be compounds having at least three functional OH groups such as trimethylolpropane, trimellitic anhydride, glycerin, pentaerythritol, hexanetriol, branched polyester or polyether ester having at least three functional OH groups. Of these, are preferred those being three-functional. When being four-functional, the reaction rate with hardeners becomes excessively high, whereby the pot life is shortened.

Employed as polyol components of the polyurethane resins according to the present invention may be prior art polyols having cyclic structures such as polyester polyols, polyether polyols, polycarbonate polyols, polyether ester polyols, polyolefin polyols or dimer diols, and diol compounds having a long alkyl chain. The molecular weight of the above polyols is preferably about 500-about 2,000. When the molecular weight is in the above range, it is possible to substantially increase the weight ratio of isocyanates. Consequently, the resultant urethanes bond increases to enhance the mutual interaction between the molecules, and raises the glass transition temperature, whereby it is possible to obtain a coating of a higher mechanical strength.

The aforesaid diol components are preferably those having a cyclic structure and a long alkyl chain. As used herein, the long alkyl chain refers to an alkyl group having 2-18 carbon atoms. The presence of the cyclic structure and the long alkyl chain results in an indented structure, which enhances solubility in solvents. Due to that, since it is possible to enlarge the spread of the molecular chain in a liquid coating composition, dispersion stability is enhanced, whereby it is possible to obtain higher image density. Further, the presence of the cyclic structure makes it possible to obtain polyurethane of a higher glass transition temperature. The preferred structures as the above cyclic structure include a cyclohexane ring, a benzene ring, and a naphthalene ring. It is preferable that the cyclic structure is incorporated in polymer main chains. The use of polymer silver salts having such a structure makes it possible to minimize uneven density during thermal development, enhance tracking properties, and retard fog during storage at relatively high temperatures.

Further, for formation of polymer silver salts, it is preferable to use diol compounds having a carboxyl group. Listed as diol compounds having a carboxyl group are 2,2-bis(hydroxymethyl)propionic acid, 2,2-bis(hydroxymethyl)butanoic acid, 2,2-bis(hydroxyethyl)propionic acid, 2,2-bis(hydroxyethyl)butanoic acid, 2,2-bis(hydroxypropyl) propionic acid, and 3,5-bis(hydroxyethoxy)benzoic acid. The content of diol compounds having a carboxylic group is preferably 20-80 percent by weight with respect to the total diol compounds, and is more preferably 30-70 percent by weight.

The aforesaid diol components are incorporated in polyurethane resins preferably in an amount of 10-50 percent by weight and more preferably in an amount of 15-40 percent by weight. When the amount is at least 10 weight percent, solubility in solvents is enhanced to result in desired dispersibility, while when it is at most 50 percent by weight, it is possible to obtain a coating of a higher Tg, whereby a coating having desired tracking properties is obtained.

In the polyurethane resins employed in the present invention, diol components other than the above may be simultaneously used as a chain extending agent. The increase in the molecular weight of diol components inevitably decreases the content of isocyanate, resulting in a decrease in urethane bonds, whereby the resultant coating strength is degraded. Consequently, in order to achieve sufficient coating strength, simultaneously used chain extending agents are preferably low molecular weight diols of a molecular weight of leas than 500, and preferably at most 300. Specifically, it is possible to use aliphatic glycols such as ethylene glycol, 1,3-propanediol, propylene glycol, neopentyl glycol (NPG), 1,4-butanediol, 1,5-pentanediol, 1,6-hexaneresiol, 1,8-octanediol, 1,9-nonanediol, 2,2-dimethyl-1,3-propanediol, 2-ethyl-2-butyl-1,3-propnaediol, or 2,2-diethyl-1,3-propane diol; alicyclic glycols such as cyclohexanedimethanol (CHDM), cyclohexanediol (CHD), or hydrogenated bisphenol A (H-BPA) and ethylene oxide addition products or propylene oxide addition products thereof; aromatic glycols such as bisphenol A (BPA), bisphenol S, bisphenol P, or bisphenol F and ethylene oxide addition products and propylene oxide addition products thereof. Of these, particularly preferred is hydrogenated bisphenol A.

Employed as diisocyanates used in the polyurethane resins of the present invention may be those known in the art. Specific examples of preferred ones include TDI (trilene diisocyanate), MDI (diphenylmethane diisocyanate), p-phenylene diisocyanate, o-phenylene diisocyanate, m-phenylene diisocyanate, xylene diisocyanate, hydrogenated xylene diisocyanate, hexamethylene diisocyanate, and isophorone diisocyanate.

It is possible to easily synthesize polymers having a ring structure on the main chain, and polyurethane resins which are usable in the present invention, employing the methods known in the art (for example, described in JP-A Nos. 2000-292881, 2003-195445, and 2003-123224). It is preferable that the polymer silver salts of the present invention are employed together with aliphatic carboxylic acid silver salts. The weight ratio of aliphatic carboxylic acid silver salts to polymer silver salts is preferwbly 95:5-50:50, is more preferably 90:10-55:45, and is most preferably 85:15-60:40. By controlling the ratio in the above range, it is possible to enhance image density and minimize uneven density during thermal development.

In a silver salt photothermographic dry imaging material which incorporates a support having thereon light-insensitive aliphatic carboxylic acid silver and light-sensitive silver halide, the present invention provides a silver salt photothermographic dry imaging materials which are characterized in containing silver halide in which the surface photographic speed becomes lower than that prior to development by converting the aforesaid light-sensitive silver halide from a surface latent image type to an inner latent image type during the thermal development process, as well as at least any one of Types A-D below.

(Type A) A compound capable of releasing at least two electrons in such a manner that a one-electron oxidation product formed by one electron oxidation undergoes subsequent bond cleavage reaction.

(Type B) A compound capable of releasing another electron in such a manner that one-electron oxidation product formed by one electron oxidation undergoes a subsequent bond cleavage reaction, as well as having, in the same molecule, at least two adsorptive group to silver halide.

(Type C) A compound capable of releasing at least one electron after one-electron oxidation product formed by one electron oxidation is subjected to a bond forming process.

(Type D) A compound capable of releasing at least one electron after one-electron oxidation product formed by one electron oxidation undergoes a subsequent intermolecular ring cleavage reaction.

In the present invention, it is preferable that Types A-D compounds are those represented by aforesaid General Formulas (1-1)-(4-2).

It is preferable that the silver salt photothermographic dry imaging materials of the present invention contain contrast increasing agents.

The silver salt photothermographic dry imaging materials of the present invention will now be detailed below. The silver salt photothermographic dry imaging materials of the present invention incorporate a support having thereon light-insensitive aliphatic carboxylic acid silver, light-sensitive emulsions containing light-sensitive silver halide, silver ion reducing agents, and binders. The silver salt photothermographic dry imaging materials of the present invention are characterized in incorporating at least one compound selected from above Types A-D. Initially, Types A-D compounds will now be detailed.

Preferred compounds of above compounds Types A, C, and D are "compounds having, in the molecule" an adsorptive group to silver halide" or "compounds having, in the molecule, a partial structure of spectral sensitizing dyes" of which "compounds having, in the molecule" are more preferred.

Compounds Types A-D will now be detailed. "Bond cleavage reaction", as described in compound Type A, refers to cleavage of the bond between atoms such as carbon-carbon, carbon-silicon, carbon-boron, carbon-tin, or carbon-germanium, in which the cleavage of a carbon-hydrogen bond may be included. Compounds Type A are those capable of releasing at least two electrons (preferably at least three electrons) in such a manner that after a one-electron oxidation product is formed by one electron oxidation, the resultant oxidation product undergoes a subsequent bond cleavage reaction.

Of compounds Type A, preferred ones are represented by above General Formulas (1-1), (1-2), (1-3), (1-4), or (1-5).

In General Formula (1-1), $RED^{11}$ represents a reducing group which may undergoes one electron oxidation and $L^{11}$ represents a releasing group, $R^{112}$ represents a hydrogen atom or a substituent, and $R^{111}$ represents a group of non-metallic atoms capable of a specified 5- or 6-membered ring structure together with a carbon atom (C) and RED11. Specified 5- or 6-memberd ring structure, as described herein, refers to the ring structure corresponding to a tetrahydro body, a hexahydro body, or an octahydro body of a 5- or 6-membered aromatic ring (including aromatic heterocycles).

In General Formula (1-2), $RED^{12}$ represents a reducing group which may be subjected to one electron oxidation, $L^{12}$ represents a releasing group, $R^{121}$ and $R^{122}$ independently represent hydrogen atoms or substituents, and $ED^{12}$ represents an electron donating group. In General Formula (1-2), $R^{121}$ and $RED^{12}$, $R^{121}$ and $R^{122}$, or $ED^{12}$ and $RED^{12}$ may bond to each other to form a ring structure.

These compounds can further release at least two electrons, or preferably at least three electrons, in such a manner that after the reducing group represented by $RED^{11}$ or $RED^{12}$ of General Formula (1-1) or (1-2) undergoes one electron oxidation, $L^{11}$ or $L^{12}$ is spontaneously released via bond cleavage reaction, namely a C (carbon atom)-$L^{11}$ bond or a C (carbon atom)-$L^{12}$ bond is subjected to cleavage.

In General Formula (1-3), $Z^1$ represents a group of atoms capable of forming a 6-membered ring together with two carbon atoms of a benzene ring and a nitrogen atom, $R^1$, $R^2$, and $R^{N1}$ independently represent hydrogen atoms or substituents, $X^1$ represents a substitute capable of being substituted on a benzene ring, m1 represents an integer of 0-3, and $L^1$ represents a releasing group. In General Formula (1-4); $ED^{21}$ represents an electron donating group, $R^{11}$, $R^{12}$, $R^{N21}$, $R^{13}$, and $R^{14}$ independently represent hydrogen atoms or substituents, $X^{21}$ represents a substituent capable of being substituted on a benzene ring, m2 represents an integer of 0-3, and $L^{21}$ represents a releasing group. $R^{N21}$, $R^{13}$, $R^{14}$, $X^{21}$, and $ED^{21}$ may be combined with each other to form a ring structure. In General Formula (1-5), $R^{32}$, $R^{33}$, $R^{31}$, $R^{N31}$, $R^a$ and $R^b$ independently represents hydrogen atoms or substituents, and $L^{31}$ represents a releasing group, however, when $R^{N31}$ represents a group other than the aryl group, $R^a$ and $R^b$ combine with each other to form an aromatic ring.

These compounds can further release at least two electrons, or preferably at least three electrons, in such a manner that after undergoing one electron oxidation, $L^1$, $L^{21}$ or $L^{31}$ is spontaneously released via bond cleavage reaction, namely in which a C (carbon atom)-L1 bond, a C (carbon atom)-$L^{21}$ bond, or C (carbon atom)-L31 undergoes cleavage.

Initially, the compounds represented by General Formula (1-1) will now be detailed. In General Formula (1-1), the reducing group, represented by $RD^{11}$, capable of undergoing one electron oxidation is capable of bonding to $R^{111}$ described below to achieve a specified ring formation. Specific examples include divalent groups in which one hydrogen atom in a suitable position to form a ring from the univalent group is removed. Listed as examples are an alkylamino group, an arylamino group (an anilino group or a naphthylamino group), a heterocyclic amino group (a benzthizolylamino group or a pyrrolylamino group), an alkylthio group, an arylthio group (such as a phenylthio group), a heterocyclic thio group, an alkoxy group, an aryloxy group (a phenoxy group), a heterocyclic oxy group, an aryl group (a phenyl group, a naphthyl group, or an anthranyl group), an aromatic or non-aromatic heterocyclyl group (a 5- to 7-membered single heterocyclic ring or a condensed ring containing at least one of a nitrogen atom, a sulfur atom, an oxygen atom, or a selenium atom, and specific examples include a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring, and a methylenedioxyphenyl ring). Hereinafter, conveniently, $RED^{11}$ is described as a univalent group name.

Listed as substituents, for example, are a halogen atom, an alkyl group (including an aralkyl group, a cycloalkyl group, and an active methylene group), an alkenyl group, an alkynyl group, an aryl group, a heterocyclyl group (the substituted position is not limited), a heterocyclyl group containing a nitrogen atom which is in the quaternary form (e.g., a pyridinio group, an imidazolio group, a quinolinio group, and an isoquinolio group), an acyl group, an alkoxycarbonyl group, an aryloxycarbonyl group, a carbamoyl group, a carboxyl group or its salts, a sulfonylcarbamoyl group, an acyloxycarbamoyl group, a sulfamoylcarbamoyl group, a carbazoyl group, an oxaryl group, an oxamoyl group, a cyano group, a carbonimidoyl group, a thiocarbamoyl group, a hydroxyl group, an alkoxy group (including a group which contains the repeated units of an ethyleneoxy group or a propyleneoxy group), an aryloxy group, a heterocyclic oxy group, an acyloxy group (alkoxy or aryloxy), a carbonyloxy group, a carbamoyloxy group, a sulfonyloxy group, an amino group, an (alkyl, aryl, or heterocyclic) amino group, an acylamino group, a sulfonamido group, a ureido group, a thioureido group, an imido group, an (alkoxy or aryloxy) carbonylamino group, a sulfamoylamino group, a semicarbazide group, a hydrzino group, an ammonio group, an oxamoylamino group, an (alkyl or aryl) sulfonylureido group, an acylureido group, an acylsulfamoylamino group, a nitro group, a mercapto group, an (alkyl, aryl, or heterocyclic) thio group, an (alkyl or aryl) sulfonyl group, an (alkyl or aryl) sulfinyl group, a sulfo group or its salts, a sulfamoyl group, an acylsulfamoyl group, a sulfonylsulfamoyl group or its salts, a phosphoric acid amido group or a group containing a phosphoric acid ester structure. These substituents may further be substituted with another substituent.

In General Formula (1-1), $L^{11}$ represents a releasing group capable of being released only by bond cleavage after a reducing group represented by $RED^{11}$ undergoes one electron oxidation and specifically represents a carboxylic acid or its salts, a silyl group, a hydrogen atom, a triaryl boron anion, a trialkylstanyl group, a trialkylgermanyl group, or a —$CR^{C1}R^{C2}R^{C3}$ group.

When $L^{11}$ represents the salt of a carboxylic group, specific examples of counter ions which form the salt include an alkaline metal ion ($Li^+$, $Na^+$, $K^+$, and $Cs^+$), an alkaline earth metal ion ($Mg^{2+}$, $Ca^{2+}$, and $Ba^{2+}$), a heavy metal ion ($Ag^+$ and $Fe^{2+/3+}$), an ammonium ion, and a phosphonium ion. When $L^{11}$ represents a silyl group, specific silyl groups include a trialkylsilyl group, an aryldialkylsilyl group, and a triarylsilyl group. The alkyl group, as described herein, represents a methyl group, an ethyl group, a benzyl group, and a tert-butyl group, while the aryl group, as described herein, includes a phenyl group.

When $L^{11}$ represents an arylboron anion, the aryl group is preferably a substituted or unsubstituted phenyl group. Listed as substituents are the same as those which $RED^{11}$ may have a substituent. When $L^{11}$ represents a trialkylstanyl group or a trialkylgermanyl group, the alkyl group, as described herein, is a straight or branched chain, or cyclic alkyl group, which may have a substituent. Listed as these substituents are the same as those which $RED^{11}$ may have.

When $L^{11}$ represents a —$CR^{C1}R^{C2}R^{C3}$ group, $R^{C1}$, $R^{C2}$, and $R^{C3}$ independently represent hydrogen atoms, alkyl groups, aryl groups, heterocyclyl groups, alkylthio groups, arylthio groups, alkylamino groups, arylamino groups, heterocyclic amino groups, alkoxy groups, aryloxy groups, and hydroxyl groups. These may be combined with each other to form a ring structure and may further have a substituent. Listed as these substituents are the same as those which $RED^{11}$ may have. However, when any one of $R^{C1}$, $R^{C2}$, and $R^{C3}$ represents either a hydrogen atom or an alkyl group, the others represent neither hydrogen atoms nor an alkyl groups. Listed as preferred $R^{C1}$, $R^{C2}$, and $R^{C3}$ are independently alkyl groups, aryl groups (particularly phenyl groups), alkylthio groups, arylthio groups, alkylamino groups, arylamino groups, heterocyclyl groups, alkoxy groups, and hydroxyl groups. Specific examples include a phenyl group, a p-dimethylaminophenyl group, a p-methoxyphenyl group, a 2,4-dimethoxyphenyl group, a p-hydroxyohenyl group, a methylthio group, a phenylthio group, a phenoxy group, a methoxy group, an ethoxy group, a dimethylamino group, an N-methylanilino group, a dipenylamino group, a morpholino group, a thiomorpholino group, and a hydroxyl group. Further, when these are combined with each other to form a ring structure, examples of the resultant compounds include a 1,3-dithian-2-yl group, an N-methyl-1,3-thiazolidine-2-yl group, and an N-benzyl-benzthiazolidine-yl group.

Preferably listed as —$CR^{C1}R^{C2}R^{C3}$ groups are a trityl group, a tri(p-hydroxyphenyl)methyl group, a 1,1-diphenyl-1-(p-dimethylaminophenyl)methyl group, a 1,1-diphenyl-1-(methylthio)methyl group, a 1-phenyl-1,1-(dimethylthio) methyl group, a 1,3-dithiolane-2-yl group, a 2-phenyl-1,3-dithiolane-2-yl group, a 1,3-dithiane-2-yl group, a 2-phenyl-1,3-dithiane-2-yl group, a 2-methyl-1,3-dithiane-2-yl group, an N-methyl-1,3-thiazolidine-2-yl group, a 3-methyl-3-methyl-1,3-thiazolidine-2-yl group, an N-benzyl-benzthiazolidine-2-yl group, a 1,1-diphenyl-1-dimethylaminomethyl group, and a 1,1-diphenyl-1-morpholinomethyl group. Further, cases are also preferred in which in the —$CR^{C1}R^{C2}R^{C3}$ group, groups within the above range are selected for each of $R^{C1}$, $R^{C2}$, and $R^{C3}$, and the resultant group represents the same group as the residual group which is formed by removing $L^{11}$ from the compound represented by General Formula (1-1).

In General Formula (1-1), $R^{112}$ represents a hydrogen atom or a substituent capable of being substituted on a carbon atom. When $R^{112}$ represents a substituent capable of being substituted on a carbon atom, listed as the substituents, as described herein, are the same as the examples of substituents when $RED^{11}$ has a substituent. However, neither $R^{112}$ nor $L^{11}$ may represent the same substituent at the same time.

In General Formula (1-1), $R^{111}$ represents a group of non-metallic atoms capable of forming a specified 5- or 6-membered ring structure. Specified ring structures formed by $R^{111}$, as described herein, refer to ring structures corresponding to a tetrahydro body, a hexahydro body, or an octahydro body of 5- or 6-membered aromatic rings (including aromatic heterocyclic rings). The hydro body, as described herein, refers to a ring structure in which a carbon-carbon double bond (or a carbon-nitrogen double bond) in an aromatic ring (including an aromatic heterocyclic ring) is partially hydrogenated. The tetrahydro body, as described herein, refers to a structure in which two carbon-carbon double bonds (or carbon-nitrogen double bond) in an aromatic ring (including an aromatic heterocyclic ring) are hydrogenated, while the octahydro body, as described herein, refers to a structure in which four carbon-carbon double bonds (or carbon-nitrogen double bond) in an aromatic ring (including an aromatic heterocyclic ring) are hydrogenated. An aromatic ring, when hydrogenated, exhibits a partially hydrogenated non-aromatic ring structure.

Listed as specific examples of 5-membered single rings are a pyrrolidine ring, an imidazoline ring, a thiazoline ring, a pyrazolone ring, and an oxazoline ring which correspond to the tetrahydro body of a pyrrole ring, an imidazole ring, a thiazole ring, a pyrazole ring, and an oxazole ring. Listed as specific examples of 6-membered single rings are a piperidine ring, a tetrahydropyridine ring, a tetrahydropyrimidine ring, and a piperazine ring all of which correspond to the tetrahydro body or hexahydro body of aromatic rings such as a pyridine ring, a pyridazine ring, a pyrimidine ring, or a pyrazine ring. Listed as examples of 6-membered condensed rings are a tetraquinoline ring, a tetrahydroquinoline ring, a tertahydroisoquinoline ring, a tetrahydroquinazoline ring, and a tetrahydroquinoxaline ring all of which correspond to the tetrahydro body of a naphthalene ring, a quinoline ring, an isoquinoline ring, a quinazoline ring, or a quinoxaline. Listed as examples of 3-membered ring compounds are a tetrahydrocarbazole ring as the tetrahydro body of a carbazole ring and an octahydrophenantridine ring as the octahydro body of a phenanatrizine ring.

Compounds having such structures may further be substituted. Listed as examples of such substituents are those which are described as substituents which $RED^{111}$ may have. Substituents having such ring structures may be combined to each other to form a ring which is either a non-aromatic carbon ring or a heterocyclic ring.

The preferred range of the compounds represented by General Formula (1-1) of the present invention will now be described. In General Formula (1-1), $L^{11}$ is preferably a carboxyl group or its salts and a hydrogen atom, and is more preferably a carboxyl group or its salts. The counter ion of the salt is preferably an alkaline metal ion or an ammonium ion, and is more preferably an alkaline metal ion (particularly, $Li^+$, $Na^+$, or $K^+$).

When $L^{11}$ represents a hydrogen atom, it is preferable that the compounds represented by General Formula (1-1) have a base portion in the molecule. Due to the action of this base portion, after the compound represented by General Formula (1-1) is oxidized, the hydrogen atom represented by $l^{11}$ undergoes deprotonation, whereby electrons are further released.

The base, as described herein, is a conjugated base of acid at a pKa of practically about 1-about 10. For example, listed are nitrogen-containing heterocycles (pyridines, imidazoles, benzimidazoles, and thiazoles), anilines, trialkylamines, an amino group, carbon acids (an active methylene anion), a thioacetic acid anion, carboxylate (—$COO^-$), sulfate (—$SO_3^-$), or amineoxide (>$N^+(O^-)$—). Conjugated bases of acid at a pKa of about 1-about 8 are preferred and carboxylate, sulfate, or amine oxide is more preferred, in which carboxylate is particularly preferred. When these bases have an anion, they may also have a counter cation. Listed as examples of the counter cations are an alkaline metal ion, an alkaline earth metal ion, a heavy metal ion, an ammonium ion, and a phosphonium ion. These bases may link to the compounds represented by General Formula (1-1) at any position. The position linking these base portions may be any of $RED^{11}$, $R^{111}$, and $R^{112}$ represented by General Formula (1-1).

When $L^{11}$ represents a hydrogen atom, the above hydrogen atom is linked with the base portion via preferably at most 8 groups of atoms, and more preferably 5-8 groups of atoms. Herein, those which are counted as a linking group of atoms are groups of atoms in which the center atom (i.e., the atom having an anion or a lone pair election) and the aforesaid hydrogen atom are linked via a covalent bond. For example, in the case of carboxylate, two atoms of —C—O— are counted, while in the case of sulfate, two atoms of S—O— are counted. The carbon atom represented by C in General Formula (1-1) is also counted.

In General Formula (1-1), when $L^{11}$ represents a hydrogen atom, $ERD^{11}$ represents anilines, and when the nitrogen atom forms, with $R^{111}$, a 6-membered single ring saturated ring structure (a piperidine ring, a piperazine ring, a morpholine ring, a thiomorpholine ring, or a selenomorpholine ring), it is preferable the aforesaid compound has, in the molecule, an adsorptive group to silver halide, and at the same time, the aforesaid compound has a base portion in the molecule so that the aforesaid base portion and the aforesaid hydrogen atom are linked via at most 8 groups of atoms.

In General Formula (1-1), $RED^{111}$ is preferably an alkylamino group, an arylamino group, a heterocyclic amino group, an aryl group, an aromatic or a non-aromatic heterocyclyl group. Of these, the heterocyclyl group is preferably a tetrahydroquinolinyl group, a tetrahydroquinoxalinyl group, a tetrahydroquinazolinyl group, an indolyl group, an indolenyl group, a carbazolyl group, a phenoxadinyl group, a phenothiazinyl group, a benzothiazolinyl group, a pyrrolyl group, an imidazolyl group, a thiazolidinyl group, a benzimidazolyl group, a benzimidazolinyl group, a 3,4-methylenedioxyphenyl-1-yl group. More preferred are an arylamino group (particularly, an anilino group) and an aryl group (particularly, a phenyl group). When $RED^{111}$ represents an aryl group, it is preferable that the above aryl group has at least one electron donating group (the number of electron donating groups is preferably at most 4, and is more preferably 1-3). The electron donating group, as described herein, refers to a hydroxyl group, an alkoxy group, a mercapto group, a sulfonamido group, an acylamino group, an alkylamino group, an arylamino group, a heterocyclic amino group, or an active methine group, an electron excessive aromatic heterocyclyl group (e.g., an indolyl group, a pyrrolyl group, an imidazolyl group, a benzimidazolyl group, a thiazolyl group, a benzothiazolyl group, or an indazolyl group), or a nitrogen atom substituting no-aromatic nitrogen-containing heterocyclyl group (a pyrrolydinyl group, an indolinyl group, a piperidinyl group, a piperazinyl group, or a morpholino group). The active methine group, as described herein, refers to a methine group substituted with two-electron attractive groups, while the electron attractive group, as descried herein, refers to an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, or a carbonimidoyl group. Herein, two electron attractive groups may be combined with each other to result in a ring structure. When $RED^{11}$ represents an aryl group, substituents for the aryl group are preferably an alkylamino group, a hydroxyl group, an alkoxy group, a mercapto group, a sulfonamido group, an active methine group, a nitrogen atom substituting non-aromatic nitrogen-containing heterocyclyl group, and are more preferably an alkylamino group, a hydroxyl group, an active methine group, and a nitrogen atom substituting non-aromatic nitrogen-containing heterocyclyl group, and are most preferably an alkylamino group and a nitrogen atom substituting non-aromatic nitrogen-containing heterocyclyl group.

In General Formula (1-1), $R^{112}$ is preferably a hydrogen atom, an alkyl group, an aryl group (such as a phenyl group), an alkoxy group (a methoxy group, an ethoxy group, or a benzoyloxy group), a hydroxyl group, an alkylthio group (a methylthio group or a butylthio group), an amino group, an alkylamino group, an arylamino group, or a heterocyclic amino group, and is more preferably a hydrogen atom, an alkyl group, an alkoxy group, a hydroxyl group, a phenyl group, or an alkylamino group.

In General Formula (1-1), $R^{111}$ is preferably a group of non-metallic atoms capable of forming the following specified 5- or 6-membered ring structure together with carbon atom (C) and $RD^{11}$. Namely listed are a pyrrolidine ring or an imidazolidine ring which corresponds to a tetrahydro body of a pyrrole ring or an imidazole ring, which is a single ring 5-membered aromatic ring; a tetrahydro body or a hexahydro body of a pyridine ring, a pyridazine ring, a pyrimidine ring, or a pyrazine ring such as a piperidine ring, a tetrahydropyridine ring, a tetrahydropyrimidine ring, or a piperazine ring; a tetralin-ring, a tetrahydroquinoline ring, a tetrahydroisoquinoline ring, a tetrahydroquinazoline ring, and a tetrahydroquinoxaline ring which correspond to the tetrahydro body of a naphthalene ring, a quinoline ring, an isoquinoline ring, a quinazoline ring, and a quinoxaline ring which are condensed ring 6-membered ring aromatic rings; and a tetrahydrocarbazole ring which is a tetrahydro body of a carbazole ring which is a 3-membered aromatic ring, and an octahydrophenanthridine ring which is an octahydro body of a phenanthridine ring. More preferred ring structures which $R^{111}$ forms include a pyrrolidine ring, an imidazolidine ring, a piperazine ring, a tetrahydropyridine ring, a tetrahydropyrimidine ring, a piperazine ring, a tetrahydroquinoline ring, a tetrahydroquinazoline ring, a tetrahydroquinoxaline ring, and a tetrahydrocarbazole ring, and the more preferred include a pyrrolidine ring, a piperidine ring, a piperazine ring, a tetrahydroquinoline ring, a tetrahydroquinazoline ring, a tetrahydroquinoxaline ring, and a tetrahydrocarbazole ring, and the most preferred are a pyrrolidine ring, a piperidine ring, and a tetrahydroquinoline ring.

General Formula (1-2) will now be detailed. In General Formula (1-2), $RED^{12}$ and $L^{12}$ are each as defined for $RED^{11}$ and $L^{11}$ in General Formula (1-1) and the preferred range is also the same. However, $RED^{12}$ is a univalent group except in the case in which the following ring structures are formed. Listed as specific examples are those of the univalent groups described in $RED^{11}$. $R^{121}$ and $R^{122}$ are also as defined for $R^{112}$ of General Formula (1-1), and the preferred range is also the same. $ED^{12}$ represents an electron donating group. $R^{121}$ and $RED^{12}$, $R^{121}$ and $R^{122}$, or $ED^{12}$ and $RED^{12}$ may be combined with each other to form a ring structure.

In General Formula (1-2), the electron donating group represented by $ED^{12}$, as described herein, refers to a hydroxyl group, an alkoxy group, an mercapto group, an alkylthio group, an arylthio group, a heterocyclic thio group, a sulfonamido group, an acylamino group, an alkylamino group, an arylamino group, a heterocyclic amino group, an active methine group, an excessive electron aromatic heterocyclyl group (for example, an indolyl group, a pyrrolyl group, and an indazolyl group), a nitrogen atom substituting non-aromatic nitrogen containing heterocyclyl group (a pyrrolidinyl group, a piperidinyl group, an indilinyl group, a piperazinyl group, and a morpholino group), and an aryl group substituted with any of these electron donating group (for example, a p-hydroxyphenyl group, a p-dialkylaminophenyl group, an o,p-dialkoxyphenyl group, and a 4-hydroxynaphthyl group). The active methine group, as described herein, is as defined for the substituent when $RED^{11}$ represents an aryl group. $ED^{12}$ is preferably a hydroxyl group, an alkoxy group, a mercapto group, a sulfonamido group, an alkylamino group, an arylamino group, an active methine group, an excessive electron aromatic heterocyclyl group, a nitrogen atom substituting non-aromatic nitrogen-containing heterocyclyl group, and a phenyl group substituted with any of these electron donating groups, in addition, a non-aromatic nitrogen-containing heterocyclyl group substituted with a hydroxyl group, a mercapto group, a sulfonamido group, an alkylamino group, an arylamino group, an active methine group, a nitrogen atom substituting non-aromatic nitrogen-containing heterocyclyl group, or a phenyl group substituted with any of these electron donating group (for example, a p-hydroxyphenyl group, a p-dialkylaminophenyl group, and an o,p-dialkoxyphenyl group).

In General Formula (1-2), $R^{121}$ and $RED^{12}$, $R^{122}$ and $R^{121}$, or $ED^{12}$ and $RED^{12}$ may be combined with each other to form a ring structure. The ring structure formed herein refers to a non-aromatic carbon ring or a heterocyclic ring, a 5- to 7-memberted single ring or condensed ring, and a substituted or unsubstituted ring structure. When $R^{121}$ and $RED^{12}$ form a ring structure, the resultant specific structures include a pyrrolidine ring, a pyrroline ring, an imidazolidine ring, an imidazoline ring, a thiazolidine ring, a thiazoline ring, a pyrazolidine ring, a pyrazoline ring, an oxazolidine ring, an oxazoline ring, an indane ring, a piperidine ring, a piperazine ring, a morpholine ring, a tetrahydropyridine ring, a tetrahydropyrimidine ring, an indoline ring, a tetralin ring, a tetrahydroquinoline ring, a tetrahydroisoquinoline ring, a tetrahydroquinoxaline ring, a tetrahydro-1,4-oxazine ring, a 2,3-dihyrdobenzo-1,4-oxazine ring, a tetrahydro-1,4-thiazine ring, a 2,3-dihydrobenzo-1,4-thiazine ring, a 2,3-dihydrobenzofuran ring, and a 2,3-dihydrobenzothiophene ring. When $ED^{12}$ and $RED^{12}$ form a ring structure, $ED^{12}$ preferably represents an amino group, an alkylamino group, or an arylamino group. Listed as specific examples of formed structures are a tetrahydropyrazine ring, a piperazine ring, a tetrahydroquinoxaline ring, and a tetrahydroisoquinoline ring. When $R^{122}$ and $R^{121}$ form a ring structure, listed as specific examples are a cyclohexane ring and a cyclopentane ring.

Of the compounds represented by General Formula (1-1), the preferred compounds are represented by General Formulas (1-1-1)-(1-1-3), while of the compounds represented by General Formula (1-2), the preferred compounds are represented by General Formulas (1-2-1) and (1-2-2).

General Formula (1-1-1)

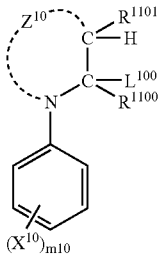

General Formula (1-1-2)

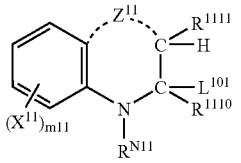

General Formula (1-1-3)

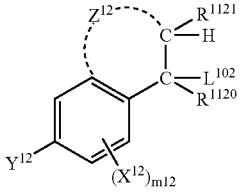

General Formula (1-2-1)

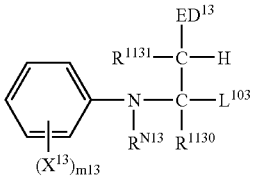

General Formula (1-2-2)

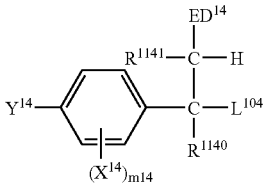

In General Formulas (1-1-1)-(1-2-2), $L^{100}$, $L^{101}$, $L^{102}$, $L^{103}$, and $L^{104}$ are each as defined for $L^{11}$, and the preferred range is also the same. $R^{1100}$ and $R^{1101}$, $R^{1110}$ and $R^{1111}$, $R^{1120}$ and $R^{1121}$, $R^{1130}$ and $R^{1131}$ and $R^{1140}$ and $R^{1141}$ are each as defined for $R^{122}$ and $R^{121}$ of General Formula (1-2), and the preferred range is also the same. $ED^{13}$ and $ED^{14}$ are each as defined for $ED^{12}$ of General Formula (1-2), and the preferred range also remains. $X^{10}$, $X^{11}$, $X^{12}$, $X^{13}$, and $X^{14}$ each represents a substituent-capable of being substituted on a benzene ring, while m10, m11, m12, m13, and m14 each represent an integer of 0-3, and when these are plural, a plurality of $X^{10}$, $X^{11}$, $X^{12}$, $X^{13}$, and $X^{14}$ are the same or different. $Y^{12}$ and $Y^{14}$ each represent an amino group, an alkylamino group, an arylamino group, a nitrogen atom substituting non-aromatic nitrogen-containing heterocyclyl group (a pyrrolyl group, a piperidinyl group, an indolinyl group, a piperazino group, and a morpholino group), a hydroxyl group, and an alkoxy group.

$Z^{10}$, $Z^{11}$, and $Z^{12}$ each represent a group of non-metallic atoms capable of forming a specified ring structure. The specified structure which $Z^{10}$ forms is a ring structure corresponding to the tetrahydro or hexahydro body of a single ring or a condensed ring nitrogen-containing aromatic heterocyclic ring. Listed as specific examples are a pyrrolidine ring, an imidazolidine ring, a thiazolidine ring, a thiazoline ring, a piperazine ring, a tetrahydropyridine ring, a tetrahydropyrimidine ring, a piperazine ring, a tetrahydroquinoline ring, a tetrahydroisoquinoline ring, a tetrahydroquinazoline ring, and a tetrahydroquinoxaline ring. The specified structure which $Z^{11}$ forms includes a tetrahydroquinoline ring and a tetrahydroquinoxaline ring. The specified structure which $Z^{12}$ forms includes a tetralin group, a tetrahydroquinoline ring and a tetrahydroisoquinoline ring.

$R^{N11}$ and $R^{N13}$ each represent a hydrogen atom or a substituent capable of being substituted on a nitrogen atom. Specific examples of the substituents include an alkyl group, an alkenyl group, an alkynyl group, an aryl group, a heterocyclyl group, and an acyl group, of which an alkyl group or an aryl group is preferred.

Listed as specific examples of substituents represented by $X^{10}$, $X^{11}$, $X^{12}$, $X^{13}$, and $X^{14}$, capable of being substituted on a benzene ring are those which are shown as the examples which $RED^{11}$ of General Formula (1-1) may have. The preferred examples include a halogen atom, an alkyl group, an aryl group, a heterocyclyl group, an acyl group, an alkoxycarbonyl group, an aryloxycarbonyl group, a carbamoyl group, a cyano group, an alkoxy group (including an ethyleneoxy group and a group having repeated propyleneoxy group units), an (alkyl aryl, or heterocyclic ring) amino group, an acylamino group, a sulfonamido group, a ureido group, a thioureido group, an imido group, an (alkoxy or aryloxy) carbonylamino group, a nitro group, an (alkyl, aryl, or heterocyclic) thio group, an (alkyl or aryl) sulfonyl group, and a sulfamoyl group. m10, m11, m12, m13, and m14 are each preferably 0-2, but are each more preferably 0 or 1.

$Y^{12}$ and $Y^{14}$ are each preferably an alkylamino group, an arylamino group, a nitrogen atom substituting non-aromatic nitrogen-containing heterocyclic ring, a hydroxyl group, and an alkoxy group, and each are more preferably an alkylamino group, a nitrogen atom substituting 5- or 6-membered non-aromatic nitrogen-containing heterocyclyl group, and a hydroxyl group, and each are most preferably an alkylamino group (particularly a dialkylamino group) or a nitrogen atom substituting 5- or 6-membered non-aromatic nitrogen-containing heterocyclyl group.

In General Formula (1-2-1), $R^{1131}$ and $X^{13}$, $R^{1131}$ and $R^{N13}$, $R^{1130}$ and $X^{13}$, or $R^{1130}$ and $R^{N13}$ are combined with each other to form a ring structure. Further, in General Formula (1-2-2), $R^{1141}$ and $X^{14}$, $R^{1141}$ and $R^{1140}$, $ED^{14}$ and $X^{14}$, or $R^{1140}$ and $X^{14}$ are combined with each other to form a ring structure. The formed ring structure, as described herein, is a non-aromatic carbon ring or a heterocyclic ring, and 5- to 7-membered single ring or a condensed ring which may be substituted or unsubstituted. In General Formula (1-2-2), the case in which $R^{1131}$ and $X^{13}$ are combined with each other to form a ring structure, and $R^{1131}$ and $R^{N13}$ are also combined with each other to form a ring structure, are preferred examples of compounds represented by General Formula (1-2-2) in the same manner as the case in which a ring structure is not formed.

In General Formula (1-2-1), specific examples of the ring structure formed by $R^{1131}$ and $X^{13}$ include an indoline ring (in this case, $R^{1131}$ represents a single bond), a tetrahydroquinoline ring, a tetrahydroquinoxaline ring, a 2,3-dihydrobenzo-1,4-oxazine ring, and a 2,3-dihydrobenzo-1,4-thiazine ring. Of these, an indoline ring, a tetrahydroquinoline ring, and a tetrahydroquinoxaline ring are particularly preferred. In General Formula (1-2-1), specific examples of the ring structure formed by $R^{1131}$ and $R^{N13}$ include a pyrrolidine ring, a pyrroline ring, an imidazolidine ring, an imidazoline ring, a thiazolidine ring, a thiazoline ring, a pyrazolidine ring, a pyrazoline ring, an oxazolidine ring, an oxazoline ring, a piperazine ring, a piperazine ring, a morpholine ring, a tetrahydropyridine ring, a tetrahydropyrimidine ring, an indoline ring, a tetrahydroquinoline ring, a tetrahydroisoquinoline ring, a tetrahydroquinoxaline ring, a tetrahydro-1,4-oxazine ring, a 2,3-dihyrobenzo-1,4-oxazine ring, a tetrahydro-1,4-thiazine ring, a 2,3-dihydrobenzo-1,4-thiazine ring, a 2,3-dihydrobenzofuran ring, and a 2,3-dihydrobenzothiphephene ring. Of these, a pyrrolidine ring, a piperazine ring, a tetrahydroquinoline ring, and a tetrahydroquinoxaline ring are particularly preferred.

In General Formula (1-2-2), the case in which $R^{1141}$ and $X^{14}$ are combined with each other to form a ring structure, and $ED^{14}$ and $X^{14}$ are also combined with each other to form a ring structure, are preferred examples of compounds represented by General Formula (1-2-2) in the same manner as the case in which a ring structure is not formed. Listed as ring structures formed by combining $R^{1141}$ with $X^{14}$ in General Formula (1-2-2) are an indane ring, a tetralin ring, a tetrahydroquinoline ring, a tetrahydroisoquinoline ring, and an indoline ring. Listed as structures formed by combining $ED^{14}$ with $X^{14}$ are a tetrahydroisoquinoline ring and a tetrahydrocinnoline ring.

General Formulas (1-3)-(1-5) will now be described. In General Formulas (1-3)-(1-5), $R^1$, $R^2$, $R^{11}$, $R^{12}$, and $R^{31}$ each independently represent a hydrogen atom or a substituent, and these are as defined for $R^{112}$ of General Formula (1-1). Further, the preferred range also remains. $L^1$, $L^{21}$, and $L^{31}$ each independently represent a releasing group which are the same as those listed as the specific examples when $L^{11}$ of General Formula (1-1) was described, and the preferred range is also the same. $X^1$ and $X^{21}$ each represent a substituent capable of being substituted on a benzene ring. Listed as examples of each of $X^1$ and $X^{31}$ are those which are the same as examples of substituents when $RED^{11}$ of General Formula (1-1) has a substituent. m1 and m21 each represent an integer of 0-3, are each preferably 0-2, and are more preferably 0 or 1.

$R^{N1}$, $R^{N2}$, and $R^{N31}$ each represent a hydrogen atom or a substituent capable of being substituted on a nitrogen atom. Examples of preferred substituents include an alkyl group, an aryl group, and a heterocyclyl group, which may further have a substituent. Listed as such substituents are those which are the same as substituents which $RED^{11}$ of General Formula (1-1) may have. $R^{N1}$, $R^{N2}$, and $R^{N31}$ are each preferably a hydrogen atom, an alkyl group, or an aryl group, and are each more preferably a hydrogen atom or a an alkyl group.

$R^{13}$, $R^{14}$, $R^{32}$, $R^{33}$, $R^a$, and $R^b$ each independently represent a hydrogen atom or a substituent capable of being substituted on a carbon atom. Listed as such substituents are those which are the same as substituents which $RED^{11}$ may have in General Formula (1-1). Preferred examples include an alkyl group, an aryl group, an acyl group, an alkoxycarbonyl group, a carbamoyl group, a cyano group, an alkoxy group, an acylamino group, a sulfonamido group, a ureido group, a thioureido group, an alkylthio group, an arylthio group, an alkylsulfonyl group, an arylsulfonyl group, and a sulfamoyl group.

In General Formula (1-3), $Z^1$ represents a group of atoms capable of forming a 6-membered ring on a nitrogen atom and two carbon atoms on the benzene ring. The 6-membered ring which $Z^1$ forms is a non-aromatic heterocyclic ring formed through condensation with the benzene ring of General Formula (1-3). Specific examples of structures including the condensed benzene ring include a tetrahydroquinoline ring, a tetrahydroquinoxaline ring, and a tetrahydroquinazoline ring which may have a substituent. Listed as such substituents are those which are the same as examples when $R^{112}$ of General Formula (1-1) represents a substituent. The preferred range is also the same.

In General Formula (1-3), $Z^1$ is preferably a group of atoms which forms a tetrahydroquinoline ring or a tetrahydroquinoxaline ring with a nitrogen atom and two carbon atoms of the benzene ring.

In General Formula (1-4), $ED^{21}$ represents an electron donating group and is as defined for $ED^{12}$ of General Formula (1-2), and the preferred range is also the same. In General Formula (1-4), any two of $R^{N21}$, $R^{13}$, $R^{14}$, and $X^{21}$ may be combined with each other to form a ring structure. The ring structure which is formed by combining $R^{N21}$ and $X^{21}$ is preferably a 5- to 7-membered non-aromatic carbon ring or a heterocyclic ring through condensation with the benzene ring. Specific examples include a tetrahydroquinoline ring, a tetrahydroquinoxaline ring, an indoline ring, a 2,3-dihydro-5,6-benzo-1,4-thiazine ring. Of these, preferred are a tetrahydroquinoline ring, a tetrahydroquinoxaline ring, and an indoline ring.

In General Formula (1-5), when $R^{N31}$ represents a group other than an aryl group, $R^a$ and $R^b$ are combined with each other to form an aromatic ring. Aromatic rings, as described herein, include an aryl group (e.g., a phenyl group and a naphthyl group), an aromatic heterocyclyl group (e.g., a pyridine ring, a pyrrole ring, a quinoline ring, and an indole ring), and of these, the aryl group is preferred. The above aromatic ring group may have a substituent. Listed as such substituents are those which are the same substituents as listed when $X^1$ in General Formula (1-3) has a substituent, and the preferred range is also the same. The case is preferred in which in General Formula (1-5), $R^a$ and $R^b$ are combined with each other to form an aromatic ring.

In General Formula (1-5), $R^{32}$ is preferably a hydrogen atom, an alkyl group, an aryl group, a hydroxyl group, an alkoxy group, a mercapto group, and an amino group. One of the preferred examples is that $R^{32}$ represents a hydroxyl group, and at the same time $R^{33}$ represents an electron attractive group. The electron attractive group, as described herein, refers to an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, and a carboimidoyl group. Of these, preferred are the acyl group, the alkoxycarbonyl group, the carbamoyl group, and the cyano group.

Type B compounds will now be described. Type B compounds undergo one-electron oxidation to form a one-electron oxidation product. The resulting one-electron oxidation product releases another electron accompanying the bond cleavage reaction. In other words, the resultant one-electron oxidation product is a compound capable of further undergoing one-electron oxidation. The bond cleavage reaction, as described herein, refers to cleavage of each of the bonds such as carbon-carbon, carbon-silicon, carbon-hydrogen, carbon-boron, carbon-tin, or carbon-germanium, and the cleavage of a carbon-hydrogen bond may be accompanied.

On the other hand, Type B compounds are those which have, in the molecule, at least two (preferably 2-6, and more preferably 2-4) groups adsorptive to silver halide. More preferably, the above compound has as an adsorptive group, being a nitrogen-containing heterocyclyl group substituted with at least two mercapto groups. The number of absorptive groups is preferably 2-6, and is more preferably 2-4. The adsorptive group will be described later.

Of Type B compounds, those which are preferred are represented by aforesaid General Formula (2-1).

Herein, the compounds represented by General Formula (2-1) are those capable of further releasing one electron in such a manner that the reducing group represented by $RED^2$ undergoes one-electron oxidation and subsequently$^2$ is spontaneously released through bond cleavage reaction, namely C (carbon atom)-$L^2$ bond is subjected to cleavage.

In General Formula (2-1), $RED^2$ represents the group defined for $RED^{12}$ of General Formula (1-2), and the preferred range is also the same. $L^2$ represents the same group as described for $L^{11}$ of General Formula (1-1), and the preferred range is also the same. Incidentally, when $L^2$ represents a silyl group, the aforesaid compound is one which has, as an adsorptive group, a nitrogen-containing heterocyclyl group substituted with at least two mercapto groups. $R^{21}$ and $R^{22}$ each independently represent a hydrogen atom or a substituent, and are as defined for $R^{112}$ of General Formula (1-1). Further, the preferred range is also the same. $RED^2$ and $R^{21}$ may be combined with each other to form a ring structure.

The ring structure formed herein refers to a 5- to 7-membered single or condensed ring, a non-aromatic carbon ring or a heterocyclic ring and may have a substituent. However, the aforesaid ring structure may not be one corresponding to a tetrahydro body, a hexahydro body, or an octahydro body of an aromatic ring or an aromatic heterocyclic ring. Listed as such substituents are those which are the same substituents when $RED^{11}$ has a substituent. Preferred ring structures include those corresponding to the dihydro body of an aromatic ring or an aromatic heterocyclic ring, and specific examples include a 2-pyrroline ring, a 2-imidazoline ring, a thiazoline ring, a 1,2-dihydropyridine ring, a 1,4-dihydropyridine ring, an indoline ring, a benzimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1.2-dihydroquinazoline ring, and a 1,2-dihydroquinoxaline ring.

Of these, preferred are a 2-imidazoline ring, a 2-thiazoline ring, an indoline ring, a benzimidazoline ring, a benzothiazoline ring, a benzoxazoline ring, a 1,2-dihydropyridine ring, a 1,2-dihydroquinoline ring, a 1,2-dihydroquinazoline ring, and a 1,2-dihydroquinoxaline ring, in which an indoline ring, a benzimidazoline ring, a benzothiazoline ring, and a 2-hydroquinoline ring are more preferred and an indoline ring is particularly preferred.

Type C compounds will now be described. The features of Type C compounds are that a one-electron oxidation product which is formed by one-electron oxidation after passing the subsequent bond forming process and thereafter, one or more electrons are released. The bond forming process, as described herein, refers to bond formation between atoms such as carbon-carbon, carbon-nitrogen, carbon-sulfur, or carbon-oxygen.

Type C compounds are those which are characterized in such a manner that a one-electron oxidation product which is formed by one-electron oxidation reacts with a reactive group portion (such as a carbon-carbon double bond portion, a carbon-carbon triple bond portion, an aromatic group portion, or a non-aromatic heterocyclyl group portion of a benzo condensed ring) to form a bond, and thereafter, it is possible to release one or more electrons.

The one-electron oxidation product, as described herein, which is formed in such a manner that Type C compound undergoes one-electron oxidation, refers to a cation radical species. However, the possibility exists that a neutral radical species is formed accompanying deprotonation. The resulting one-electron oxidation product (a cation radical species or a radical species) reacts with a carbon-carbon double bond portion, a carbon-carbon triple bond portion, an aromatic group portion, or a non-aromatic heterocyclyl group portion of the benzo condensation ring, which is present in the same molecule to form a bond between atoms such as carbon-carbon, carbon-nitrogen, carbon-sulfur, or carbon-oxygen, whereby a new ring structure is formed in the molecule. The features of the Type C compound are that during this, simultaneously or later, one or more electrons are released.

In more detail, the features of Type C compounds are that after undergoing one-electron oxidation, they form a newly structured radical species via the aforesaid bond forming reaction, and another electron is released directly or via deprotonation from the resultant radical species to result in oxidation.

The Type C compounds include those capable of being oxidized in such as manner that after the two-electron oxidation product is formed as above or in some cases, undergoes hydrolysis or tautomerism accompanying movement of protons, the resultant compound releases another electron or commonly at least the other two electrons. Type C compounds also include those capable of being oxidized upon releasing another electron or commonly two other electrons from the two-electron oxidation product without undergoing such tautomerism.

Type C compounds are preferably represented by aforesaid General Formula (3-1).

In General Formula (3-1), $RED^3$ represents a reducing group capable of being subjected to one-electron oxidation, $Y^3$ represents a reactive group portion which undergoes reaction after $RED^3$ undergoes one-electron oxidation, and specifically represents a carbon-carbon double bond portion, a carbon-carbon triple bond portion, an aromatic group portion, or an organic group containing the non-aromatic heterocyclyl group portion of a benzo condensed ring. $L^3$ represents a group linking $RED^3$ and $Y^3$.

In General Formula (3-1), $RED^3$ is as defined for $RED^{12}$ of General Formula (1-2). In General Formula (3-1), $RED^3$ is preferably an arylamino group, a heterocyclic amino group, an aryloxy group, an arylthio group, an aryl group, an aromatic or non-aromatic heterocyclyl group (particularly preferably, a nitrogen-containing heterocyclyl group), and is more preferably an arylamino group, a heterocyclic amino group, an aryl group, or an aromatic or non-aromatic heterocyclyl group. Of these, preferred as heterocyclyl groups are a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzimidazole ring group, a benzimidazoline ring group, a benzothiazoline ring group, and a 3.4-methylenedioxyphenyl-1-yl group. Particularly preferred as $RED^3$ are an arylamino group (particularly, an anilino group), an aryl group (particularly, a phenyl group), and an aromatic or non-aromatic heterocyclyl group.

When $RED^3$ represents an aryl group, it is preferable that the aforesaid aryl group has at least one electron donating group. The electron donating group, as described herein, refers namely to a hydroxyl group, an alkoxy group, a mercapto group, an alkylthio group, a sulfonamido group, an acylamino group, an alkylamino group, an arylamino group, a heterocyclic amino group, an active methine group, an excessive electron aromatic heterocyclyl group (e.g., an indolyl group, a pyrrolyl group, or an indazolyl group), a nitrogen atom substituting non-aromatic nitrogen-containing heterocyclyl group (a pyrrolidinyl group, an indolinyl group, a piperidinyl group, a piperazinyl group, a morpholino group, or a thiomorpholino group). The active methine group, as described herein, refers to the methine group substituted with two electron attractive groups, which refer to an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, or a carbonimidoyl group. Two electron attractive groups may be combined with each other to form a ring structure.

When $RED^3$ represents an aryl group, substituents of the aryl group are more preferably an alkylamino group, a hydroxyl group, an alkoxy group, a mercapto group, a sulfonamido group, an active methine group, and a nitrogen atom substituting non-aromatic nitrogen-containing heterocyclyl group, are still more preferably an alkylamino group, a hydroxyl group, an active methine group, and a nitrogen atom substituting non-aromatic nitrogen-containing heterocyclyl group, and are most preferably an alkylamino group and a nitrogen atom substituting non-aromatic nitrogen-containing heterocyclyl group.

In General Formula (3-1), when the reactive group represented by $Y^3$ refers to an organic group containing a carbon-carbon double bond or a carbon-carbon triple bond, each having a substituent, listed as the preferred substituents are an alkyl group (preferably having 6-12 carbon atoms), an alkoxycarbonyl group (preferably having 2-8 carbon atoms), a carbamoyl group, an acyl group, and an electron donating group. The electron donating group, as described herein, refers to an alkoxy group (preferably having 1-8 carbon atoms), a hydroxyl group, an amino group, an alkylamino group (preferably having 1-8 carbon atoms), an arylamino group (preferably having 6-12 carbon atoms), a heterocyclic amino group (preferably having 2-6 carbon atoms), a sulfonamido group, an acylamino group, an active methine group, a mercapto group, an alkylthio group (preferably having 1-8 carbon atoms), an arylthio group (preferably having 6-12, carbon atoms), and an aryl group (preferably having 2-8 carbon atoms in the aryl portion) having any of these substituents. A hydroxyl group may be protected by a silyl group. Listed, for example, are a trimethylsilyloxy group, a tert-butyldimethylsilyloxy group, a triphenylsilyloxy group, a triethylsilyloxy group, and a phenyldimethylsilyloxy group. Listed as examples of a carbon-carbon double bond portion and a carbon-carbon triple bond portion are a vinyl group and an ethynyl group.

When $Y^3$ represents an organic group containing a carbon-carbon double bond portion having a substituent, the preferred substituents include an alkyl group, a phenyl group, an acyl group, a cyano group, an alkoxycarbonyl group, a carbamoyl group, and an electron donating group. Preferred electron donating groups include an alkoxy group, a hydroxyl group (which may be protected by a silyl group), an amino group, an alkylamino group, an arylamino group, a sulfonamido group, an active methine group, a mercapto group, an alkylthio group, and a phenyl group having any of these electron donating group as a substituent.

Incidentally, herein, when an organic group containing a carbon-carbon double bond portion has a hydroxyl group as a substituent, $Y^3$ is to contain a partial structure on the right, namely $>C^1{=}C^2(—OH)—$, the resultant structure may undergo tautomerism to form the partial structure on the right, namely $>C^1H—C^2({=}O)—$. Further, in this case, the case is preferred in which a substituent substituted on the aforesaid $C^1$ carbon is an electron attractive group. In this case, $Y^3$ is to have a partial structure of "an active methylene group" or "an active methine group". Electron attractive groups, as described herein, capable of resulting in such a partial structure of the active methylene group or the active methine group are as described in above "active methine group".

When $Y^3$ represents an organic group containing a carbon-carbon triple bond portion having a substituent, the preferred substituents include an alkyl group, a phenyl group, an alkoxycarbonyl group, a carbamoyl group, and an electron donating group. Preferred electron donating groups include an alkoxy group, an amino group, an alkylamino group, an arylamino group, a heterocyclic amino group, a sulfonamido group, an acylamino group, an active methine group, a mercapto group, an alkylthio group, and a phenyl group, each having any of these electron donating group as a substituent.

When $Y^3$ represents an organic group having an aromatic group portion, the preferred aromatic groups include an aryl group (particularly preferably a phenyl group) having an electron donating group as a substituent or an indole ring group, while herein, preferred electron donating groups include a hydroxyl group (which may be protected by a silyl group), an alkoxy group, an amino group, an alkylamino group, an active methine group, a sulfonamido group, and a mercapto group.

When $Y^3$ represents an organic group containing a non-aromatic heterocyclyl group portion of a benzo condensed ring, preferred non-aromatic heterocyclyl groups of the benzo condensed ring include those having an aniline structure in the interior as a partial structure. Listed as the examples are an indoline ring group, a 1,2,3,4-tetrahydroquinoline ring group, a 1,2,3,4-tetrahydroquinoxaline ring group and a 4-quinolone ring group.

In General Formula (3-1), more preferred reactive groups represented by $Y^3$ include organic groups containing a carbon-carbon double bond portion, an aromatic group portion, or a non-aromatic heterocyclyl group of a benzo condensed ring. More preferred reactive groups include a carbon-carbon double bond portion, a phenyl group having an electron donating group as a substituent, an indole ring group, and a non-aromatic heterocyclyl group of a benzo condensed ring having an aniline structure in the interior as a partial structure. Herein, it is preferable that the carbon-carbon double bond portion has at least one-electron donating group as a substituent.

In General Formula (3-1), the reactive groups represented by $Y^3$ are selected from the range described as above. As a result, the case having the same partial structure as that of the reducing group represented by $RED^3$ in General Formula (3-1) is also the preferred example of the compounds represented by General Formula (3-1).

In General Formula (3-1), $L^3$ represents a group which links $RED^3$ and $Y^3$, and specifically represents an alkylene group, an arlyene group, a heterocyclyl group, —O—, —S—, —$NR^N$—, —C(=O)—, —$SO_2$—, —SO—, and —P(=O)— or combinations of these groups, wherein $R^N$ represents a hydrogen atom, an alkyl group, an aryl group, and a heterocyclyl group. The linking group represented $byl^3$ may have a substituent. Listed as such substituents are the same ones described as those which $RED^{11}$ of General Formula (1-1) may have. The linking group represented $byl^3$ can be linked at any position of the group represented by $RED^3$ and $Y^3$ in the form of replacing any one of the hydrogen atoms.

It is preferable that when a bond is formed by allowing a reactive group represented by $Y^3$ of General Formula (3-1) to react with a cation radical species ($X^+$•) or a radical species (X•) which is formed by deprotonation of the aforesaid radical, the group of atoms related to the foregoing can form a 3- to 7-membered ring structure including $L^3$. Consequently, it is preferable that the radical species ($X^+$• or X•), the reactive group represented by Y, and L are connected via 3-7 groups of atoms.

Listed as preferred examples of $L^3$ are a single bond, an alkylene group (particularly, a methylene group, an ethylene group, or a propylene group), an arylene group (particularly, a perylene group), a —C(=O)— group, an —O— group, an —NH— group, an —N(alkyl group)- group, and a divalent linking group formed by combinations of these groups.

Of compounds represented by General Formula (3-1), preferred compounds are represented by General Formulas (3-1-1)-(3-1-4).

General Formula (3-1-1)

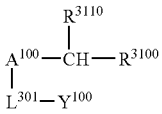

General Formula (3-1-2)

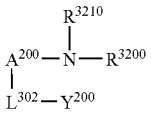

General Formula (3-1-3)

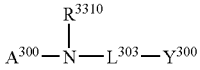

General Formula (3-1-4)

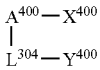

In General Formulas (3-1-1)-(3-1-4), $A^{100}$, $A^{200}$, and $A^{400}$ each represent an arylene group or a divalent heterocyclyl group, while $A^{300}$ represents an aryl group or a heterocyclyl group. The preferred range of these groups is as defined for $RED^3$ of General Formula (3-1). $L^{301}$, $L^{302}$, $L^{303}$, and $L^{304}$ each represent a linking group and are as defined for $L^3$ of General Formula (3-1). The preferred range is also the same. $Y^{100}$, $Y^{200}$, $Y^{300}$, and $Y^{400}$ each represent a reactive group and are as defined for $Y^3$ of General Formula (3-1). Further the preferred range is also the same. $R^{3100}$, $R^{3110}$, $R^{3200}$, $R^{3210}$, and $R^{3310}$ each represent a hydrogen atom or a substituent. $R^{3100}$ and $R^{3110}$ are each preferably a hydrogen atom, an alkyl group, or an aryl group. $R^{3200}$ and $R^{3310}$ are each preferably a hydrogen atom. $R^{3210}$ is preferably a substituent, which is preferably an alkyl group or an aryl group. Each pair of $R^{3110}$ and $A^{100}$, $R^{3210}$ and $A^{200}$, and $R^{3310}$ and $A^{300}$ may join together to form a ring structure. Formed rings herein are preferably a tetralin ring, an indane ring, a tetrahydroquinoline ring, or an indoline ring. $X^{400}$ represents a hydroxyl group, a mercapto group, and an alkylthio group in which a hydroxyl group, and a mercapto group are preferred and a method group is more preferred.

Of the compounds represented by General Formulas (3-1-1)-(3-1-4), more preferred compounds are those represented by General Formulas (3-1-2), (3-1-3), or (3-1-4), and still more preferred are compounds represented by General Formula (3-1-2) or (3-1-3).

Type D compounds will now be described. The aforesaid Type D compounds are those having a ring structure substituted with a reducing group and are those capable of releasing one or more electrons accompanying a cleavage reaction of the ring structure after the aforesaid reducing group undergoes one-electron oxidation. Type D compounds undergo one-electron oxidation and are then subjected to cleavage of the ring structure. The ring cleavage reaction, as described herein, refers to the scheme described below.

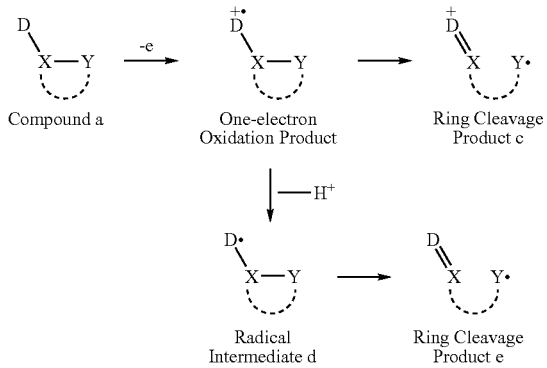

In the above formula, Compound a represents a Type D compound. In Compound a, D represents a reducing group, while X and Y represent atoms in the ring structure, forming a bond which is subjected to cleavage after one-electron oxidation. Initially, Compound a undergoes one-electron oxidation to form One-electron Oxidation Product b. From here, D-X single bond is transformed to a double bond and at the same time, the X—Y bond is cleaved to form Ring Cleavage Product c. Alternatively, One-electron Oxidation Product undergoes deprotonation to form Radical Intermediate d, whereby Ring Cleavage Product e is formed. The features of the compounds employed in the present invention are that at least one electron is subsequently released from Ring Cleavage Product c or e.

The ring structures possessed by Type D compounds, as described herein, are carbon rings or heterocyclic rings in the from of a 3- to 7-membered ring, which include a single ring or a condensed ring, or saturated or unsaturated non-aromatic ring. Preferred are saturated ring structures, and more preferred are 3- or 4-membered rings. Preferred ring structures include a cyclopropane ring, a cyclobutane ring, an oxirane ring, an oxetane ring, an aziridine ring, an azetidine ring, an episulfide ring, and a thietane ring. Of these, more preferred are a cyclopropane ring, a cyclobutane ring, an oxirane ring, an oxetane ring, and an azetidine ring, and particularly preferred are a cyclopropane, a cyclobutane, and an azetidine ring. These ring structure may have a substituent.

Type D compounds are preferably represented by aforesaid General Formula (4-1) or (4-2).

In General Formulas (4-1) and (4-2), $RED^{41}$ and $RED^{42}$ are each as defined for $RED^{12}$ of General Formula (1-2), and the preferred range is also the same. $R^{40}$-$R^{44}$ and $R^{45}$-$R^{49}$ each represent a hydrogen atom or a substituent. Listed as such substituents are those which are the same as the substituents for $RED^{12}$. In General Formula (4-2), $Z^{42}$ represents —$CR^{420}R^{421}$—, —$NR^{423}$—, or —O—, wherein $R^{420}$ and $R^{421}$ each represent a hydrogen atom or a substituent, while $R^{423}$ represents a hydrogen atom, an alkyl group, an aryl group, or a heterocyclic group.

In General Formula (4-1), $R^{40}$ is preferably a hydrogen atom, an alkyl group, an alkenyl group, an alkynyl group, an aryl group, a heterocyclyl group, an alkoxy group, an amino group, an alkylamino group, an arylamino group, a heterocyclic amino group, an alkoxycarbonyl group, an acyl group, a carbamoyl group, a cyano group, or a sulfamoyl group, is more preferably a hydrogen atom, an alkyl group, or an aryl group, and is most preferably a hydrogen atom, an alkyl group, an aryl group, heterocyclyl group, an alkoxycarbonyl group, or a carbamoyl group.

With regard to $R^{41}$-$R^{44}$, the case in which at least one of $R^{41}$-$R^{44}$ is a donating group, and the case in which $R^{41}$ and $R^{42}$ or $R^{43}$ and $R^{44}$ are both electron attractive groups are preferred. The more preferred case is in which at least one of $R^{41}$-$R^{44}$ is a donating group, and the still more preferred case is that at least one of $R^{41}$-$R^{44}$ is a donating group and the group which is not the donating group in $R^{41}$-$R^{44}$ is a hydrogen atom or an alkyl group.

Donating groups, as described herein, include a hydroxyl group, an alkoxy group, an aryloxy group, a mercapto group, an acylamino group, a sulfonylamino group, an active methine group, or a group selected from a group of the groups, which are preferred as $RED^{41}$ and $RED^{42}$. Employed as preferred donating groups are an alkylamino group, an arylamino group, a heterocyclic amino group, a 5-membered aromatic heterocyclyl ring having one nitrogen atom in the ring (which may be a single ring or a condensed ring), a nitrogen atom substituting non-aromatic nitrogen-containing heterocyclyl group, a phenyl group substituted with at least one-electron donating group, (herein, the electron donating group refers to a hydroxyl group, an alkoxy group, an aryloxy group, an amino group, an alkylamino group, an arylamino group, a heterocyclic amino group, or a nitrogen atom substituting non-aromatic nitrogen-containing heterocyclyl group). More preferably employed are an alkylamino group, an arylamino group, a 5-membered aromatic heterocyclyl group having one nitrogen atom in the ring (wherein the aromatic heterocyclic ring represents an indole ring, a pyrrole ring, or a carbazole ring), a phenyl group substituted with an electron donating group (wherein., particularly, represents a phenyl group substituted with at least three alkoxy groups, a hydroxyl group, an alkylamino group, or a phenyl group substituted with a hydroxyl group, an alkylamino group, or an arylamino group). Particularly preferably employed are an arylamino group, a 5-membered aromatic heterocyclyl group having one nitrogen atom in the ring (herein, it refers to a 3-indolyl group), a phenyl group substituted with an electron donating group (herein, particularly, a trialkyloxyphenyl group, an alkylamino group, or a phenyl group substituted with an arylamino group). Electron attractive groups are the same as those which were described in the description of the active methine group.

In General Formula (4-2), the preferred range of $R^{45}$ is as defined for $R^{40}$ of aforesaid General Formula (4-1). $R^{46}$-$R^{49}$ are each preferably a hydrogen atom, an alkyl group, an alkenyl group, an alkynyl group, an aryl group, a heterocyclyl group, a hydroxyl group, an alkoxy group, an amino group, an alkylamino group, an arylamino group, a heterocyclic amino group, a mercapto group, an arylthio group, an alkylthio group, an acylamino group, and a sulfonamino group, and are each more preferably a hydrogen atom, an alkyl group, an aryl group, a heterocyclyl group, an alkoxy group, an alkylamino group, an arylamino group, and a heterocyclic amino group. Particularly preferred for $R^{46}$-$R^{49}$ are, in the case in which $Z^{42}$ is a group represented by —$CR^{420}R^{421}$, a hydrogen atom, an alkyl group, an aryl group, a heterocyclyl group, an alkylamino group, an arylamino group, in the case in which $Z^{42}$ represents —$NR^{423}$—, a hydrogen atom, an alkyl group, an aryl group., and a heterocyclyl group, while in the case in which $Z^{42}$ represents —O—, a hydrogen atom, an alkyl group, an aryl group, and a heterocyclyl group.

$Z^{42}$ is preferably —$CR^{420}R^{421}$ or —$NR^{423}$—, and is more preferably —$NR^{423}$—. $R^{420}$ and $R^{421}$ are each preferably a hydrogen atom, an alkyl group, an alkenyl group, an alkynyl group, an aryl group, a heterocyclyl group, a hydroxyl group, an alkoxy group, an amino group, a mercapto group, an acylamino group, and a sulfonamino group, and are each more preferably a hydrogen atom, an alkyl group, an aryl group, a heterocyclyl group, an alkoxy group, and an amino group. $R^{423}$ is preferably a hydrogen atom, an alkyl group, an aryl group, and an aromatic heterocyclyl group, and is more preferably a methyl group, an ethyl group, an isopropyl group, a tert-butyl group, a tert-amyl group, a benzyl group, a diphenylmethyl group, an aryl group, a phenyl group, a naphthyl group, a 2-pyridyl group, a 4-pyridyl group, and a 2-thiazolyl group.

In the case in which each of $R^{40}$-$R^{49}$, $R^{420}$, $R^{421}$, and $R^{423}$ is a substituent, the number of total carbons for each is preferably at most 40, is more preferably at most 30, and is most preferably at most 15. These substituents may be combined with each other, or combine with another portion ($RED^{41}$, $RED^{42}$ or $Z^{42}$) in the molecule to form a ring.

Type A, Type C, and Type D compounds are preferably "compounds having, in the molecule, an adsorptive group to silver halide" or "compounds having, in the molecule, a partial structure of a spectral sensitizing dye". Type A, Type C, and Type D compounds are more preferably "compounds having, in the molecule, an adsorptive group to silver halide". On the other hand, Type B compounds are "compounds having, in the molecule, at least two groups adsorptive to silver halide". Type A-D compounds are more preferably "compounds having, as an adsorptive group, a nitrogen-containing heterocyclyl group substituted with at least two mercapto groups".

In Types A-D compounds, the adsorptive group to silver halide, as described herein, refers to the group which directly adsorbs onto silver halide or accelerates adsorption onto silver halide. Specific examples include a mercapto group (or salts thereof), a thione group (—C(═S)—), a heterocyclyl group containing at least one atom selected from the group consisting of a nitrogen atom, a sulfur atom, a selenium atom, and a tellurium atom, a sulfide group, a cationic group, or a thienyl group. However, in Type B compounds, a sulfide group is not included as an adsorptive group.

As used herein, a mercapto group (or salts thereof) as an adsorptive group, refers to the mercapto group itself (or salts thereof) and at the same time, more preferably to a heterocyclyl group, an aryl group, or an alkyl group substituted with at least one mercapto group (or salts thereof). As used herein, the heterocyclyl group is a 5- to 7-membered single or condensed aromatic or non-aromatic heterocyclyl group. Examples include an imidazole ring group, a thiazole ring group, an oxazole ring group, a benzimidazole ring group, a benzothiazole ring group, a benzoxazole ring group, a triazole ring group, a thiazole ring group, an oxadiazole ring group, a tetrazole ring group, a purine ring group, a pyridine ring group, a quinoline ring group, an isoquinoline ring group, a pyrimidine ring group, and a triazine ring group. Further, preferred is a heterocyclyl group containing a quaternary nitrogen atom. In such a case, a substituted mercapto group undergoes dissociation to form a mesoion. Examples of such heterocyclyl groups include an imidazolium ring group, a pyrazolium ring group, a thiazolium ring group, a triazolium ring group, a tetrazolium ring group, a thiazolium ring group, a pyridium ring group, a pyrimidinium ring group, and a triazinium ring group. Of these, preferred is a triazolium ring group (e.g., a 1,2,4-triazolium-3-thiolate ring group). Listed as aryl groups are a phenyl group and a naphthyl group, while listed as alkyl groups are straight, branched, or cyclic alkyl groups having 1-30 carbon atoms. When a mercapto group forms a salt, listed as counter ions are cations ($Li^+$, $Na^+$, $K^+$, $Mg^{2+}$, $Ag^+$, or $Zn^{2+}$) of alkaline metals, alkaline earth metals, and heavy metal, an ammonium ion, a heterocyclyl group having a quaternary nitrogen atom, and a phosphonium ion.

The mercapto group as an adsorptive group may further undergo tautomerism to result in a thione group. Specific examples include a thioamido group (herein, a —C(═S)—NH— group, a group containing the partial structure of the aforesaid thioamido group, namely a chain or cyclic thioamido group, a thioureido group, a thiourethane group, or a dithiocarbamic acid ester group. Herein, listed as examples of cyclic groups are a thiazolidine-2-thione group, an oxazolidine-2-thione group, a 2-thiohydantoin group, a rhodanine group, an isorhodanine group, a thiobarbituric acid, and a 2-thioxo-oxazolidine-4-4-one group.

The thione group as an adsorptive group, as described herein, includes a thione group formed via tautomerism of the above mercapto group as well as a chain or cyclic thioamido group, a thioureido group, a thiourethane group, and a thiocarbamic acid ester group (having no hydrogen atom in the α-position of the thione group), in which it is not possible for the mercapto group to undergo tautomerism.

The heterocyclyl groups containing at least one selected from the following: a nitrogen atom, a sulfur atom, a selenium atom or a tellurium atom as a adsorptive group, as described herein, include a nitrogen containing heterocyclyl group having, as a partial structure, an —NH— group capable of forming imino silver (>NAg) or a heterocyclyl group having, as a partial structure of the heterocyclyl group, an "—S—" group, an "—Se—" group, a "—Te—" group, or an "═N—" group. Examples of the former include a benzotriazole group, a triazole group, an indazole group, a pyrazole group, a tetrazole group, a benzimidazole group, an imidazole group, and a purine group, while examples of the latter include a thiophene group, a thiazole group, an oxazole group, a benzothiazole group, a benzoxazole group, a thiadiazole group, an oxadiazole group, a triazine group, a selenazole group, a benzoselenazole group, a tellurazole group, and a benzotellurazole group. The former is preferred.

Listed as sulfide groups as an adsorptive group are all the groups having as "—S—" as a partial structure. Of these, preferred are groups having a partial structure of alkyl (or alkylene)-S-alkyl (or alkylene), aryl (or arlylene)-S-alkyl (or alkylene), aryl (or arylene)-S-aryl (or arylene). Further, these sulfide groups may form a ring structure or may result in a —S—S— group. Specific examples in the case of forming a ring structure include groups containing a thiolane ring, a 1,3-dithiolane ring, a 1,2-dithiolane ring, a thiane ring, a dithiane ring or a tetrahydro-1,4-thiazine ring (a thiomorpholine ring). Particularly preferred as a sulfide group are those having a partial structure of alkyl (or alkylene)-S-alkyl (or alkylene).

The cationic group as an adsorptive group, as described herein, refers to a group containing a quaternary nitrogen atom, and specifically a nitrogen-containing heterocyclyl group having an ammonio group or a quaternary nitrogen atom, provided that the aforesaid cationic group does not become a part of the group of atoms (e.g., a cyanine chromophore) forming a dye structure. The ammonio group, as described herein, refers to a trialkylammonio group, a dialkylarylammonio group, or an alkyldiarylammonio group. Listed as examples are a benzyldimethylammonio group, a trihexylammonio group, and a phenyldiethylammonio group. The nitrogen-containing heterocyclyl group containing a quaternary nitrogen atom, as described herein, refers, for example, to a pyridinio group, a quinolinio group, an isoquinolinio group, and an imidazolio group. Of these, preferred are a pyridinio group and an imidazolio group, and the pyridinio group is particularly preferred. These nitrogen-containing heterocyclyl groups containing a quaternary nitrogen atom may have any of the substituents. In the case of a pyridinio group and an imidazolio group, listed as preferred substituents are an alkyl group, an aryl group, an acylamino group, a chlorine atom, an alkoxycarbonyl group, and a carbamoyl group. On the other hand, in the case of a pyridinio group, particularly preferred is a phenyl group.

The ethynyl group as an adsorptive group, as described herein, refers to a —C═CH— group, in which the hydrogen atom may be substituted. The above adsorptive group may have any of the substituents.

Incidentally, further listed as specific examples of adsorptive groups are those described on pages 4-7 of JA-P No. 11-95355.

In the present invention, those preferred as an adsorptive group are a mercapto substituted nitrogen-containing heterocyclyl group (e.g., a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, and a 1,5-dimethyl-1,2,4-triazolium-3-thiolate group), and a nitrogen-containing heterocyclyl group having, as a partial structure of the heterocyclic ring, an —NH— group capable of forming imino silver (>NAg)(e.g., a benzotriazole group, a benzimidazole group, and an indazole group). Of these, more preferred are a 5-mercaptotetrazole group, a 3-mercapto-1,2,4-triazole group, and a benzotriazole group and most preferred are a 3-mercapto-1,2,4-triazole group, and a 5-mercaptotetrazole group.

Of compounds employed in the present invention, particularly preferred are those which have at least two mercapto groups in the molecule as a partial structure. The mercapto group (—SH), as described herein, may be changed to a thione group when formed via tautomerism. Examples, of such compounds may include compounds having, in the molecule, at least two adsorptive groups, as above, having a mercapto group or a thione group as a partial structure (for example, a ring forming thioamido group, an alkylmercapto group, an arylmercapto group, and a heterocyclic mercapto group), or may include at least one adsorptive group (for example, a dimercapto substituted nitrogen-containing heterocyclyl group) having at least two mercapto groups or thione groups in the molecule as a particle structure.

Preferred examples of adsorptive groups (being a dimercapto substituted nitrogen-containing heterocyclyl group) having at least two mercapto groups as a partial structure include a 2,4-dimercaptopyrimidine group, a 2,4-dimercaptotriazine group, a 3,5-dimercapto-1,2,4-triazole group, a 2,5-dimercapto-1,3,-thiazole group, a 2,5-dimercapto-1,3-oxazole group, a 2,7-dimercapto-5-methyl-s-triazolo(1,5-A)-pyrimidine, a 2,6,8-trimercaptopurine, a 6,8-dimercaptopurine, a 3,5,7-trimethyl-s-triazolotriazine, a 4,6-dimercaptopyrazolopyrimidine, and a 2,5-dimercaptoimidazole. Of these, particularly preferred are a 2,4-dimercaptopyrimidine group, a 2,4-dimercaptotriazine group and a 3,5-dimercapto-1,2,4-triazole group.

The adsorptive group may be substituted on any position of General Formulas (1-1)-(4-2). However, it is preferable that in General Formulas (1-1)-(3-1), substitution is performed on $RED^{11}$, $RED^{12}$, $RED^{2}$, or $RED^{3}$; in General Formulas (4-1) and (4-2), substitution is performed on $RED^{41}$, $R^{41}$, $RED^{42}$, or $R^{46}$-$R^{48}$; in General Formulas (1-3)-(1-5), substitution is performed on any position other than $R^{1}$, $R^{2}$, $R^{11}$, $R^{12}$, $R^{31}$, $L^{1}$, $L^{21}$, and $L^{31}$; and in all General Formulas (1-1)-(4-2), substitution is performed in $RED^{11}$-$RED^{42}$.

The partial structure of spectral sensitizing dyes, as described herein, refers to the chromophore containing group of the spectral sensitizing dyes and the residual group formed by removing any of the hydrogen atoms of a spectral sensitizing dye. The partial structure of spectral sensitizing dyes may be substituted on any position of General Formulas (1-1)-(4-2). However, it is preferable that in General Formulas (1-1)-(3-1), substitution is performed on $RED^{11}$, $RED^{12}$, $RED^{2}$, or $RED^{3}$; in General Formulas (4-1) and (4-2), substitution is performed on $RED^{41}$, $R^{41}$, $RED^{42}$, or $R^{46}$-$R^{48}$; in General Formulas (1-3)-(1-5), substitution is performed on any position except for $R^{1}$, $R^{2}$, $R^{11}$, $R^{12}$, $R^{31}$, $L^{1}$, $L^{21}$, and $L^{31}$; and in all General Formulas (1-1)-(4-2), substitution is performed on $RED^{11}$-$RED^{42}$. Preferred spectral sensitizing dyes are those which are typically applied to color sensitization techniques. Examples include cyanine dyes, composite cyanine dyes, merocyanine dyes, composite merocyanine dyes, homopolar cyanine dyes, styryl dyes, and hemicyanine dyes. Representative spectral sensitizing dyes are disclosed in Research Disclosure Item 36544, September 1994. It is possible for a person skilled in the art to synthesize these dyes employing the procedures described in the aforesaid Research Disclosure or in F. M. Hamer, The Cyanine Dyes and Related Compounds (Interscience Publishers, New York, 1964). Further, dyes described on pages 7-14 of JP-A No. 11-95355 (U.S. Pat. No. 6,054,260) are usable without any modification.

The total number of carbon atoms of Type A-D compounds of the present invention is preferably in the range of 10-60, is more preferably in the range of 10-50, is still more preferably in the range of 11-40, and is most preferably in the range of 12-30.

Type A-D compounds undergo one-electron oxidation, being triggered by exposing to light, a silver halide light-sensitive photographic material in which the above compounds are used. After the subsequent reaction, the resultant material releases another electron or at least two electrons depending on the type of material, and is then oxidized. The oxidation potential of the first electron is preferably at most 1.4 V, and is more preferably at most 1.0 V. The above oxidation potential is preferably at least 0 V and is more preferably at least 0.0.3 V. Consequently, the oxidation potential is preferably in the range of about 0-about 1.4 V, and is more preferably in the range of about 0.3-about 1.0 V.

Herein, it is possible to determine the oxidation potential employing a cyclic voltammetry technique. In practice, a sample is dissolved in a solution of acetonitrile:water=80 precept:20 percent (by volume), and the resultant solution is bubbled with nitrogen gas. Thereafter, a glass carbon disk is employed as an operating electrode, while a platinum wire is employed a counter electrode. Subsequently, a calomel electrode (SCE) is used as a reference electrode, and determination is performed at a potential scanning rate of 0.1 V/second at 25° C. When a cyclic voltammetry wave reaches its peak potential, oxidation potential with respect to SCE is recorded.

In the case in which Type A-D compounds undergo one-electron oxidation and after the subsequent reaction, release another electron, the oxidation potential during the second-half step is preferably from −0.5 to −2 V, is more preferably from −0.7 to −2 v, and is still more preferably from −0.9 to −1.6V.

In the case in which Type A-D compounds undergo one-electron oxidation and after the subsequent reaction, release at lest two electrons for oxidation, the oxidation potential during the second-half step is not particularly limited. Reasons for this are that since it is difficult to clearly separate the oxidation potential of the second electron from that of the third electron and the subsequent electron, it is frequently difficult to correctly determine these and to separate them.

Specific examples of the compounds represented by General Formula (1-1)-(4-2) of the present invention are listed below, however, the present invention is not limited thereto.

1

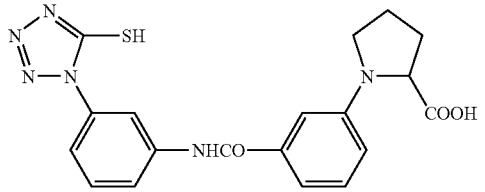

2

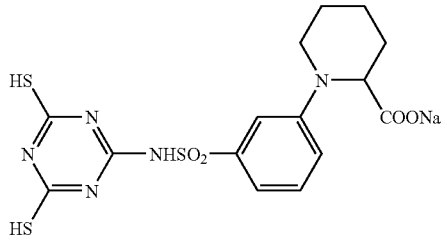

-continued
3
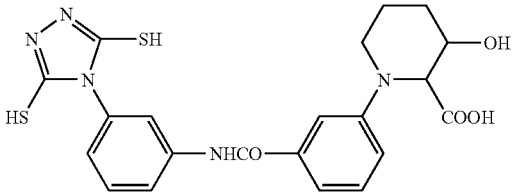
4
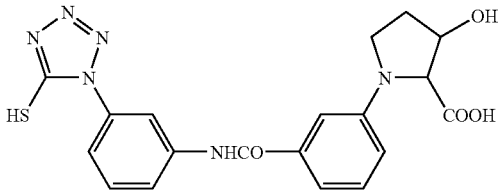
5
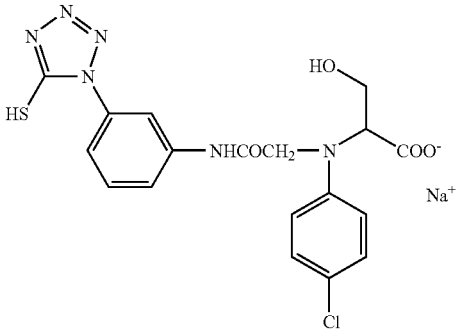
6
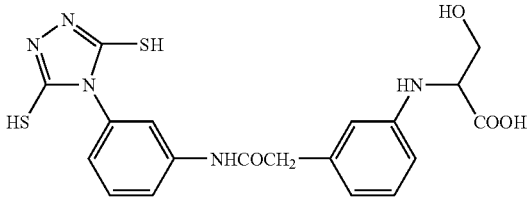
7
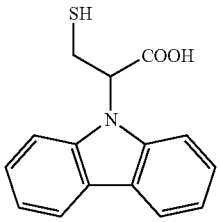
8
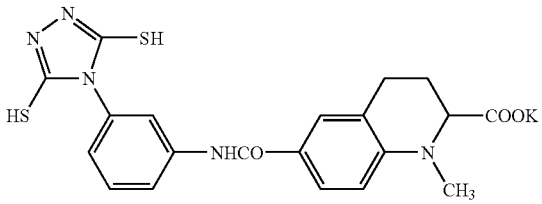
9
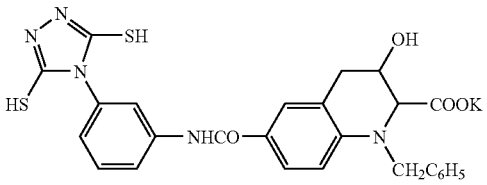
10
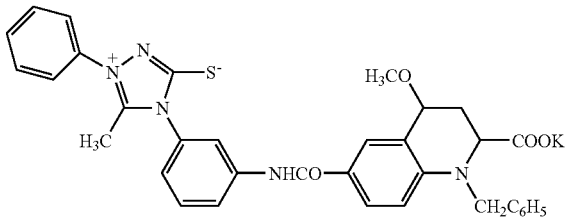
11
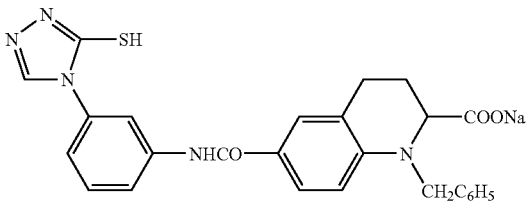
12
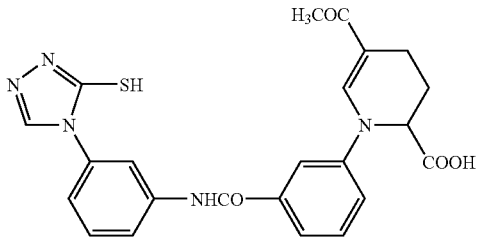
13
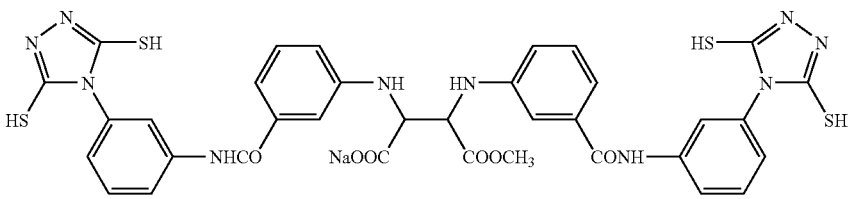

-continued
14
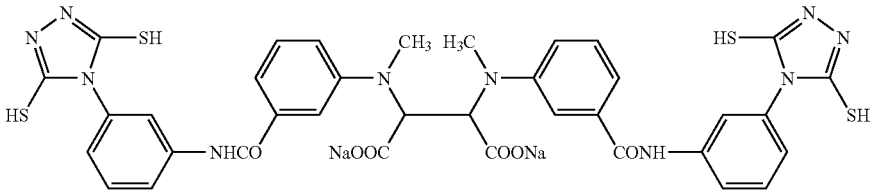
15
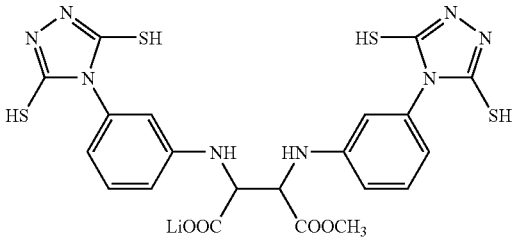
16
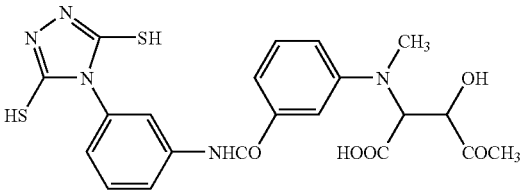
17
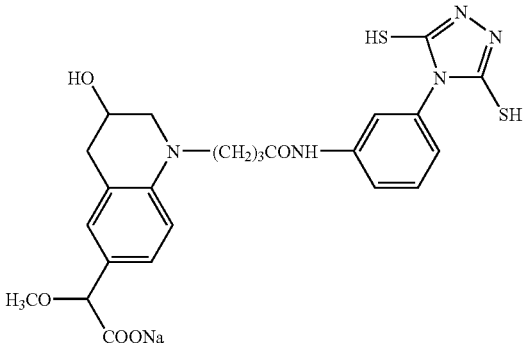
18
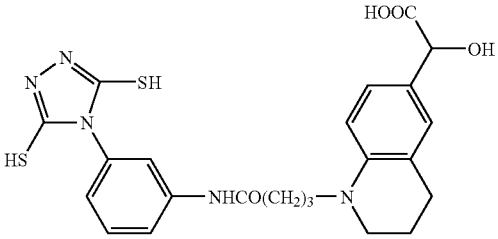
19
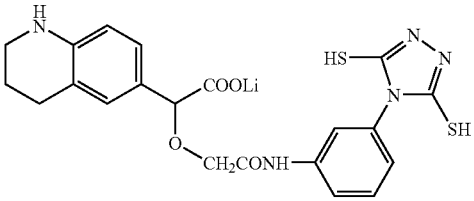
20
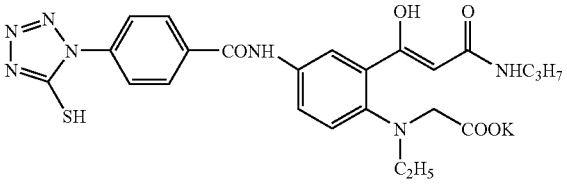
21
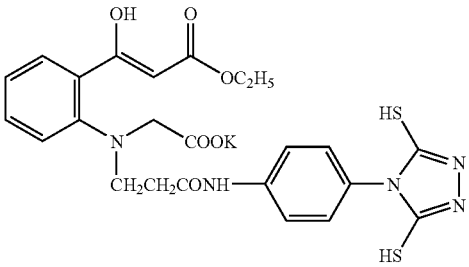
22
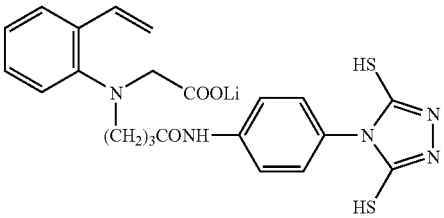
23
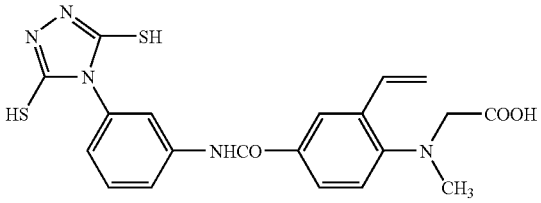
24
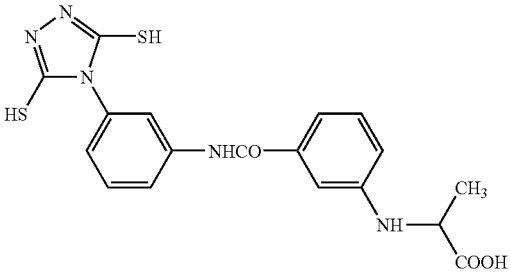

-continued
25
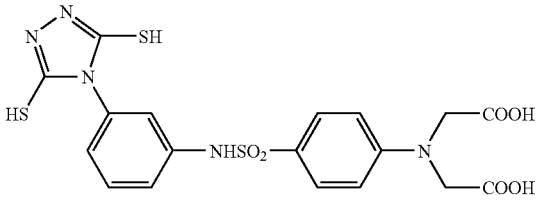
26
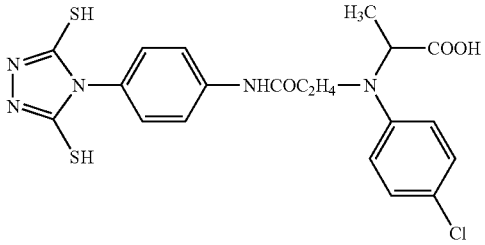
27
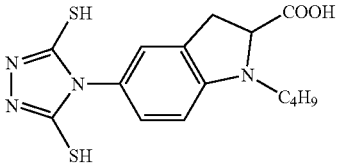
28
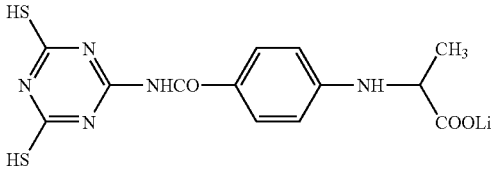
29
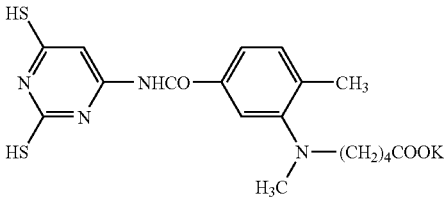
30
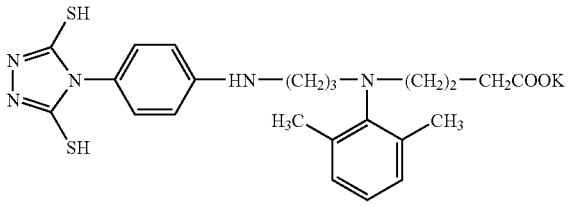
31
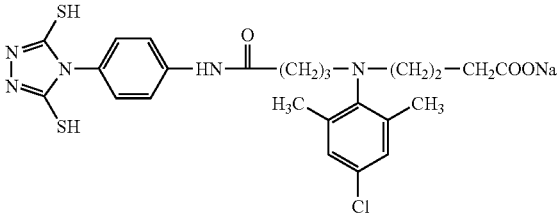
32
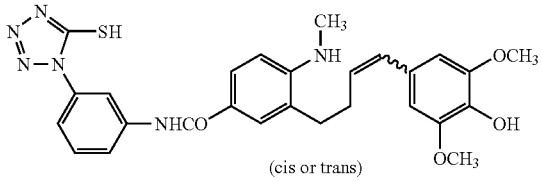
33
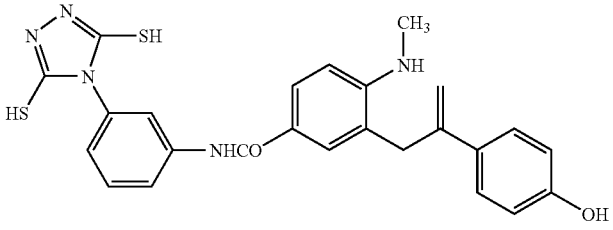
34
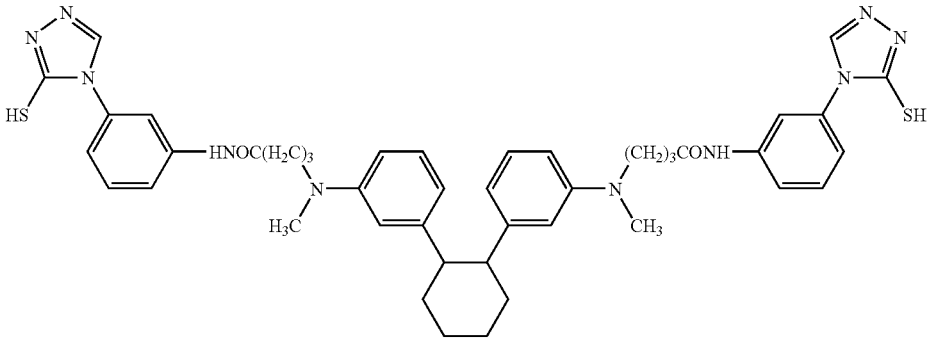

-continued
35
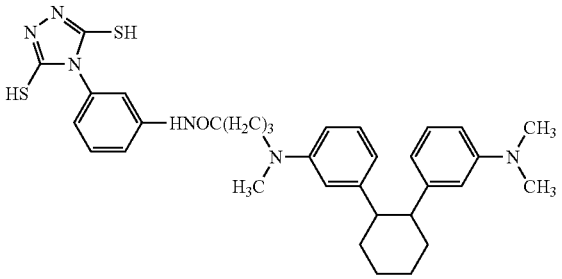
36
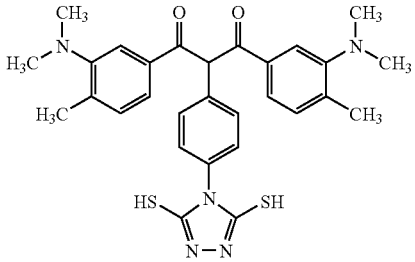
37
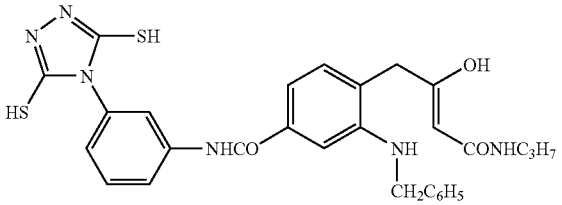
38
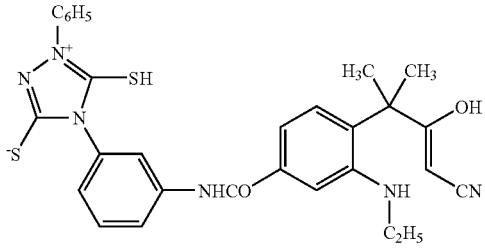
39
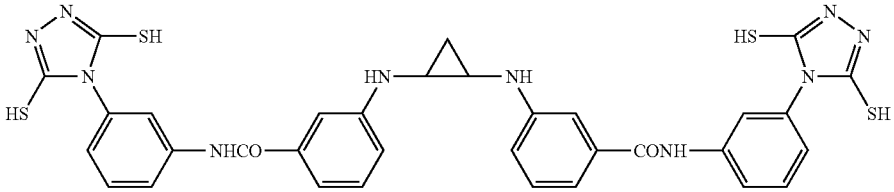
40
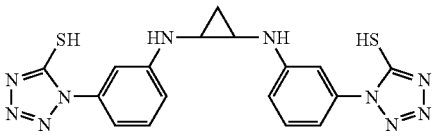
41
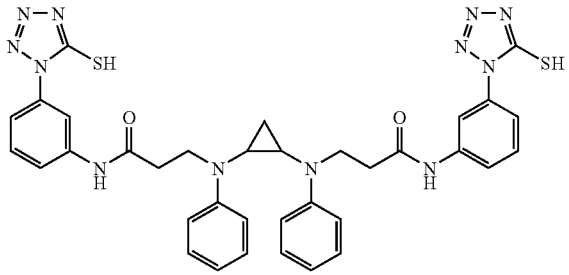
42
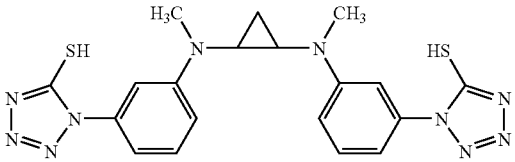
43
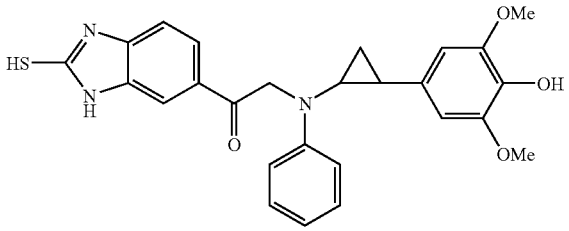
44
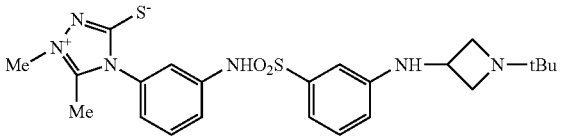
45
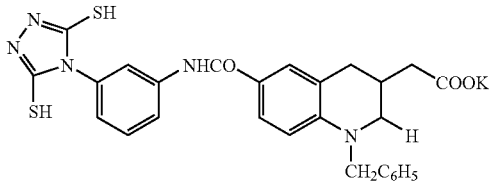

-continued
46
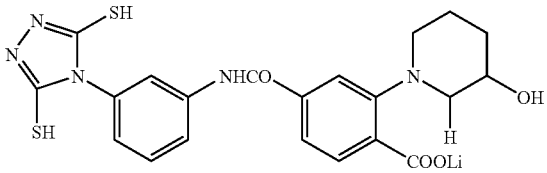
47
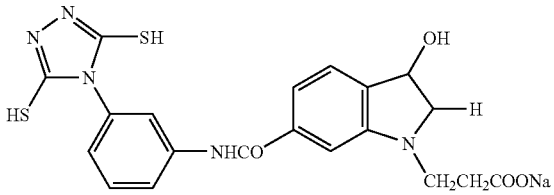
48
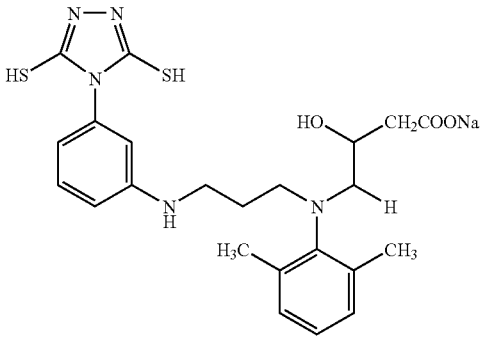
49
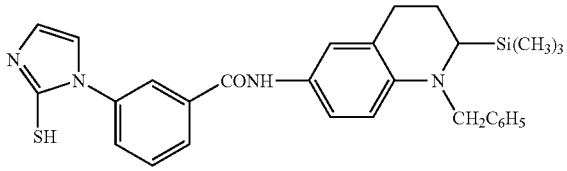
50
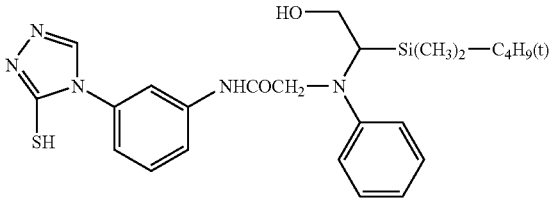
51
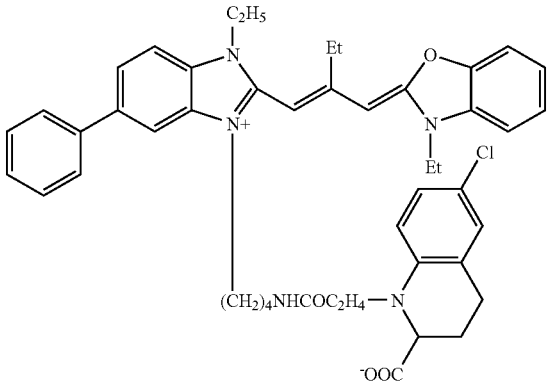
52
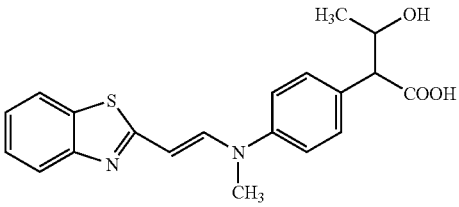
53
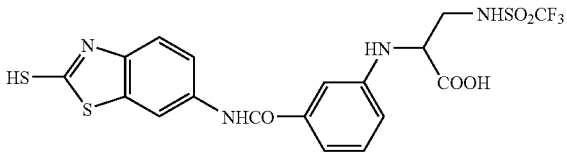
54
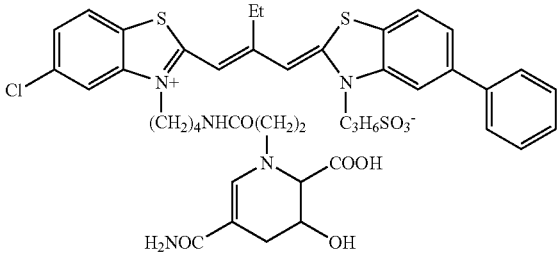
55
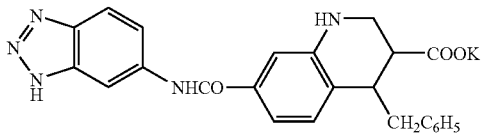

-continued

56

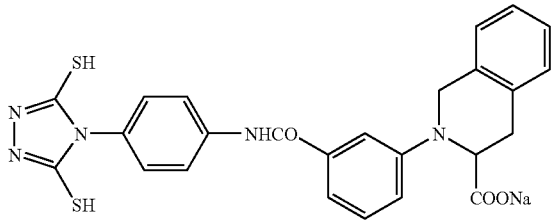

57

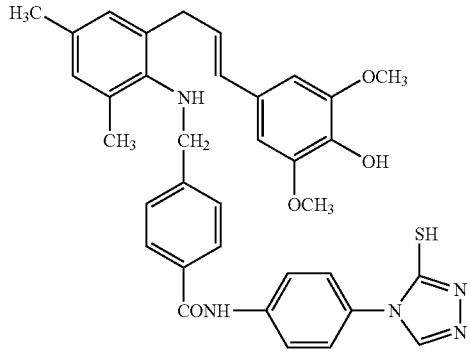

58

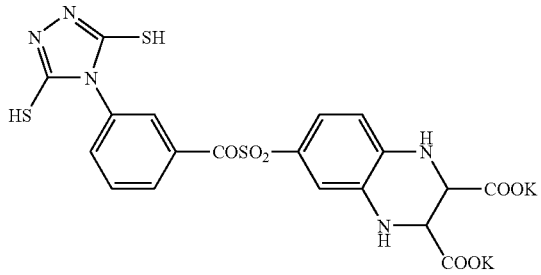

59

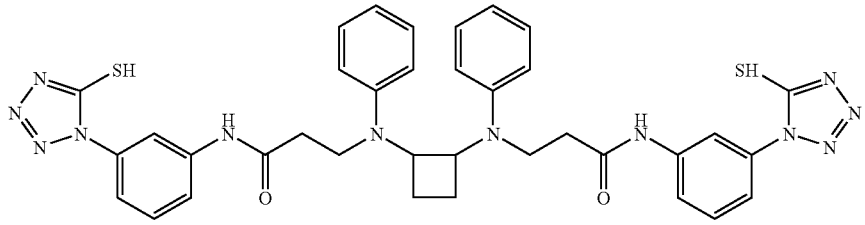

Type A-D compounds are the same as those detailed in JP-A Nos. 2003-114486, 2003-114487, 2003-140287, and 2003-75950. It is possible to list specific compounds described in these patent publications as specific examples of Type A-D compounds of the present invention. Synthetic examples of Type A-D compounds of the present invention are the same as those described in the above patents.

Types A-D compounds may be employed in any stage during the emulsion preparation process or the production process of a heat developable light-sensitive material, such as during particle formation, the desalting process, and chemical sensitization or prior to coating. Further, during these processes, addition may be performed over a plurality of times. Addition periods are preferably during the period after its completion of particle formation and prior to the desalting process, during chemical ripening (a period prior to initiation of chemical sensitization and immediately after its completion, and prior to coating and more preferably during chemical sensitization and prior to coating.

It is preferable that Type A-D compounds are dissolved in water, in water-soluble solvents such as methanol or ethanol, or in mixed solvents thereof, and subsequently added. In the case of dissolution in water, in regard to compounds which exhibit higher solubility by increasing or decreasing the pH, they may be dissolved in water by increasing or decreasing the pH and then added.

It is preferable that Type A-D compounds are employed in a light-sensitive layer. However, they may be added to a protective layer and/or to an interlayer in addition to the light-sensitive layer, to allow them to diffuse during coating. Type A-D compounds may be added prior to or after the addition of sensitizing dyes. The addition amount of each of them in a silver halide emulsion layer is preferably $1\times10^{-9}$-$5\times10^{-2}$ mol per mol of silver halide, and is more preferably $1\times10^{-8}$-$2\times10^{-3}$ mol.

The light-sensitive silver halide, light-insensitive aliphatic carboxylic acid silver, various additives such as crosslinking agents, coating techniques, and exposure and development conditions employed in the silver salt photothermographic dry imaging materials of the present invention will now be individually described.

<Silver Halide Grains of Internal Latent Formation after Thermal Development>

The photosensitive silver halide grains according to the present invention are characterized in that they have a property to change from a surface latent image formation type to an internal latent image formation type after subjected to thermal development. This change is caused by decreasing the speed of the surface latent image formation by the effect of thermal development.

When the silver halide grains are exposed to light prior to thermal development, latent images capable of functioning as a catalyst of development reaction are formed on the surface of the aforesaid silver halide grains. "Thermal development" is a reduction reaction by a reducing agent for silver ions. On the other hand, when exposed to light after the thermal development process, latent images are more formed in the interior of the silver halide grains than the surface thereof. As a result, the silver halide grains result in retardation of latent image formation on the surface.

It was not known to use the silver halide grains which changes the latent image formation mechanism before and after thermal development in the photothermographic material.

Generally, when photosensitive silver halide grains are exposed to light, silver halide grains themselves or spectral sensitizing dyes, which are adsorbed on the surface of photosensitive silver halide grains, are subjected to photoexcitation to generate free electrons. Generated electrons are competitively trapped by electron traps (sensitivity centers) on the surface or interior of silver halide grains. Accordingly, when chemical sensitization centers (chemical sensitization specks) and dopants, which are useful as an electron trap, are much more located on the surface of the silver halide grains than the interior thereof and the number is appropriate, latent images are dominantly formed on the surface, whereby the resulting silver halide grains become developable. Contrary to this, when chemical sensitization centers (chemical sensitization specks) and dopants, which are useful as an electron trap, are much more located in the interior of the silver halide grains than the surface thereof and the number is appropriate, latent images are dominantly formed in the interior, whereby it becomes difficult to develop the resulting silver halide grains. In other words, in the former, the surface speed is higher than interior speed, while in the latter, the surface speed is lower than the interior speed. The former type of latent image is called "a surface latent image", and the latter is called "an internal latent image". Examples of the references are:

(1) T. H. James ed., "The Theory of the Photographic Process" 4$^{th}$ edition, Macmillan Publishing Co., Ltd. 1977; and (2) Japan Photographic Society, "Shashin Kogaku no Kiso" (Basics of Photographic Engineering), Corona Publishing Co. Ltd., 1998.

The photothermographic material containing the photosensitive silver halide grains of the present invention can extremely improve the light stability of the image after development.

The light-sensitive silver halide of the present invention is composed of silver halide grains which have undergone chemical sensitization (which refers to an internal electron trapping dopant after thermal development) due to reduction sensitization, chalcogen sensitization, or noble metal sensitization). It is particularly preferable that the core portion of silver halide grains undergoes chemical sensitization. The portion of grains, as described in the present invention, refers to a portion having a silver weight ratio of 0-50 mol percent in a single grain. The above ratio is preferably 10-35 mol percent. Employed as specific compounds employed for reduction sensitization may be, other than ascorbic acid and thiourea dioxide, for example, stannous chloride, aminoiminomethanesulfinic acid, hydrazine derivatives, boron compounds, silane compounds, and polyamine compounds. Further, it is possible to perform reduction sensitization by carrying out ripening while maintaining a pH during grain formation in the range of 6.6-9.5. In the present invention, the chalcogen sensitizers represented by Generals Formulas (C-1) and (C-2) below are preferred. When the core portion of the grains of the present invention is grown, the pH is maintained in the range of 6.0-10.5. It is preferable that chemical sensitization is performed in the range 7.0-9.0. Since it is possible for the compounds represented by General Formulas (C-1) and (C-2) to control sensitization effects depending on the pH, the formation of large fog specks on the surface of silver halide grains are retarded.

General Formula (C-1)

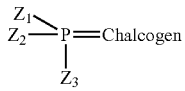

General Formula (C-2)

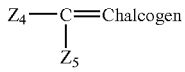

In General Formula (C-1), $Z_1$, $Z_2$, and $Z_3$ may be the same or different, and each-represents an aliphatic group, an aromatic group, a heterocyclyl group, —$OR_7$, —$NR_8(R_9)$, —$SR_{10}$, —$SeR_{11}$, a halogen atom, and a hydrogen atom. $R_7$, $R_{10}$, and $R_{11}$ each represent an aliphatic group, an aromatic group, a heterocyclyl group, a hydrogen atom, or a cation, while $R_8$ and $R_9$ each represent an aliphatic group, an aromatic group, a heterocyclyl group, or a hydrogen atom. Further, pairs $Z_1$ and $Z_2$, $Z_2$ and $Z_3$, or $Z_3$ and $Z_1$ may form a ring. Chalcogen represents selenium or tellurium.

In General Formula (C-2), $Z_4$ and $Z_5$ may be the same or different, and each represents an alkyl group, an alkenyl group, an aralkyl group, an aryl group, a heterocyclyl group, —$NR_1(R_2)$, —$OR_3$, or —$SR_4$. $R_1$, $R_2$, $R_3$, and $R_4$ are the same or different, and each represent an alkyl group, an aralkyl group, an aryl group, or a heterocyclyl group. However, $R_1$ and $R_2$ may be hydrogen atoms and acyl groups. Further, $Z_4$ and $Z_5$ may form a ring. Chalcogen represents sulfur, selenium, or tellurium. Specific examples of the compounds represented by General Formulas (C-1) and (C-2) are listed below.

1

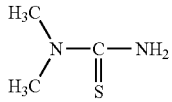

2

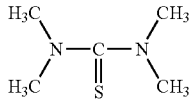

3

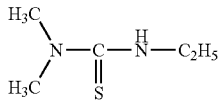

4

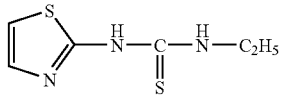

5

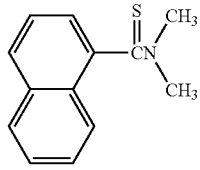

-continued
6
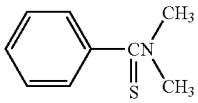
7
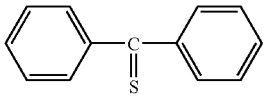
8
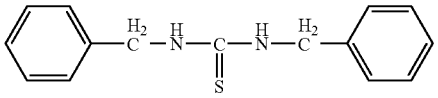
9
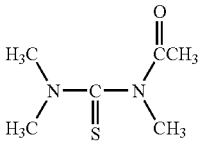
10
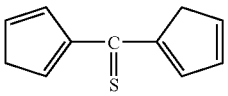
11
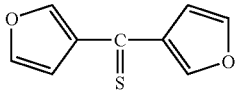
12
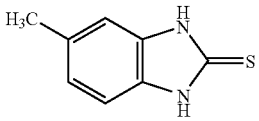
13
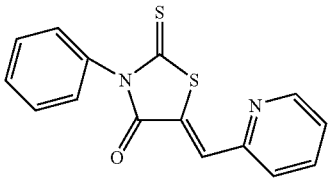
14
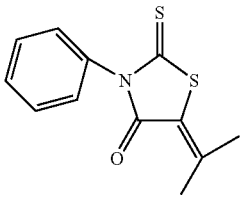
15
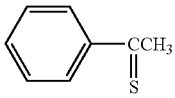
16
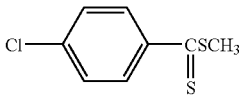
-continued
17
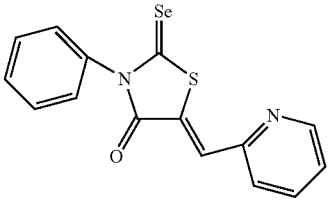
18
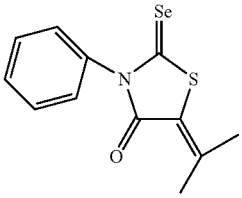
19
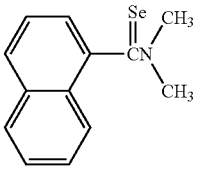
20
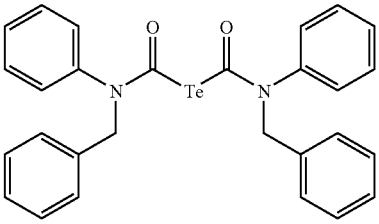
21
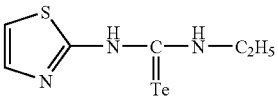
22
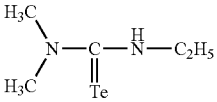
23
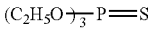
24
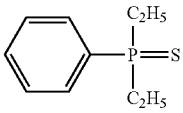
25
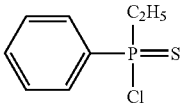
26
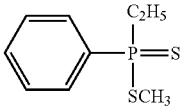
27
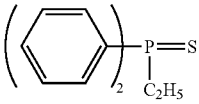

-continued

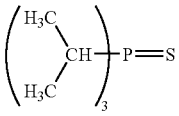

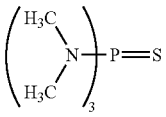

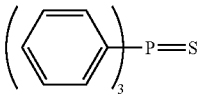

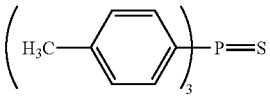

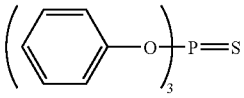

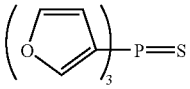

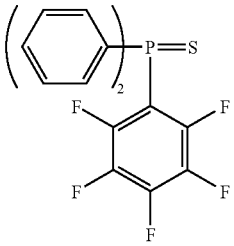

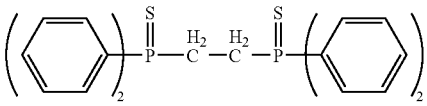

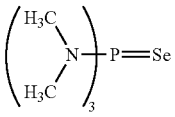

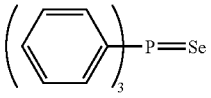

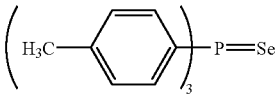

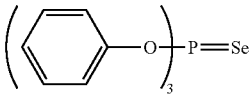

-continued

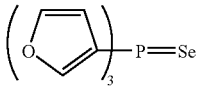

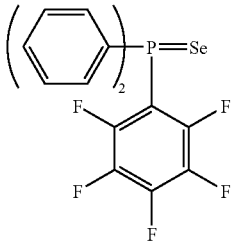

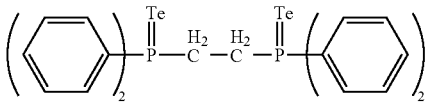

It may be added a thiosulfonic acid compound to the silver halide emulsion used in the present invention. The addition method is referred to EP 293917.

The photosensitive silver halide grains of the present invention are preferably provided with dopants which act as electron trapping in the interior of silver halide grains at least in a stage of exposure to light after thermal development. This is required so as to achieve high photographic speed grains as well as high image keeping properties.

It is especially preferred that the dopants act as a hole trap during an exposure step prior to thermal development, and the dopants change after a thermal development step resulting in functioning as an electron trap.

Electron trapping dopants, as described herein, refer to silver, elements except for halogen or compounds constituting silver halide, and the aforesaid dopants themselves which exhibit properties capable of trapping free electron, or the aforesaid dopants are incorporated in the interior of silver halide grains to generate electron trapping portions such as lattice defects. For example, listed are metal ions other than silver ions or salts or complexes thereof, chalcogen (such as elements of oxygen family) sulfur, selenium, or tellurium, inorganic or organic compounds comprising nitrogen atoms, and rare earth element ions or complexes thereof.

Listed as metal ions, or salts or complexes thereof may be lead ions, bismuth ions, and gold ions, or lead bromide, lead carbonate, lead sulfate, bismuth nitrate, bismuth chloride, bismuth trichloride, bismuth carbonate, sodium bismuthate, chloroauric acid, lead acetate, lead stearate, and bismuth acetate.

Employed as compounds comprising chalcogen such as sulfur, selenium, and tellurium may be various chalcogen releasing compounds which are generally-known as chalcogen sensitizers in the photographic industry. Further, preferred as organic compounds comprising chalcogen or nitrogen are heterocyclic compounds which include, for example, imidazole, pyrazole, pyridine, pyrimidine, pyrazine, pyridazine, triazole, triazine, indole, indazole, purine, thiazole, oxadiazole, quinoline, phthalazine, naphthylizine, quinoxaline, quinazoline, cinnoline, pteridine, acrydine, phenanthroline, phenazine, tetrazole, thiazole, oxazole, benzimidazole, benzoxazole, benzothiazole, indolenine, and tetraazaindene. Of these, preferred are imidazole, pyrazine, pyrimidine, pyrazine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzothiazole, and tetraazaindene.

Incidentally, the aforesaid heterocyclic compounds may have substituent(s). Preferable substituents include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, a phosphoric acid amide group, a halogen atom, a cyano group, a sulfo group, a carboxyl group, a nitro group, a heterocyclic group. Of these, more preferred are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amido group, a halogen atom, a cyano group, a nitro group, and a heterocyclic group. More preferred are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group, and a heterocyclic group.

Incidentally, ions of transition metals which belong to Groups 6 through 11 in the Periodic Table may be chemically modified to form a complex employing ligands of the oxidation state of the ions and incorporated in silver halide grains employed in the present invention so as to function as an electron trapping dopant, as described above, or as a hole trapping dopant. Preferred as aforesaid transition metals are W, Fe, Co, Ni, Cu, Ru, Rh, Pd, Re, Os, Ir, and Pt.

In the present invention, aforesaid various types of dopants may be employed individually or in combination of at least two of the same or different types. It is required that at least one of the dopants act as an electron trapping dopant during an exposure time after being thermal developed. They may be incorporated in the interior of the silver halide grains in any forms of chemical states.

It is not recommended to use a complex or a salt of Ir or Cu as a single dopant without combining with other dopant.

The content ratio of dopants is preferably in the range of $1\times10^{-9}$ to $1\times10$ mol per mol of silver, and is more preferably $1\times10^{-6}$ to $1\times10^{-2}$ mol.

However, the optimal amount varies depending the types of dopants, the diameter and shape of silver halide grains, and ambient conditions. Accordingly, it is preferable that addition conditions are optimized taking into account these conditions.

In the present invention, preferred as transition metal complexes or complex ions are those represented by the general formula described below.

General Formula: $[ML_6]^m$ wherein M represents a transition metal selected from the elements of Groups 6 through 11 in the Periodic Table; L represents a ligand; and m represents 0, -, 2-, 3-, or 4-. Listed as specific examples of ligands represented by L are a halogen ion (a fluoride ion, a chloride ion, a bromide ion, or an iodide ion), a cyanide, a cyanate, a thiocyanate, a selenocyanate, a tellurocyanate, an azide, and an aqua ligand, and nitrosyl and thionitrosyl. Of these, aqua, nitrosyl, and thionitrosyl are preferred. When the aqua ligand is present, one or two ligands are preferably occupied by the aqua ligand. L may be the same or different.

It is preferable that compounds, which provide ions of these metals or complex ions, are added during formation of silver halide grains so as to be incorporated in the silver halide grains. The compounds may be added at any stage of, prior to or after, silver halide grain preparation, namely nuclei formation, grain growth, physical ripening or chemical ripening. However, they are preferably added at the stage of nuclei formation, grain growth, physical ripening, are more preferably added at the stage of nuclei formation and growth, and are most preferably added at the stage of nuclei formation. They may be added over several times upon dividing them into several portions. Further, they may be uniformly incorporated in the interior of silver halide grains. Still further, as described in JP-A Nos. 63-29603, 2-306236, 3-167545, 4-76534, 6-110146, and 5-273683, they may be incorporated so as to result in a desired distribution in the interior of the grains.

These metal compounds may be dissolved in water or suitable organic solvents (for example, alcohols, ethers, glycols, ketones, esters, and amides) and then added. Further, addition methods include, for example, a method in which either an aqueous solution of metal compound powder or an aqueous solution prepared by dissolving metal compounds together with NaCl and KCl is added to a water-soluble halide solution, a method in which silver halide grains are formed by a silver salt solution, and a halide solution together with a the compound solution as a third aqueous solution employing a triple-jet precipitation method, a method in which, during grain formation, an aqueous metal compound solution in a necessary amount is charged into a reaction vessel, or a method in which, during preparation of silver halide, other silver halide grains which have been doped with metal ions or complex ions are added and dissolved. Specifically, a method is preferred in which either an aqueous solution of metal compound powder or an aqueous solution prepared by dissolving metal compounds together with NaCl and KCl is added to a water-soluble halide solution. When added onto the grain surface, an aqueous metal compound solution in a necessary amount may be added to a reaction vessel immediately after grain formation, during or after physical ripening, or during chemical ripening.

Incidentally, it is possible to introduce non-metallic dopants into the interior of silver halide employing the same method as the metallic dopants.

In the imaging materials in accordance with the present invention, it is possible to evaluate whether the aforesaid dopants exhibit electron trapping properties or not, while employing a method which has commonly employed in the photographic industry. Namely a silver halide emulsion comprised of silver halide grains, which have been doped with the aforesaid dopant or decomposition product thereof so as to be introduced into the interior of grains, is subjected to photoconduction measurement, employing a microwave photoconduction measurement method. Subsequently, it is possible to evaluate the aforesaid electron trapping properties by comparing the resulting decrease in photoconduction to that of the silver halide emulsion comprising no dopant as a standard. It is also possible to evaluate the same by performing experiments in which the internal speed of the aforesaid silver halide grains is compared to the surface speed.

Further, a method follows which is applied to a finished photothermographic dry imaging material to evaluate the electron trapping dopant effect in accordance with the present invention. For example, prior to exposure, the aforesaid imaging material is heated under the same conditions as the commonly employed thermal development conditions. Subsequently, the resulting material is exposed to white light or infrared radiation through an optical wedge for a definite time (for example, 30 seconds), and thermally developed under the same thermal development conations as above, whereby a characteristic curve (or a densitometry curve) is obtained. Then, it is possible to evaluate the aforesaid electron trapping dopant effect by comparing the speed obtained based on the characteristic curve to that of the imaging material which is comprised of the silver halide emulsion which does not comprise the aforesaid electron trapping dopant. Namely, it is necessary to confirm that the speed of the former sample comprised of the silver halide grain emulsion comprising the dopant in accordance with the present invention is lower than the latter sample which does not comprise the aforesaid dopant.

Speed of the aforesaid material is obtained based on the characteristic curve which is obtained by exposing the aforesaid material to white light or infrared radiation through an optical wedge for a definite time (for example 30 seconds) followed by developing the resulting material under common thermal development conditions. Further, speed of the aforesaid material is obtained based on the characteristic curve which is obtained by heating the aforesaid material under common thermal development conditions prior to exposure and giving the same definite exposure as above to the resulting material for the same definite time as above followed by thermally developing the resulting material under common thermal development conditions. The ratio of the latter speed to the former speed is preferably at most 1/10, and is more preferably at most 1/20. When the silver halide emulsion is chemically sensitized, the preferred photographic speed is as low as not more than 1/50.

Cited as shapes of silver halide grains may be cubic, octahedral grains, planar grains, spherical grains, rod-shaped grains, and roughly elliptical-shaped grains. Of these, cubic, and planar silver halide grains are particularly preferred.

It is preferred an average circle equivalent diameter of the photosensitive silver halide grains is small in order to prevent white turbidity after image formation. Specifically, it is preferred to be 10-100 nm. "An equivalent diameter" is defined as a diameter of a circle which has the same area of the projected main plane of a planar grain measured with an electron microscope.

When the aforesaid planar silver halide grains are employed, their average aspect ratio is preferably 100:1 to 2:1, and is more preferably 50:1 to 3:1. Further, it is possible to preferably employ silver halide grains having rounded corners.

The crystal habit of the external surface of silver halide grains is not particularly limited. However, when spectral sensitizing dyes, which exhibit crystal habit (surface) selectiveness are employed, it is preferable that silver halide grains are employed which have the crystal habit matching their selectiveness in a relatively high ratio. For example, when sensitizing dyes, which are selectively adsorbed onto a crystal plane having a Miller index of (100), it is preferable that the ratio of the (100) surface on the external surface of silver halide grains is high. The ratio is preferably at least 50 percent, is more preferably at least 65 percent, and is most preferably at least 80 percent. Incidentally, it is possible to obtain a ratio of the surface having a Miller index of (100), based on T. Tani, J. Imaging Sci., 29, 165 (1985), utilizing adsorption dependence of sensitizing dye in a (111) plane as well as a (100) surface.

In the silver salt photothermographic dry imaging materials of the present invention, silver halide emulsions may be used individually or in combinations at least two types (for example, those which differ in average grain size, halogen composition, or crystal habit.

The used amount of light-sensitive silver halide is commonly 0.01-0.5 mol per mol of aliphatic carboxylic acid silver, is more preferably 0.02-0.3 mol, and is most preferably 0.03-0.25 mol. In regard to mixing methods and mixing conditions of separately prepared light-sensitive silver halide and aliphatic carboxylic acid silver, the methods include one in which separately prepared silver halide grains and aliphatic carboxylic acid silver are mixed employing a high speed stirrer, a ball mill, a sand mill, a colloid mill, a vibration mill, or a homogenizer and the other method in which aliphatic carboxylic acid silver is prepared by mixing prepared light-sensitive silver halide at any timing during preparation of axiomatic carboxylic acid silver. However, methods are not particular limited as long as at least the effects of the present invention are sufficiently exhibited.

Typically, silver halide emulsions are prepared in such a manner that in a protective colloid (hydrophilic colloid such as gelatin is employed) used as a reaction host solution, an aqueous silver salt solution and an aqueous halide solution are mixed and nuclei are formed followed by crystal growth. Commonly employed as addition methods of an aqueous halide solution and an aqueous silver salt solution are double-jet methods. Of these, a controlled double-jet method is representative in which while controlling pAg and pH, each component is mixed and the above-mentioned nuclei formation and crystal growth are achieved. Further, the method includes various ones in which preparation is performed employing two stages in which initially, seed particles are formed (nuclei formation), and thereafter, crystal growth or ripening is performed under the same or other conditions. The point is that a person skilled in the art knows that during the mixing process of the aqueous protective colloid solution, by specifying the mixing conditions of the aqueous silver salt solution and the aqueous halide solution, crystal habit and size are desirably controlled. After these mixing processes, a desalting process is performed in which excessive salts are removed from the prepared emulsion. Well known as a desalting process is a flocculation method in which flocculants are added to the prepared silver halide emulsion and silver halide is flocculated together with gelatin as a protective colloid, and subsequently, the resultant flocculates are separated from the supernatant containing salts. The supernatant is removed by decantation. Further, in order to remove excessive salts contained in the resultant gelatin flocculates containing silver halide grains, dissolution, flocculation and decantation are repeated. Further, a method is known in which soluble salts are removed employing an ultrafiltration method. In this method, by employing a synthetic ultrafiltration membrane which does not allow passage of relatively large size particles and large molecular weight molecules such as silver halide grains or gelatin, whereby unnecessary low molecular weight salts are removed.

It is possible to apply chemical sensitization to the surface of grains of light-sensitive silver halide prepared employing the various methods described above. It is also possible to perform chemical sensitization employing, for example, sulfur containing compounds, gold compounds, platinum compounds, palladium compounds, silver compounds, tin compounds, and chromium compounds, and combinations thereof. Methods and procedures of the above chemical sensitization are described, for example, in U.S. Pat. No.

4,036,650, British Patent No. 1,518,850, and JP-A Nos. 51-22430, 51-78310, and 51-81124. Further, in the course of converting some part of aliphatic carboxylic silver to light-sensitive silver halide employing silver halide forming components, as described in U.S. Pat. No. 3,980,482, in order to achieve sensitization, low molecular weight amide compounds may be simultaneously employed.

The light-sensitive silver halide grains of the present invention may be added to a light-sensitive layer employing any available method. At that time, it is preferable that the silver halide grains are situated adjacent to reducible silver sources.

The silver halide of the present invention is previously prepared and the resulting silver halide is added to a solution which is employed to prepare aliphatic carboxylic acid silver salt particles. By so doing, since a silver halide preparation process and an aliphatic carboxylic acid silver salt particle preparation process are performed independently, production is preferably controlled. Further, as described in British Patent No. 1,447,454, when aliphatic carboxylic acid silver salt particles are formed, it is possible to almost simultaneously form aliphatic carboxylic acid silver salt particles by charging silver ions to a mixture consisting of halide components such as halide ions and aliphatic carboxylic acid silver salt particle forming components. Still further, it is possible to prepare silver halide grains utilizing conversion of aliphatic carboxylic acid silver salts by allowing halogen-containing components to act on aliphatic carboxylic acid silver salts. Namely, it is possible to convert some of aliphatic carboxylic acid silver salts to photosensitive silver halide by allowing silver halide forming components to act on the previously prepared aliphatic carboxylic acid silver salt solution or dispersion, or sheet materials comprising aliphatic carboxylic acid silver salts.

Silver halide grain forming components include inorganic halogen compounds, onium halides, halogenated hydrocarbons, N-halogen compounds, and other halogen containing compounds.

Specific examples are disclosed in; U.S. Pat. Nos. 4,009,039, 3,4757,075, 4,003,749; G.B.Pat.No. 1,498,956; and JP-A Nos. 53-27027, 53-25420.

Further, silver halide grains may be employed in combination which are produced by converting some part of separately prepared aliphatic carboxylic acid silver salts.

The aforesaid silver halide grains, which include separately prepared silver halide grains and silver halide grains prepared by partial conversion of aliphatic carboxylic acid silver salts, are employed commonly in an amount of 0.001 to 0.7 mol per mol of aliphatic carboxylic acid silver salts and preferably in an amount of 0.03 to 0.5 mol.

The separately prepared photosensitive silver halide particles are subjected to desalting employing desalting methods known in the photographic art, such as a noodle method, a flocculation method, an ultrafiltration method, and an electrophoresis-method, while they may be employed without desalting.

<Light-Insensitive Aliphatic Carboxylic Acid Silver Salt>

The light-insensitive aliphatic carboxylic acid silver salts according to the present invention are reducible silver sources which are preferably silver salts of long chain aliphatic carboxylic acids, having from 10 to 30 carbon atoms and preferably from 15 to 25 carbon atoms. Listed as examples of appropriate silver salts are those described below.

For example, listed are silver salts of gallic acid, oxalic acid, behenic acid, stearic acid, arachidic acid, palmitic acid, and lauric acid. Of these, listed as preferable silver salts are silver behenate, silver arachidate, and silver stearate.

Further, in the present invention, it is preferable that at least two types of aliphatic carboxylic acid silver salts are mixed since the resulting developability is enhanced and high contrast silver images are formed. Preparation is preferably carried out, for example, by mixing a mixture consisting of at least two types of aliphatic carboxylic acid with a silver ion solution.

On the other hand, from the viewpoint of enhancing retaining properties of images, the melting point of aliphatic carboxylic acids, which are employed as a raw material of aliphatic carboxylic acid silver, is commonly at least 50° C., and is preferably at least 60° C. The content ratio of aliphatic carboxylic acid silver salts is commonly at least 60 percent, is preferably at least 70 percent, and still more preferably at least 80 percent. From this viewpoint, specifically, it is preferable that the content ratio of silver behenate is higher.

Aliphatic carboxylic acid silver salts are prepared by mixing water-soluble silver compounds with compounds which form complexes with silver. When mixed, a normal precipitation method, a reverse precipitating method, a double-jet precipitation method, or a controlled double-jet precipitation method, described in JP-A No. 9-127643, are preferably employed. For example, after preparing a metal salt soap (for example, sodium behenate and sodium arachidate) by adding alkali metal salts (for example, sodium hydroxide and potassium hydroxide) to organic acids, crystals of aliphatic carboxylic acid silver salts are prepared by mixing the soap with silver nitrate. In such a case, silver halide grains may be mixed together with them.

The kinds of alkaline metal salts employed in the present invention include sodium hydroxide, potassium hydroxide, and lithium hydroxide, and it is preferable to simultaneously use sodium hydroxide and potassium hydroxide. When simultaneously employed, the mol ratio of sodium hydroxide to potassium hydroxide is preferably in the range of 10:90-75:25. When the alkali metal salt of aliphatic carboxylic acid is formed via a reaction with an aliphatic carboxylic acid, it is possible to control the viscosity of the resulting liquid reaction composition within the desired range.

Further, in the case in which aliphatic carboxylic acid silver is prepared in the presence of silver halide grains at an average grain diameter of at most 0.050 μm, it is preferable that the ratio of potassium among alkaline metals in alkaline metal salts is higher than the others, since dissolution of silver halide grains as well as Ostwald ripening is retarded. Further, as the ratio of potassium salts increases, it is possible to decrease the size of fatty acid silver salt particles. The ratio of potassium salts is preferably 50-100 percent with respect to the total alkaline metal salts, while the concentration of alkaline metal salts is preferably 0.1-0.3 mol/1,000 ml.

<Binder>

Suitable binders for the silver salt photothermographic material of the present invention are to be transparent or translucent and commonly colorless, and include natural polymers, synthetic resin polymers and copolymers, as well as media to form film. The binders include, for example, gelatin, gum Arabic, casein, starch, poly(acrylic acid), poly(methacrylic acid), poly(vinyl chloride), poly(methacrylic acid), copoly(styrene-maleic anhydride), copoly(styrene-acrylonitrile), copoly(styrene-butadiene), poly(vinyl acetals) (for example, poly(vinyl formal) and poly(vinyl butyral), poly(esters), poly(urethanes), phenoxy resins, poly(vinylidene chloride), poly(epoxides), poly(carbonates), poly (vinyl acetate), cellulose esters, poly(amides).

Generally, a single photothermographic silver halide or a plurality of photothermographic silver halides is provided in the form of a hydrophilic light-sensitive silver halide emulsion containing at least one peptizer (for example, gelatin). The typical concentration of silver halide in formulated components to be coated is 0.01-1 mol of light-sensitive silver halide per mol of the light-insensitive reducible silver ion sources.

It is possible to produce hydrophilic silver halide emulsions containing peptizers, employing conventional methods in photographic technical fields, including those described in Product Licensing Index, Volume 92, December 1971. The above photographic silver halide which may be washed or unwashed, as described, may undergo chemical sensitization as described below. As used herein, a "hydrophilic light-sensitive silver halide emulsion" refers to one which contains water-soluble solvents as well at least one peptizer.

Useful peptizers are not particularly limited and include gelatin based peptizers such as phthalated gelatin and non-phthalated gelatin or hydrolyzed gelatin employing an acid or base, and poly(vinyl alcohol), which are known as prior art in photographic technical fields. The particularly preferred peptizer is cationic starch which is described in U.S. Pat. No. 5,604,085 (Maskasky), U.S. Pat. No. 5,620,840 (Maskasky), U.S. Pat. No. 5,667,955 (Maskasky), and U.S. Pat. No. 5,733,718 (Maskasky). Such peptizers definitely decrease fogging and improve storage stability of unexposed film.

The amount of peptizers in the hydrophilic silver halide emulsion is commonly 5-40 g per mol of silver. The particularly effective concentration of peptizers is 9-15 g per mol of silver.

Further, it is preferable that hydrophilic binders are present in the formulated components of silver halide or its emulsion. Useful binders including binders which are employed to produce photographic silver halide emulsions may be the same or different from the above peptizers. Various types of gelatin, polyacrylamides, polymethacrylates, poly(vinyl alcohols), and various types of starch are preferred. Poly(vinyl alcohols) are more preferred for the water based silver halide emulsions.

Preferable binders for the photosensitive layer of the silver salt photothermographic dry imaging material of the present invention are poly(vinyl acetals), and a particularly preferable binder is poly(vinyl butyral), which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/m$^2$, and is more preferably from 1.7 to 5 g/m$^2$. When the binder amount is less than 1.5 g/m$^2$, density of the unexposed portion markedly increases, whereby it occasionally becomes impossible to use the resultant material.

Employed as cross-linking agents used in the present invention may be various conventional cross-linking agents, which are described in JP-A No. 50-96216 and have been employed for silver halide photosensitive photographic materials. Examples are, an aldehyde based, epoxy based, ethyleneimine based, vinylsulfone based sulfonic acid ester based, acryloyl based, carbodiimide based, and silane compound based cross-linking agents, Of these, preferred are isocyanate based compounds, silane compounds, epoxy compounds or acid anhydrides, which are disclosed in JP-A No. 2001-249728.

In this present invention, it is preferable that matting agents are incorporated on the light-sensitive layer side. In order to minimize abrasion on images after heat development, it is preferable to apply matting agents onto the surface of photothermographic materials. The content ratio of the above matting agents is preferably 0.5-10 percent by weight with respect to the total binders on the light-sensitive layer side. Materials of the matting agents employed in the present invention may be either organic or inorganic. Employed as inorganic matting agents may be silica described in Swiss Patent No. 330,158, glass powder described in French Patent No. 1,296,995, carbonates of alkaline earth metals, cadmium, or zinc described in British Patent No. 1,173,181. On the hand, employed as organic matting agents may be starch described in U.S. Pat. No. 2,322,037, starch derivatives described in Belgium Patent No. 625,451 and British Patent No. 981,198, polyvinyl alcohol described in Japanese Patent Publication No. 44-3643, polystyrene or polymethacrylate described in Swiss Patent No. 330,158, polyacrylonitrile described in U.S. Pat. No. 3,079,257, and polycarbonate described in U.S. Pat. No. 3,022,169.

The shape of matting agent particles may be either regular or irregular. However, a regular shape, or particularly a spherical shape is preferably employed. The size of matting agent particles is represented by the diameter of a sphere which has the same volume as that of a matting agent particle. The particle diameter of matting agents, as described in the present invention refers to an equivalent spherical diameter. The average particle diameter of the matting agents in the present invention is preferably 0.5-10 μm, and is more preferably 1.0-8.0 μm. Further, the variation coefficient of the particle size distribution is preferably at most 50 percent, is more preferably at most 40 percent, and is most preferably at most 30 percent. The variation coefficient of a particle size distribution, as described herein, is represented by the same formula as for silver salt particles. Matting agents may be incorporated in any constituting layers, but are preferably incorporated in constituting layers other than the light-sensitive layers, and are more preferably incorporated in the outermost layer from the support. Addition methods of matting agents may include a method in which matting agents are dispersed in a liquid coating composition and then coated, or a method in which matting argents are sprayed onto a coating during the period after coating the liquid coating composition but before completion of drying. Further, in the case in which a plurality of various types of matting agents are added, both above methods may be simultaneously used.

It is also preferable to add toners to the silver salt photothermographic dry imaging materials of the present invention. Appropriate toners are disclosed in RD 17020. Specifically, it is possible to list the following:

It is possible to list imides (phthalimide); cyclic imides, pyrazoline-5-ones and quinazolines (succinimide, 3-penyl-2-pyrazoline-5-one, 1-phenylurazole, quinazoline, and 2,4-thiazolidinedione); naphthalimides (N-hydroxy-1,8-naphthalimides); cobalt complexes (cobalt hexaminetrifluoroacetate); mercaptans (3-mercapto-1,2,4-triazole); N-(aminomethyl)aryldicarboxyimides (N-(dimethylaminomethyl)phthalimide); blocked pyrazoles, isothiuronium derivatives and combinations with a certain type of light bleaching agent (being a combination of N,N'-hexamethylene(1-carbamoyl-3,5-dimethylpyrazole), 1,8-(3,6-dioxaoctane)bis(isothuroniumtrifluoroacetate) and 2-(tribromomethylsulfonyl)benzothiazole; merocyanine dyes (3-ethyl-5-((3-ethyl-2-benzothiazolinylidene(benzothiazolinylidene))-1-methylethynylidene-2-tio-2,4-oxazolidinedione); phthalazinone, phthalazinone derivatives or metals salts of these derivatives (4-(1-naphthyl)phthalazinone, 6-chlorophthalazinone, 5,7-dimethyloxyphthalazinone, and 2,3-dihydro-1,4-phthalazinedione); combinations of phthalazinone and sulfinic acid derivatives (6-chlorophthalazinone and sodium benzenesulfonate or 8-methylphthalazinone and sodium p-trisulfonate); combinations of phthalazine and phthalic acid; combinations of phthalazine (including phthalazine addition products) with at least one-compound selected from maleic anhydride, phthalic acid, 2,3-naphthalenedicaboxylic acid, or o-phenylenic acid derivatives and anhydrides thereof (phthalic acid, 4-methylnaphthalic acid, 4-nitrophthalic acid and tetrachlorophthalic anhydride); quinazolidiones; benzoxazine, narutoxazine derivatives; benzoxazines and asymmetry-triazines (2,4-dihydroxypyrimidine), and tetraazapentalene derivatives (3,6-dimercapto-1,4-diphenyl-1H,4H,-2,3a,5,6a-tetraazapentalene). Of these, particularly preferred toners are phthalazone or phthalazine.

The silver salt photothermographic dry imaging material of the present invention incorporates a support having thereon at least one light-sensitive layer. Only the light-sensitive layer may be formed on the support. However, it is preferable to form at least one light-insensitive layer on the light-sensitive layer. In order to control the amount or the wavelength distribution of the light which is transmitted through the light-sensitive layer, a filter layer may be formed on the side of the light-sensitive layer or on the opposite side. Alternatively, dyes according to the present invention, as well as prior art pigments, may directly be incorporated in the light-sensitive layer. The light-sensitive layer may be composed of a plurality of layers, and for controlling gradation, may be composed of layers differing in photographic speed, such as a high photographic speed layer/a low photographic speed layer or a low photographic speed layer/a high-photographic speed layer.

Various types of additives may be added to any of the light-sensitive layer, the light-insensitive layer, or other formed layers. In the photographic materials of the present invention, for example, employed may be surface active agents, antioxidants, stabilizers, plasticizers, UV absorbers and covering aids.

It is preferable that the silver salt photothermographic dry imaging materials of the present invention are formed in such a manner that liquid coating compositions are formed by dissolving or dispersing the above components of each layer in solvents, and after performing simultaneous multilayer coating of these liquid coating compositions onto a support, a heating process is performed. Simultaneous multilayer coating, as described herein, means that it is possible to form each of the constituting layers in such a state that multilayer coating is simultaneously performed and the drying process is also simultaneously performed instead of a state in which the liquid coating composition of each constituting layer (for example, a light-sensitive layer or a protective layer) is prepared, and coating and drying of each layer liquid coating composition is repeated. Namely, an upper layer is provided before the residual amount of the total solvents in the lower layer reaches 70 percent by weight.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The aforesaid extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

(Surface Layer)

In heat developable light-sensitive materials used in the present invention, the value of Rz(E)/Rz(B) is preferably 0.10-0.70, is more preferably 0.10-0.60, and is most preferably 0.10-0.50, where Rz(E) represents the 10-point average roughness of the outermost surface on image forming layer side on the support, and Rz(B) represents the 10-point average roughness of the outermost surface on the side opposite the image forming layer on the support. By controlling the value of Rz(E)/Rz(B) to be in the above range, it is possible to further minimize uneven density during thermal development. Further, Lb/Le is preferably 2.0-10, and is more preferably 2.5-6.0 where Le represents the average particle diameter (in μm) of the matting agent having the maximum average particle diameter of the matting agents incorporated in the layer on the side having the image forming layer, and Lb represents the average particle diameter (in μm) of the matting agent having the maximum average particle diameter of the matting agents incorporated in the layer on the side having the back coat layer. By controlling Lb/Le to be in the above range, it is possible to further minimize uneven density.

The above 10-point mean roughness (Rz) is defined based on JIS Surface Roughness (B 0601) described below. As used herein, ten-point mean roughness (Rz) refers to the difference in micrometer (μm) between the average of the peak height of the highest peak to the 5th highest peak and the average of the depth of the lowest valley to the 5th lowest valley, which are measured in the longitudinal multiplication direction from the straight line which is parallel to the mean line and does not cross the sectional curve in the part which is extracted only by the standard length from the sectional curve. The 10-point mean roughness (Rz) is determined as follows. Samples are humidified for 24 hours at 25° C. and 65 percent relative humidity under a no overlapping condition and subsequently measured in the same ambience. The no overlapping conditions, as described herein, refer to any of the methods in which winding is carried out in such a state the edges of a film are raised, in which film sheets are stacked while inserting a sheet of paper between them, or in which a frame is prepared employing a cardboard sheet and four corners are fixed. Listed as a usable measurement apparatus may be a RSTPLUS non-contact three dimensional minute surface state measuring system, produced by WYKO Co.

It is possible to easily control the 10-point mean roughness of the obverse and reverse surfaces of light-sensitive materials to be within the above range by controlling the types, average particle diameter, and added amount of employed matting agents, as well as dispersion conditions and drying conditions during coating. In the present invention, it is preferable to use organic or inorganic powders as a matting agent in the surface layer (on the image forming layer side, and in the case in which a light-insensitive layer is provided on the side opposite the image forming layer) to achieve the objects of the present invention and as well as to control the surface roughness. It is preferable to use powders at a Mohs hardness of at least 5. Further, when the 10-point mean roughness of the outermost surface on the image forming layer side on the support is represented by Rz(E), Rz(E) is preferably 1.0-4.0 μm, is more preferably 1.2-3.8 μm, and is most preferably 1.4-3.6 μm. By controlling Rz to be within the above range, it is possible to minimize uneven density during thermal development, and enhance tracking properties during thermal development as well as retard an increase in fog during development at high humidity.

As powders, prior art inorganic powders and organic powders are suitably selected and then employed. Listed as inorganic powders may be, for example, titanium oxide, boron nitride, $SnO_2$, $SiO_2$, $Cr_2O_3$, $\alpha$-$Al_2O_3$, $\alpha$-$Fe_2O_3$, $\alpha$-FeOOH, cerium oxide, corundum, artificial diamond, garnet, mica, silica, silicon nitride, and silicon carbide. Listed as organic powders may be powders of polymethyl methacrylate, polystyrene, and Teflon (registered trade name). Of these, preferred are inorganic powders of $SiO_2$, titanium oxide, barium sulfate, $\alpha$-$Al_2O_3$, $\alpha$-$Fe_2O_3$, $\alpha$-FeOOH, $Cr_2O_3$, and mica. Of these, $SiO_2$ and $\alpha$-$Al_2O_3$ are preferred and $SiO_2$ is particularly preferred.

In the present invention, it is preferable that the aforesaid powders are subjected to a surface treatment employing Si compounds or Al compounds. When the powders which have been subjected to such surface treatment are used, it is possible to improve the surface state of the uppermost layer. The content of the above Si and Al compounds is preferably 0.1-10 percent by weight with respect to the above powders, respectively. It is more preferable that the content of the Si compounds is 0.1-5 percent by weight, while the content of the Al compounds is 0.1-2 percent by weight. It is particularly preferable that the content of the Si compounds is 0.1-2 percent by weight, while the content of the Al compounds is 0.1-2 percent by weight. Further, it is preferable that the weight ratio of the Si compounds is more than that of the Al compounds. It is possible to perform the surface treatment employing the method described in JP-A No. 2-83219. Incidentally, the average particle diameter, as described in the present invention, refers to an average diameter for spherical powder particles, an average long axis length for needle-like powder particles, an average maximum diagonal length of the tabular surface for tabular powder particles. It is easily to obtain these diameters based on measurements employing an electron microscope.

The average particle diameter of the above organic or inorganic powders is preferably 0.5-10 μm, and is more preferably 1.0-8.0 μm.

The average particle diameter of the organic or inorganic powders incorporated in the outermost layer on the light-sensitive layer side is commonly 0.5-8.0 μm, is preferably 1.0-6.0 μm, and is more preferably 2.0-5.0 μm. The added amount is commonly 1.0-20 percent by weight with respect to the weight (including the weight of hardeners) of binders employed in the outermost layer, and is preferably 2.0-15 percent by weight, and is more preferably 3.0-10 percent by weight.

The average particle diameter of organic or inorganic powders incorporated in the outermost layer on the side opposite the light-sensitive layer side is commonly 2.0-15 μm, is preferably 3.0-12 μm, and is more preferably 4.0-10.0 μm. The added amount is commonly 0.2-10 percent by weight with respect to the weight (including the weight of hardeners) of binders employed in the outermost layer, and is preferably 0.4-7 percent by weight, and is more preferably 0.6-5 percent by weight.

Further, the variation coefficient of the particle size distribution of powders is preferably at most 50 percent, is more preferably at most 40 percent, and is most preferably at most 30 percent. The variation coefficient of the particle size distribution is the value represented by the formula below.

$$|(\text{standard deviation of particle diameter})/(\text{average value of particle diameter})|\times 100$$

Employed as addition methods of organic or inorganic powders may be one in which powders are previously dispersed into a liquid coating composition and coated, or the other in which after coating a liquid coating composition, organic or inorganic powders are sprayed onto the coating prior to completion of drying. Further, when a plurality of types of powders is added, both methods may be simultaneously used.

<Exposure Conditions>

When the silver salt photothermographic dry imaging material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, laser lights having 600-900 nm are preferably employed due to their high power, as well as ability to make photosensitive materials transparent.

In the present invention, it is preferable that exposure is carried out utilizing laser scanning. Employed as the exposure methods are various ones. For example, listed as a firstly preferable method is the method utilizing a laser scanning exposure apparatus in which the angle between the scanning surface of a photosensitive material and the scanning laser beam does not substantially become vertical.

"Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode.

The longitudinal multiple mode is achieved utilizing methods in which return light due to integrated wave is employed, or high frequency superposition is applied.

The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

Further, as the third method, it is also preferable that exposure is carried out utilizing laser scanning with two or more laser lights.

The image recording method utilizing such a plurality of laser beams is a technique used in an image writing device of laser printers as well as digital copiers in which in order to meet demands for higher resolution and higher speed printing, during a single scanning, images are written employing a plurality of lines. Such a method is known, for example, based on JP-A No. 60-166916. In this method, a laser beam emitted from a laser beam source unit is subjected to deflection scanning and images are formed on a photoreceptor via an fθ lens. Subsequently, in principle, this is the same laser scanning optical device as laser imagers.

In image formation on a photoreceptor employing a laser beam in the image writing device of laser printers and digital copiers, due to the use of writing images employing a plurality of lines during a single scanning, the subsequent laser beam forms an image while being shifted one line from the image forming position of the previous laser beam. In practice, two laser beams are adjacent to each other at a distance of an order of several 10 μm on the image forming surface in the secondary scanning direction in such a manner that at a printing density of 400 dpi (dpi means the number of dots per inch or 2.54 cm), the secondary scanning direction pitch of two beams is 63.5 μm and at 600 dpi, is 43.3 μm.

Differing from such a method in which in the secondary scanning direction, shifting equivalent to resolution is performed, in the present invention, it is also preferable that images are formed by focusing at least two laser beams on the exposed plane while varying the incident angle. In this case, it is preferable that the range is controlled to hold the relationship of $0.9\times E \leqq En\times N \leqq 1.1\times E$, wherein E represents the exposure energy on the exposure plane while writing is performed employing a common single laser beam (at a wavelength of λ nm), En represents the exposure energy when N laser beams used for exposure have the same wavelength (at a wavelength of λ nm) and also the same exposure energy. By doing so, energy on the exposure plane is assured. On the other hand, reflection of each of the laser beams on the light-sensitive layer decreases due to relatively low exposure energy of the laser beam, whereby formation of interference fringes is minimized.

Incidentally, in the foregoing, a plurality of laser beams of the same wavelength λ is employed. It is possible to use laser beams of differing wavelengths. In this case, it is preferable to control the range so that the following conditions are satisfied for λnm:

$$(\lambda-30)<\lambda 1, \lambda 2, \ldots \lambda n \leqq (\lambda+30)$$

Incidentally, in the recording methods of the aforesaid first, second and third embodiments, it is possible to suitably select any of the following lasers employed for scanning exposure, which are generally well known, while matching the use. The aforesaid lasers include solid lasers such as a ruby laser, a YAG laser, and a glass laser; gas lasers such as a HeNe laser, an Ar ion laser., a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm.

The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

<Development Conditions>

In the present invention, development conditions vary depending on employed devices and apparatuses, or means. Typically, an imagewise exposed silver salt photothermographic dry imaging material is heated at optimal high temperature. It is possible to develop a latent image formed by exposure by heating the material at relatively high temperature (for example, from about 80 to 150° C., more preferably from about 100 to 130° C.) for a sufficient period (commonly from about 5 second to about 20 seconds).

When heating temperature is less than or equal to 80° C., it is difficult to obtain sufficient image density within a relatively short period. On the other hand, at more than or equal to 150° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

(Thermal Processor)

The thermal processor, as described in the present invention, is composed of a film feeding section represented by a film tray, a laser image recording section, a heat development section, which supplies uniform and consistent heat onto the entire surface of heat developable materials, and a conveying section, from the film feeding section via the laser recording to discharging of the heat developable light-sensitive materials on which images have been formed by heat development to the exterior of the processor. The specific example of a thermal processor in such embodiments is shown in FIG. 1.

Thermal processor 100 is composed of feeding section 110 which feeds sheets one by one of heat developable light-sensitive material (herein refereed to as a photothermographic element or simply as a film), exposure section 120 in which fed film F is exposed, development section 130 which develops exposed film F, cooling section 150 which terminates development, accumulating section 160, and a plurality of paired rollers such as paired feeding rollers 140 which are used to feed film F from the feeding section, feeding paired rollers 144 to feed the film to the development section, and paired conveying rollers 141, 142, 143, and 145 to smoothly convey film F between each of the sections. The heat development section is composed of heat drum 1, as a heating device, having a plurality of heatable facing rollers 2 which are brought nearly into contact with the outer periphery and peeling claw 6 to peel film F for conveying to the cooling section.

Incidentally, the conveying rate of heat developable materials in the heat development section is preferably in the range of 10-200 mm/second, and is more preferably 20-200 mm/second. By controlling the conveyance rate to be within the above range, it is possible to minimize uneven density. Further, it is possible to shorten the processing time, whereby it is possible to correspond to urgent diagnosis requests.

Development conditions of heat developable light-sensitive materials vary depending on the used apparatuses, devices or methods. Typically, development is performed in such a manner that image exposed heat developable materials are heated at relatively high temperatures suitable for development. After exposure, resultant latent images are developed at intermediate high temperatures (about 80-about 200° C., preferably about 100-about 140° C., and more preferably 110-130° C.) for a sufficient time (commonly about 1 second-2 minutes, preferably 3-30 seconds, and more preferably 5-20 seconds).

At heating temperatures of less than 80° C., it is impossible to obtain sufficient image density during a short time. On the other hand, at heating temperatures of at least 200° C., binders melt and adversely affect not only images, due to transference to rollers, but also tracking properties as well as the processor. Heating results in oxidation reduction reaction between organic silver salts (which function as an oxidizing agent) and reducing agents, whereby silver images are formed. This reaction process proceeds without any supply of processing solutions such as water from the exterior.

Employed as heating apparatuses, devices or methods may, for example, be typical heating devices such as a hot plate, a garment iron, a hot roller, or a generator using carbon or white titanium. In view of achieving uniform heating and enhancing heat efficiency as well as workability, it is preferable that heat developable materials, provided with a protective layer, are heated in such a manner that the surface on the side having the protective layer is conveyed while being brought into contact with a heating device and developed by thermal processing.

EXAMPLES

The present invention will now be detailed with reference to examples. However, the present invention is not limited to these examples. The % appeared in the description of Examples indicates weight % as long as mentioning otherwise.

Example 1

<<Preparation of Supports>>

By employing terephthalic acid and ethylene glycol, polyethylene terephthalate at an intrinsic viscosity IV of 0.66 (measured in phenol/tetrachloroethane=6/4 by weight at 25° C.) was prepared based on a conventional method. After pelletizing the resultant product, the resultants pellets were dried at 130° C. over a period of 4 hours. Subsequently, the dried pellets were fused at 300° C., extruded from a T-type die, and quickly cooled to prepare an unstretched film which resulted in a thickness of 175 μm after thermal fixing.

The resultant film was longitudinally stretched at a factor of 3.3, employing rollers of different peripheral rates and subsequently was laterally stretched at a factor of 4.5 employing a tenter. During stretching, the temperatures were maintained at 110° C. and 130° C., respectively. Thereafter, thermal fixing was performed at 240° C. for 20 seconds and subsequently, at the same temperature, relaxation in the lateral direction was performed by 4 percent. Thereafter, after slitting chuck portions due to the tenter, both edges were subjected to a knurling treatment, and the resultant film was wound at 4 kg/cm$^2$, whereby a roll of 175 μm thick film of was obtained.

(Surface Corona Treatment)

Both sides of the resultant support were treated at 20 m/minute at room temperature, employing Solid State Corona Processor Model 6KVA, produced by Pillar Co. From the values of electric current and voltage during this treatment, it was found that the support was subjected to a treatment of 0.375 kV·A·minutre/m$^2$. During this treatment, frequency was 9.6 kHz, and the gap clearance between the electrode and the dielectric roller was 1.6 mm.

<<Preparation of a Subbed Support>>

| Subbing Liquid Coating Composition Formula 1) (For a Subbing Layer on the Light-sensitive Layer Side) | |
|---|---|
| Pes Resin A-520, produced by Takamatsu Yusi Co., Ltd. (30 percent solution by weight) | 59 g |
| 10 weight percent polyethylene glycol monononyl phenol ether (average ethylene oxide number of 8.5) | 5.4 g |
| MP-1000 produced by Soken Kagaku Co., Ltd. (minute polymer particles of an average particle diameter of 0.4 μm | 0.91 g |
| Distilled water | 935 ml |
| Subbing Liquid Coating Composition Formula 1) (For the First Layer on the Rear Side) | |
| Styrene-butadiene copolymer latex (solids 40 percent by weight, styrene/butadiene = 68/32 by weight) | 158 g |
| 8 weight percent aqueous 2,4-dichloro-6-hydoxy-S-triazine sodium salt solution | 20 g |
| 1 percent aqueous sodium laurylbenzenesulfonate | 10 ml |
| Distilled water | 854 ml |
| Subbing Liquid Coating Composition Formula 3) (For the Second Layer on the Rear Layer Side) | |
| $Sn_2O/SbO$ (at a ratio of 9/1 by weight, average particle diameter of 0.038 μm, 17 weight percent dispersion) | 84 g |
| Gelatin (10 weight percent aqueous solution) | 89.2 g |
| Metrose TC-5, produced by Shin-Etsu Chemical Co., Ltd. (2 weight percent aqueous solution) | 8.6 g |
| MP-1000 produced by Soken Kagaku Co., Ltd. | 0.01 g |
| 1 weight percent aqueous sodium benzenesulfonate | 10 ml |
| NaOH (1 weight percent) | 6 ml |
| Proxel (produced by ICI Co.) | 1 ml |
| Distilled water | 805 ml |

After applying the above corona discharge treatment to both sides of the above 175 μm thick biaxially oriented support, the aforesaid Subbing Liquid Coating Composition Formula 1) was applied onto one side (the light-sensitive layer side) to result in a wet coated volume of 6.6 ml/m$^2$ (per side), employing a wire bar, and was dried at 180° C. over a period of 5 minutes. Subsequently, the aforesaid Subbing Liquid Coating Composition Formula-2) was applied onto the rear side (the back surface) to result in a wet coated volume of 5.7 ml/m$^2$, employing a wire bar, and was dried at 180° C. over a period of 5 minutes. Further, the aforesaid Subbing Liquid Coating Composition Formula 3) was applied onto the rear side (the back surface) to result in a wet coated volume of 7.7 ml/m$^2$, employing a wire bar, and was dried at 180° C. over a period of 6 minutes.

<<Preparation of the Back Surface Liquid Coating Composition>>

(Preparation of Solid Minute Base Precursor Particle Dispersion (a))

Mixed with 220 ml of distilled water were 64 g of Base Precursor Compound-1, 28 g of diphenylsulfone, and 10 g surface active agent, Demol N, produced by Kao Corp., and the resultant mixture was subjected to bead dispersion employing a sand mill (¼ Gallon Sand Grinder Mill, produced by Imex Co., Ltd), whereby Solid Minute Base Precursor Particle Dispersion (a) at an average particle diameter of 0.2 μm was obtained.

(Preparation of Solid Minute Dye Particle Dispersion)

Mixed with 305 ml of distilled water were 9.6 g of Cyanine Dye Compound 13 and 5.8 g of sodium p-dodecylbenzenesulfonate, and the resultant mixture was subjected to bead dispersion employing a sand mill (¼ Gallon Sand Grinder Mill, produced by Imex Co., Ltd), whereby Minute Dye Particle Dispersion at an average particle diameter of 0.2 μm was obtained.

<Preparation of Antihalation Layer Liquid Coating Composition>

An antihalation layer coating composition was prepared by mixing 844 ml of water with 17 g of gelatin, 9.6 g of polyacryl amide, 70 g of above Solid Base Precursor Minute Particle Dispersion (a), 56 g of above Solid Dye Minute Particle Dispersion, 1.5 g of minute monodipsersed polymethyl methacrylate particle dispersion (at an average particle size of 8 μm and a particle diameter standard deviation of 0.4), 0.03 g of benzoisothiazolinone, 2.2 g of sodium polyethylenesulfonate, 0.2 g of Blue Dye Compound 14, and 3.9 g of Yellow Dye Compound 15.

<Preparation of the Back Surface Protective Layer Liquid Coating Composition>

In a vessel maintained at 40° C., mixed were 50 g of gelatin, 0.2 g of sodium polystyrenesulfonate, 2.4 g of N,N-ethylenebisvinylsulfonacetoamide), 1 g of sodium t-octylphenoxyethoxyethanesulfonate, 30 mg of benzisothiazolinone, 37 mg of a fluorine based surface active agent (F-1), 0.15 g of a fluorine based surface active agent (F-2), 64 mg of a fluorine based surface active agent (F-3), 32 mg of a fluorine based surface active agent (F-4), 8.8 g of an acrylic acid/ethyl acrylate copolymer (at a copolymerization weight ratio of 5/95), 0.6 g of Aerosol OT (produced by American Cyanamid Co.), 1.8 g of a liquid paraffin emulsion as a liquid paraffin, and 950 ml of water. The resultant mixture was designated as Back Surface Protective Layer Liquid Coating Composition.

<<Preparation of Silver Halide Emulsion 1>>

<<Preparation of a Light-sensitive Silver Halide Emulsion>>

| | | |
|---|---|---|
| (A1) | | |
| | Phenylcarbamoylated gelatin | 66.23 g |
| | Compound (A) (10 percent aqueous solution) | 10 ml |
| | Potassium bromide | 0.32 g |
| | Water to make | 5429 ml |
| (B1) | | |
| | 0.67 mol/L aqueous silver nitrate solution | 2635 ml |
| (C1) | | |
| | Potassium bromide | 52.1 g |
| | Potassium iodide | 1.485 g |
| | Water to make | 660 ml |
| (D1) | | |
| | Potassium bromide | 151.1 g |
| | Potassium iodide | 7.645 g |
| | Potassium hexachloroiridate (IV) (1 percent aqueous solution) | 0.925 ml |
| | Potassium hexacyanoferrate (II) | 0.075 g |
| | Water to make | 1982 ml |
| (E1) | | |
| | 0.4 mol/L aqueous potassium bromide solution amount to control the silver potential, given below | |
| (F1) | | |
| | Potassium hydroxide | 0.71 g |
| | Water to make | 20 ml |
| (G1) | | |
| | 56 percent aqueous acetic acid solution | 18.0 ml |
| (H1) | | |
| | Sodium carbonate anhydride | 1.72 g |
| | Water to make | 151 ml |

Compound (A): $HO(CH_2CH_2O)_n(CH(CH_3)CH_2O)_{17}(CH_2CH_2O)_mH$ (m + N = 5 − 7)

<Comparative Grains 1a>

Employing the stirrer shown in Japanese Patent Publication No. 58-58288, 1/4 of Solution (B1) and all of Solution (C1) were added to Solution (A1) at 75° C. over a period of 4 minutes 45 seconds by employing a double-jet method, while controlling pAg to 8.09, whereby nuclei were formed. After 7 minutes, 3/4 of Solution (B1) and all of Solution (D1) were added over a period of 14 minutes 15 seconds, employing a double-jet method. After stirring for 5 minutes, the temperature was lowered to 40° C., and all of Solution (G1) was added, whereby the silver halide emulsion was sedimented. The supernatant was removed while leaving 2,000 ml of the sedimented portion and 10 L of water was added. After stirring, the silver halide emulsion was re-sedimented. That supernatant was removed while leaving 1,500 ml of the sedimented portion and 10 L of water was added. After stirring, the silver halide was sedimented. The supernatant was removed while leaving 1500 ml of the sedimented portion. Thereafter, Solution (H1) was added and the temperature was raised to 60° C. Stirring was continued for an additional 120 minutes. Finally, the pH was adjusted to 5.8 and water was added so that the volume per mol of Ag reached 1,161 g, whereby light-sensitive Silver Halide Emulsion 1a was obtained.

The resultant emulsion was constituted of monodipsersed cubic silver iodobromide grains of an average grain size of 111.7 nm (being an equivalent circular diameter), a grain size variation coefficient of 16 percent, and a [100] plane ratio of 89 percent (at the content ratio of AgI on the grain surface of 3.5 mol percent).

<Present Invention Grains 1b>

The same method as for Grains 1a was employed, except that the temperature was altered to 40° C. All of Solution (F-1) was added one minute after nuclei formation. During that period, the pH was 10. After 6 minutes, Solution (B1) and Solution (D1) were added over a period of 14 minutes 15 seconds, employing a double-jet method. Thereafter, Light-sensitive Silver Halide Emulsion 1b was prepared employing the same method as for Grains 1a. The resultant emulsion was constituted of monodipsersed cubic silver iodobromide grains of an average grain size of 47.5 nm (being an equivalent circular diameter), a grain size variation coefficient of 12 percent, and a [100] plane ratio of 92 percent.

<Present Invention Grains 1c>

The same method as for Grains 1a was employed, except that the temperature was altered to 30° C. All of Solution (F-1) was added one minute after nuclei formation. During that period, the pH was 10. After stirring for 5 minutes, at 30° C., the pH was adjusted to 5.8 by the addition of a citric acid solution. Thereafter, the remaining Solution (B1) and Solution (D1) were added over a period of 12 minutes 15 seconds, employing a double-jet method. Thereafter, Light-sensitive Silver Halide Emulsion 1b was prepared employing the same method as for Grains 1a. The resultant emulsion was constituted of monodipsersed cubic silver iodobromide grains of an average grain size of 41.2 nm (being an equivalent circular diameter), a grain size variation coefficient of 11 percent, and a [100] plane ratio of 94 percent.

<Present Invention Grains 1d-1h>

Grains were formed employing the same method as for Grains 1c. After adding Solution (F-1), it was confirmed that the pH was 10. Thereafter, sensitizers represented by General Formulas (C-1) and (C-2) were added as shown in Table 1, whereby light-sensitive Silver Halide Emulsions 1d-1h were obtained.

Each of above Silver Halide Grain Dispersions 1a-1h was stirred while maintaining 38° C., and 5 ml of 0.34 percent by weight of 1,2-benzisothazoline-3-one was added. After 40 minutes, the temperature was raised to 47° C. A sodium benzenethiosulfonate methanol solution was added, 20 minutes after increasing temperature, in an amount of $7.6\times10^{-5}$ mol per mol of silver, and further, after 5 minutes, a tellurium sensitizer methanol solution was added in an amount of $2.9\times10^{-4}$ mol per mol of silver. Subsequently, the resultant mixture underwent ripening for 91 minutes. Thereafter, Spectral Sensitizing Dyes A and B at a mole ratio of 3:1 methanol solution was added in an amount of $1.2\times10^{-3}$ mol as the total amount of both dyes per mol of silver, and one minute later, 1.3 ml of a 0.8 weight percent N',N'-dihydroxy-N"-diethylmelamine methanol solution was added. Further, 4 minutes later, a 5-methyl-2-mercaptobenzimidazol solution in an amount of $4.8\times10^{-3}$ mol per mol of silver, a 1-phenyl-2-heptyl-5-mercapto-1,3,4-triazole methanol solution in an amount of $5.4\times10^{-3}$ mol per mol of silver, and an aqueous 1-(3-methylureido)-5-mercaptotetrzole sodium salt solution in an amount of $8.5\times10^{-3}$ mol per mol of silver were added, whereby Chemically Sensitized Silver Halide Emulsions 1a-1h were prepared.

Further, prior to mixing the silver halide emulsion of the present invention with reducible carboxylic acid silver, compounds represented by General Formulas (1-1)-(4-2) were added, as shown in Table 1.

<<Preparation of a Reducible Silver Salt Dispersion>>

1) Preparation of Reducible Silver Salt Dispersion 1

Mixed were 87.6 kg of behenic acid (trade name EDENOR C22-85JP GW), produced by COGNIS DEUTSCHLAND GmbH, 423 L of distilled water, 49.2 L of an aqueous 5 mol/L NaOH solution, and 20 L of tert-butanol, and the resultant mixture underwent reaction at 75° C. for one hour while stirred, whereby a sodium behenate solution was prepared. Separately, 206.2 L of an aqueous solution (at a pH of 4.0) containing 40.4 kg of silver nitrate was prepared and maintained at 10° C. A reaction vessel, into which 635 L of distilled water and 30 L of tert-butanol were charged, was maintained at 30° C. While vigorously stirred, all the above sodium behenate solution and all the above aqueous silver nitrate solution were added at a constant flow rate over a period of 93 minutes 15 seconds and 90 minutes, respectively. The above addition was arranged so that only an aqueous silver nitrate solution was added for 11 minutes after initiation of the addition of the aqueous silver nitrate solution, subsequently the sodium behenate solution was added, and only the sodium behenate solution was added for 14 minutes 15 seconds after completion of the addition of the aqueous silver nitrate solution. During the additions, the temperature in the reaction vessel was controlled to reach 30° C. The exterior temperature was controlled so that the temperature of the liquid composition remained constant. The temperature of the piping of the addition system of the sodium behenate solution was controlled by circulating warm water through the exterior of the duplex piping, and the temperature of the liquid composition of the outlet of the tip of the addition nozzle was controlled to reach 75° C. Further, the temperature of the piping of the addition system of the aqueous silver nitrate solution was controlled by circulating cold water in the exterior of the duplex pipe. Addition locations of the sodium behenate solution and the aqueous silver nitrate solution were arranged to be symmetrical with the stirrer shaft as a center and further the rising level was controlled to not come into contact with the reaction liquid composition.

After the addition of the sodium behenate solution, the resultant mixture while stirred was allowed to stand for 20 minutes. Subsequently, the temperature was raised to 35° C. over a period of 30 minutes, and then ripening was performed for 210 minutes. Immediately after the ripening, solids were collected by centrifugal filtration, and washed with water until the conductivity of the filtrate water reached 30 μS/cm. During that operation, in order to promote the decrease in electric conductivity, an operation in which the wet cake was converted to a slurry state by adding pure water was repeated three times. The resultant wet cake was treated at centrifugal a force of 700 G for one hour. Incidentally, G is represented by $1.119\times10^{-5}\times$radius (in cm) of the vessel×rotation frequency (rpm). The solid content (determined by drying 1 g of the wet cake at 110° C. for two hours) of the aliphatic acid silver wet cake, prepared as above, was 44 percent.

The shape of the resultant silver behenate particles was observed employing an electron microscope, and was found to be flake-shaped crystals of a thickness of 0.14 μm, a short side of 0.4 μm, a long side of 0.6 μm, an average aspect ratio of 5.2, an average equivalent spherical diameter of 0.52 μm, and an equivalent spherical diameter variation coefficient of 15 percent.

With respect to the wet cake equivalent to 260 kg of the dried solid portion, 19.3 kg of polyvinyl alcohol (trade name, PVA-217) and water were added. After the total weight was brought to 1,000 kg, the resultant mixture was subjected to become a slurry employing a dissolver blade, and further to a preliminary dispersion employing a pipe line mixer (Type PM-10, produced by Mizuho Kogyo).

Subsequently, the preliminarily dispersed stock liquid composition was processed three times at an adjusted pressure of 1,260 kg/cm$^2$ employing a homogenizer (trade name, Microfluidizer M-610, produced by Microfluidics International Corp., Z type interaction chamber was used), whereby a silver behenate dispersion was obtained. To perform cooling operation, a coiled heat exchanger was installed in the front and the back of the interaction chamber and dispersion temperature was maintained at 18° C. by controlling the coolant temperature.

2) Preparation of Reducible Silver Salt Dispersions 2-6

In the same manner as the preparation of Reducible Silver Salt Dispersion 1, each of the compounds in the amount listed in Table 1, of which carboxylic group was equal to the mol behenic acid (trade name, EDENOR C22-85JP GW) produced by COGNIS DEUTSCHLAND GmbH), 432 L of distilled water, 49.2 L of a 5 mol/L aqueous NaOH solution, and 120 L of tert-butanol were mixed and the resultant mixture underwent reaction at 75° C. for one hour, whereby a sodium salt solution was obtained. Separately, 206.2 L (at a pH of 4.0) of an aqueous solution containing 40.4 kg of silver nitrate was prepared and maintained at 10° C. A reaction vessel, into which 635 L of distilled water and 30 L of tert-butanol were charged, was maintained at 30° C. While vigorously stirred, all the above sodium salt solution and all the above aqueous silver nitrate solution were added at a constant flow rate over a period of 93 minutes 15 seconds and 90 minutes, respectively. The above addition was arranged so that only the aqueous silver nitrate solution was added for 11 minutes after initiation of the addition of the aqueous silver nitrate solution, subsequently the sodium salt solution was added, and only the sodium behenate solution was added for 14 minutes 15 seconds after completion of the addition of the aqueous silver nitrate solution. During the additions, the temperature in the reaction vessel was controlled to maintain 30° C. The exterior temperature was controlled so that the temperature of the liquid composition remained constant. The temperature of the piping of the addition system of the sodium behenate solution was controlled by circulating warm water through the exterior of the duplex piping, and the temperature of the liquid composition of the outlet of the tip of the addition nozzle was controlled to reach 75° C. Further, the temperate of the piping of the addition system of the aqueous silver nitrate solution was controlled by circulating cold water in the exterior of the duplex pipe. Addition locations of the sodium behenate solution and the aqueous silver nitrate solution were arranged to be symmetrical with the stirrer shaft as the center, and further the rising level was controlled to not come into contact with the reaction liquid composition.

After the addition of the sodium salt solution, the resultant mixture, while stirred, was allowed to stand for 20 minutes. Subsequently, the temperature was raised to 35° C. over a period of 30 minutes, and then ripening was performed for 210 minutes. Immediately after the ripening, solids were collected by centrifugal filtration, and washed with water until the conductivity of the filtrate water reached 30 μS/cm. During that operation, in order to promote the decrease in electric conductivity, an operation in which the wet cake was converted to a slurry state by adding pure water, was repeated three times. The resultant wet cake was treated at a centrifugal force of 700 G for one hour. Incidentally, G is represented by $1.119\times10^{-5}\times$radius (in cm) of the vessel$\times$ rotation frequency (rpm). The solid content (determined by drying 1 g of the wet cake at 110° C. for two hours) of the aliphatic acid silver wet cake, prepared as above, was about 30 percent.

Added to the wet cake in an amount necessary to achieve the same silver content ratio as Reducible Silver Salt Dispersion 1 were 19.3 kg of polyvinyl alcohol (trade name, PVA-217) and water, and the total weight was brought to 1,000 kg. The resultant mixture was subjected to a slurry state employing dissolver blades and was further subjected to preliminary dispersion employing a pipe line mixer (PM-10, produced by Mizuho Industrial Co., Ltd.).

Subsequently, the preliminarily dispersed stock liquid composition was processed three times at an adjusted pressure of 1,260 kg/cm$^2$ employing a homogenizer (trade name, Microfluidizer M-610, produced by Microfluidics International Corp., using Z type interaction chamber), whereby a dicarboxylic acid silver dispersion was obtained. To perform cooling operation, a coiled heat exchanger was installed in the front and the back of the interaction chamber, and dispersion temperature was set at 18° C. by controlling the coolant temperature.

(Preparation of Reducing Agent Dispersions)

<<Preparation of Reducing Agent-4 Dispersion>>

Added to 10 kg of Reducing Agent-4 (2,2'-methylenebis-(4-ethyl-6-tert-butylphenol)) and 20 kg of a 10 weight percent aqueous modified polyvinyl alcohol (Poval PM203, produced by Kuraray Co., Ltd.) solution, was 6 kg of water. The mixture was vigorously stirred to result in a slurry. The resultant slurry was fed by a diaphragm pump to a horizontal sand mill (UVM-2, produced by Imex Co.) loaded with zirconia beads of an average diameter of 0.5 mm, and was dispersed for 3 hours 30 minutes. Thereafter, 0.2 g of benzoisothiazolinone sodium salt and water were added to result in a concentration of the reducing agent of 25 percent by weight, whereby Reducing Agent-4 Dispersion was obtained. The median diameter and the maximum particle diameter of the reducing agent particles contained in the reducing agent dispersion, prepared as above, were 0.40 μm and at most 1.5 μm, respectively. The resultant reducing agent dispersion was filtered employing a polypropylene filter of a pore diameter of 3.0 μm to remove foreign matter such as dust and stored.

<<Preparation of Reducing Agent-5 Dispersion>>

Added to 10 kg of Reducing Agent-4 (2,2'-methylenebis-(4-methyl-6-tert-butylphenol)) and 20 kg of a 10 weight percent aqueous modified polyvinyl alcohol (Poval PM203, produced by Kuraray Co., Ltd.) solution, was 6 kg of water. The mixture was vigorously stirred to result in a slurry. The resultant slurry was fed by a diaphragm pump to a horizontal sand mill (UVM-2, produced by Imex Co.) loaded with zirconia beads of an average diameter of 0.5 mm, and was dispersed for 3 hours 30 minutes. Thereafter, 0.2 g of benzoisothiazolinone sodium salt and water were added to result in a concentration of the reducing agent of 25 percent by weight, whereby Reducing Agent-5 Dispersion was obtained. The median diameter and the maximum particle diameter of the reducing agent particles contained in the reducing agent dispersion, prepared as above, were 0.38 μm and at most 1.5 μm, respectively. The resultant reducing agent dispersion was filtered employing a polypropylene filter of a pore diameter of 3.0 μm to remove foreign matter such as dust and stored.

<<Preparation of Hydrogen Bonding Compound-2 Dispersion>>

Added to 10 kg of Hydrogen Bonding Compound-2 (tri(4-t-butylphenyl)phosphine oxide) and 20 kg of a 10 weight percent aqueous modified polyvinyl alcohol (Poval PM203, produced by Kuraray Co., Ltd.) solution, was 6 kg of water. The mixture was vigorously stirred to result in a slurry. The resultant slurry was fed by a diaphragm pump to a horizontal sand myll (UVM-2, produced by Imex Co.) loaded with zirconia beads of an average diameter of 0.5 mm, and was dispersed over a period of 3 hours 30 minutes. Thereafter, 0.2 g of benzisothiazolinone sodium salt and water were added to result in a concentration of the reducing agent of 25 percent by weight, whereby Hydrogen Bonding Compound-2 Dispersion was obtained. The median diameter and the maximum particle diameter of the reducing agent particles contained in the reducing agent dispersion, prepared as above, were 0.35 μm and at most 1.5 μm, respectively. The resultant hydrogen bonding compound dispersion was filtered employing a polypropylene filter of a pore diameter of 3.0 μm to remove foreign matter such as dust and stored.

(Preparation of Polyhalides)

<<Preparation of Polyhalide-2 Dispersion>>

Added to 10 kg of Polyhalide-2 (tribromomethanesulfonylbenzene), 10 kg of a 20 weight percent aqueous modified polyvinyl alcohol (Poval PM203, produced by Kuraray Co., Ltd.) solution, and 0.4 kg of a 20 weight percent aqueous sodium triisopropylnaphthalenesulfonate solution, was 14 kg of water. The mixture was vigorously stirred to result in a slurry. The resultant slurry was fed by a diaphragm pump to a horizontal sand mill (UVM-2, produced by Imex Co.) loaded with zirconia beads of an average diameter of 0.5 mm, and was dispersed over a period of 5 hours. Thereafter, 0.2 g of benzisothiazolinone sodium salt and water were added to result in a 25 percent by weight polyhalide concentration, whereby Polyhalide-2 Dispersion was obtained. The median diameter and the maximum particle diameter of the reducing agent particles contained in the reducing agent dispersion, prepared as above, were 0.41 μm and at most 2.0 μm, respectively. The resultant polyhalide dispersion was filtered employing a polypropylene filter of a pore diameter of 10.0 μm to remove foreign matter such as dust and subsequently stored.

<<Preparation of Polyhalide-3 Dispersion>>

Added to 10 kg of Polyhalide-3 (N-butyl-3-tribromomethanesulfonylbenzamide), 20 kg of a 10 weight percent aqueous modified polyvinyl alcohol (Poval PM203, produced by Kuraray Co., Ltd.) solution, and 0.4 kg of a 20 weight percent aqueous sodium triisopropylnaphthalenesulfonate solution, was 8 kg of water. The mixture was vigorously stirred to result in a slurry. The resultant slurry was fed by a diaphragm pump to a horizontal sand mill (UVM-2, produced by Imex Co.) loaded with zirconia beads of an average diameter of 0.5 mm, and was dispersed over a period of 5 hours. Thereafter, 0.2 g of benzisothiazolinone sodium salt and water were added to result in a 25 percent by weight polyhalide concentration. The resultant dispersion heated at 40° C. for 5 hours whereby Polyhalide-3 Dispersion was obtained. The median diameter and the maximum particle diameter of the organic polyhalide particles in the polyhalide dispersion prepared as above were 0.36 μm and at most 1.5 μm, respectively. The resultant polyhalide dispersion was filtered employing a polypropylene filter of a pore diameter of 3.0 μm to remove foreign matter such as dust and stored.

<<Preparation of Phthalazine Compound-1 Solution>>

Dissolved in 174.57 kg of water was 8 kg of modified polyvinyl alcohol MP303, produced by Kuraray Co., Ltd. Subsequently, 3.15 kg of a 30 weight percent aqueous sodium triisopropylnaphthalenesulfonate solution and 14.28 kg of a 70 weight percent aqueous Phthalazine Compound-1 (6-isopropylphthalazine) were added, whereby a 5 weight percent Phthalazine Compound-1 Solution was prepared.

<<Preparation of Aqueous Mercapto Compound-1 Solution>>

Dissolved in 993 g of water was 7 g of Mercapto Compound-1 (1-(3-sulfophenyl)-5-mercaptotetrazole sodium salt), whereby a 0.7 weight percent aqueous solution was prepared.

<<Preparation of Pigment-1 Dispersion>>

Added to 250 g of water were 64 g of C.I. Pigment Blue 60 and 6.4 g of Demol N, produced by Kao Corp. The resultant mixture was vigorously blended to form a slurry. Zirconia beads of an average diameter of 0.5 mm were collected in an amount of 800 g and placed in a vessel together with the slurry. The resultant mixture was dispersed over a period of 25 hours employing a homogenizer (¼ G Sand Grinder Mill, produced by Imex Co.), whereby Pigment-1 Dispersion was obtained. The average diameter of pigment particles contained in the resultant pigment dispersion was 0.21 μm.

<<Preparation of SBR Latex Liquid Composition>>

SBR latex, at Tg of 23° C., was prepared as described below. A mixture consisting of 70.5 weight parts of styrene, 26.5 weight parts of butadiene, and 3 weight parts of acrylic acid underwent emulsion polymerization at 80° C. over a period over a period of 8 hours, employing ammonium persulfate as a polymerization initiator, as well as anionic surface active agents as an emulsifier. Thereafter, aging was performed at 80° C. over a period of 8 hours, and then the temperature was lowered to 40° C. The pH was regulated to 7.0 by the addition of ammonia water and then Sundet BL, produced by Sanyo Chemical Industries, Ltd., was added to reach 0.22 percent. Subsequently, the pH was adjusted to 8.3 by the addition of a 5 percent aqueous sodium hydroxide solution. Further, the pH was adjusted to 8.4 by the addition of ammonia water. The mol ratio of $Na^+$ ions to $NH_4^+$ ions used for the pH adjustments was 1:2.3. Further, 0.15 ml of a 7 percent aqueous benzoisothiazolinone sodium salt solution was added per kg of the resultant liquid composition, whereby SBR Latex Liquid Composition was prepared.

(SBR Latex: latex of -St (70.5)-Bu (26.5)-AA (3)-, of a Tg of 23° C., an average particle diameter of 0.1 μm, a concentration of 43 percent by weight, an equilibrium moisture content of 0.6 percent by weight at 25° C. and 60 percent relative humidity, an ionic conductivity of 4.2 mS/cm (determined by Conductivity Meter CM-30S, produced by DKK-TOA Corp.) for Latex Stock Liquid Composition (43 percent by weight) at 25° C.), a pH of 8.4. SBR Latexes of different Tg were prepared by appropriately changing the ratio of styrene to butadiene.

<<Preparation of Emulsion Layers (Light-Sensitive Layers) Nos. 1-14>>

As shown in Table 1, were successively added to 1,000 g of each of Reducible Silver Salt Dispersions 1-6, as prepared above, were 95 ml of water, 73 g of Reducing Agent-4 Dispersion, 68 g of Reducing Agent-5 Dispersion, 30 g of Pigment-1 Dispersion, 21 g of Organic Polyhalide-2 Dispersion, 69 g of Organic Polyhalide-3 Dispersion, 173 g of Phthalazine Compound-1 Solution, 1,082 g of SBR core/shell type latex (at a core Tg of 20° C./shell Tg of 30° C., and a weight ratio of 70/30) liquid composition, 124 g of Hydrogen Bonding Compound-2 Dispersion, and 9 g of Mercapto Compound-1 Solution. Just prior to coating, as shown in FIG. 1, 110 g of each of Silver Halide Emulsions 1a-1h was added and the sufficiently mixed emulsion layer liquid coating composition was fed without any modification to the coating die and coated.

<<Preparation of Emulsion Side Interlayer Liquid Coating Composition>>

Water was added to the following mixture to bring the total weight to 880 g; the mixture consisted of 772 g of a 10 weight percent aqueous polyvinyl alcohol PVA-205 (produced by Kuraray Co., Ltd.) solution, 5.3 g of Pigment-1 Dispersion, 226 g of a 27.5 weight percent methyl methacrylate/styrene/butyl acrylate/hydroxyethyl methacrylate/acrylic acid copolymer (at a copolymerization weight ratio of 64/9/20/5/2) latex liquid composition, and 2 ml of 5 weight percent aqueous solution of Aerosol OT (produced by American Cyanamid), 10.5 ml of a 20 weight percent aqueous phthalic acid diammonium salt solution. The pH was then adjusted to 7.5 by the addition of NaOH to prepare an interlayer liquid coating composition, which was fed to a coating die to result in a coated amount of 10 ml/m$^2$. The viscosity of the above liquid coating composition was determined at 40° C., employing a Type B viscosimeter (No. 1 rotor, at 60 rpm), resulting in 21 mPa·s.

<<Emulsion Surface Protective First Layer Liquid Coating Composition>>

In water, 64 g of an inert gelatin was dissolved, and added to the resultant gelatin solution were 80 g of a 27.5 weight percent methyl methacrylate/styrene/butyl acrylate/hydroxyethyl methacrylate/acrylic acid copolymer (at a copolymerization weight ratio of 64/9/20/5/2) latex liquid composition, 23 ml of a 10 weight percent phthalic acid methanol solution, 23 ml of a 10 weight percent aqueous 4-methylphthalic acid solution, 28 ml of 0.5 mol/L sulfuric acid, 5 ml of a 5 weight percent aqueous Aerosol OT (produced by American Cyanamid) solution, 0.5 g of phenoxyethanol, and 0.1 g of benzisothiazoline, and the total volume was brought to 750 g by the addition of water to prepare a liquid coating composition. Just prior to coating, 26 ml of a 4 weight percent chromium alum solution was added. The resultant mixture was mixed employing a static mixer and fed to the coating die to result in a coated amount of 6 ml/m$^2$. The viscosity of the liquid coating composition was determined at 40° C., employing Type B viscosimeter (No. 1 rotor at 60 rpm), resulting in 17 mPa·s.

<<Emulsion Surface Protective Second Layer Liquid Coating Composition>>

In water, 80 g of an inert gelatin was dissolved, and added to the resultant gelatin solution were 102 g of a 27.5 weight percent methyl methacrylate/styrene/butyl acrylate/hydroxyethyl methacrylate/acrylic acid copolymer (at a copolymerization weight ratio of 64/9/20/5/2) latex liquid composition, 3.2 ml of a 5 weight percent fluorine based surface active agent (F-1: N-perfluoroctylsulfonyl-N-propylalanine potassium salt) solution, 32 ml of a 2 weight percent fluorine based surface active agent (F-2: polyethylene glycol mono (N-perfluoroctylsulfonyl-N-propyl-2-aminoethyl)ether [at the ethylene oxide average degree of polymerization of 15]), 23 ml of a 5 weight percent Aerosol OT (produced by American Cyanamid) solution, 4 g of minute polymethyl methacrylate particles (at an average particle diameter of 0.7 μm), 21 g of minute polymethyl methacrylate particles (at an average particle diameter of 4.5 μm), 1.6 g of 4-methylphthalic acid, 4.8 g of phthalic acid, 44 ml of 0.5 mol/L sulfuric acid, and 10 mg of benzisothiazoline. Subsequently, the total volume was brought to 650 g by the addition of water. Just prior to coating, 445 ml of an aqueous solution containing 4 weight percent chromium alum and 0.67 weight percent phthalic acid were added and mixed employing a static mixer, whereby a surface protective layer liquid coating composition was prepared. The resultant liquid coating composition was fed to a coating die to result in a coated amount of 8.3 ml/m$^2$. The viscosity of the liquid coating composition was determined at 40° C., employing Type B viscosimeter (No. 1 rotor at 60 rpm), resulting in 9 mPa·s.

<<Preparation of Silver Salt Photothermographic Dry Imaging Material Nos. 1-14>>

The Antihalation Layer Liquid Coating Composition and Back Surface Protective Layer Liquid Coating Composition, prepared as above, were simultaneously applied onto the back surface of the aforesaid subbed support so that the solid coated weight of the minute solid dye particles reached 0.04 g/m$^2$ and the coated weight of the gelatin of the back surface protective layer reached 1.7 g/m$^2$, and subsequently dried, whereby layers was prepared.

An emulsion layer, an interlayer, a protective layer first layer, and a protective layer second layer were simultaneously coated in the stated order from the sublayer onto the surface opposite the back surface, whereby a silver salt photothermographic dry imaging material sample was prepared. During the coating, the emulsion layer and the interlayer were maintained at 31° C., and the protective layer first layer was maintained at 36° C., while the protective layer second layer was maintained at 37° C. The coated weight (in g/m$^2$) of each of the compounds of each layer is as follows.

| | |
|---|---|
| Reducible silver salt (in terms of Ag) | 1.34 |
| Pigment (C.I. Pigment Blue 60) | 0.032 |
| Reducing Agent-4 | 0.40 |
| Reducing Agent-5 | 0.36 |
| Polyhalide-2 | 0.12 |
| Polyhalide-3 | 0.37 |
| Phthalazine Compound-1 | 0.19 |
| SBR Latex | 10.0 |
| Hydrogen Bonding Compound-2 | 0.59 |
| Mercapto Compound-1 | 0.002 |
| Silver Halide (in terms of Ag) | 0.09 |

Drying and coating conditions were as follows. The coating speed was set at 160 m/minute, and the gap between the tip of the coating die and the support was set between 0.10-0.30 mm. The pressure in the vacuum chamber was set to be 196-882 Pa lower than atmospheric pressure. The support was subjected to charge elimination employing an ionic air flow. In the subsequent chilling zone, the coating was chilled employing an air flow at a dry bulb temperature of 10-20° C. Thereafter, non-contact conveyance was performed and in a helically floating dryer, drying was performed employing a drying air flow at a dry bulb temperature of 23-45° C. and a wet bulb temperature of 15-21° C. After drying, the moisture content was controlled in an ambience of 25° C. and 40-60 percent relative humidity followed by heating so that the coating surface reached a temperature of 70-90° C. After the heating, the coating was cooled to 25° C.

The degree of matting of the silver salt photothermographic dry imaging materials, prepared as above, was as follows: in terms of Bekk smoothness, the light-sensitive layer side surface was 550 seconds, while the back side surface was 130 seconds. Further, the pH of the surface on the light-sensitive layer side was determined, resulting in 6.0.

Chemical structures of the compounds employed in examples of the present invention are shown below.

Spectral Sensitizing Dye A

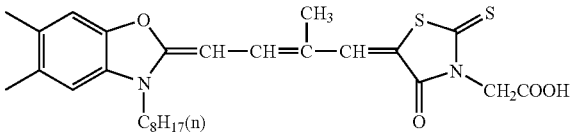

Spectral Sensitizing Dye B

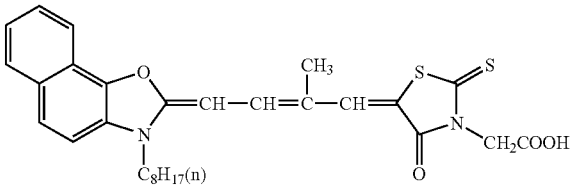

Tellurium Senstizer C

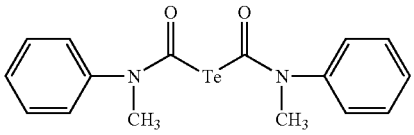

Base Precursor Compound-1

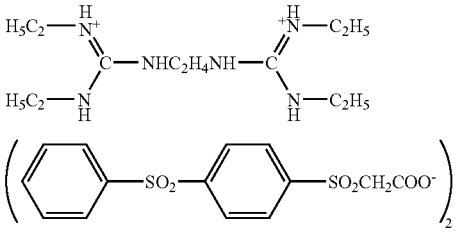

Cyanine Dye Compound 13

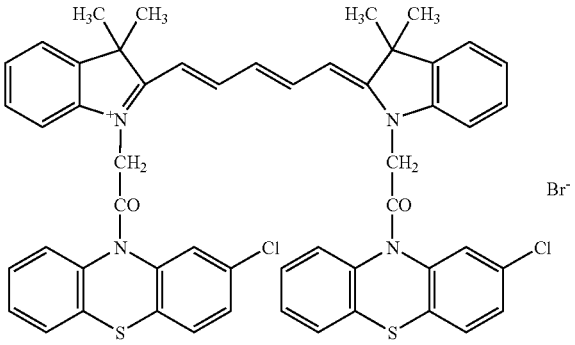

-continued

Yellow Dye Compound 14

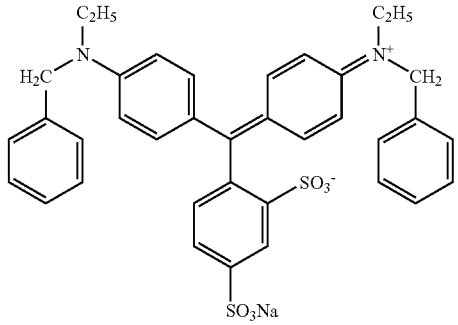

Yellow Dye Compound 15

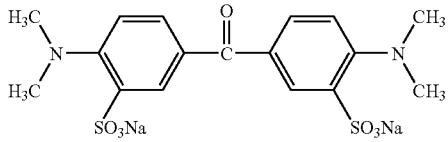

(Deducing Agent-4)

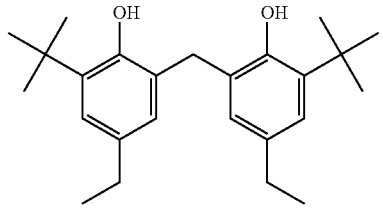

(Red icing Agent-5)

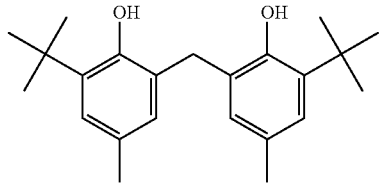

(Hydrogen Bonding Compound-2)

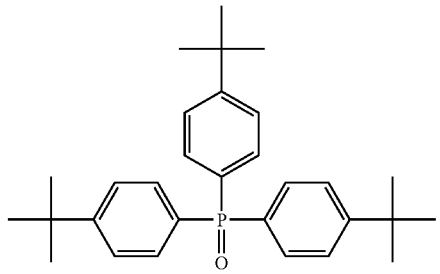

(Polyhalide Compound-2)

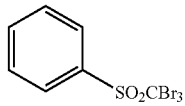

(Polyhalide Compound-3)

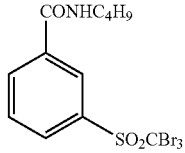

-continued (Mercapto Compound-1)

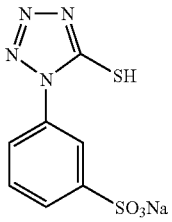

(Phthalazine Compound-1)

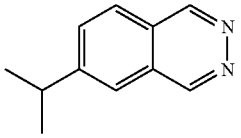

(F-1)

$C_8F_{17}SO_2NCH_2COOK$
|
$C_3H_7(n)$ (F-2)

$C_8F_{17}SO_2NCH_2CH_2O(CH_2CH_2O)_nH$ n = 15 (average)
|
$C_3H_7(n)$ (F-3)

$C_8F_{17}SO_2N(CH_2CH_2O)_4CH_2CH_2CH_2CH_2SO_3Na$
|
$C_3H_7(n)$ (F-4)

$C_8F_{17}SO_3K$ (Determination of Dmin and Photographic Speed)

By employing a dry laser imager (loaded with a 660 nm semiconductor laser at a maximum output of 60 mW (IIIB), each sample was exposed and thermally developed (for a total of 24 seconds employing four panel heaters set at 112° C.-119° C.-121° C.-121° C.). Density of the thermally developed samples was determined employing an optical densitometer (PD-82, produced by Konica Corp.). Subsequently, characteristic curves were prepared based on density D and exposure amount E, and minimum density (Dmin equivalent to fog density) and photographic speed were recorded. Incidentally, the photographic speed was defined as a logarithm of the reciprocal of the exposure amount to yield a density which was higher 1.0 than the minimum density, while the results were shown by relative values when Sample 1 was 100.

(Evaluation of Storage Stability (Storage of Unexposed Light-Sensitive Materials))

(Packaging Materials) PET 10 μm/PE 12 μm/aluminum foil 9 μm/Ny 15 μm/polyethylene containing 3 percent carbon 50 μm, oxygen permeability: 0 ml/atm·m$^2$·25° C.·day, moisture permeability: 0 g/atm·m$^2$·25° C.·day.

Each of the prepared samples was re-humidified at 25° C. and 50 percent relative humidity for two hours and subsequently sealed in the above packaging materials. As an accelerated aging treatment, the packaged materials were stored in an ambience of 40° C. for four weeks. As comparison, the same material was stored at 25° C. Each of these samples was exposed and thermally developed employing the same methods as above, and minimum density (fog density) and photographic speed were determined employing the same methods as above. Increase in fog (ΔDmin) was calculated based on the formula below and was used as a measure for storage stability. In practice, a relative value was used when the value of Sample 1 was 100.

ΔDmin=(fog density of the sample which was subjected to accelerated aging)−(fog density of the sample which was subjected to normal aging)

Δphotographic speed=(photographic speed of the sample which was subjected to normal aging)−(photographic speed of the sample which was subjected to accelerated aging)

(Evaluation of Image Lightfastness)

Each of the samples which had been thermally developed employing the above methods was allowed to stand on a light source or under a fluorescent lamp for three days in a room at 50° C. and 55 percent relative humidity, and the optical density of the minimum density portion (Dmin portion) prior to and after exposure to the above light sources was determined, and variation (ΔDmin) of the minimum density (Dmin) was obtained based on the formula below. The resultant variation was used as a measure of storage stability. In practice, the results were shown as a relative value when Sample 1 was 100.

ΔDmin=(Dmin after exposure to a fluorescent lamp)−(Dmin prior to exposure to the fluorescent lamp)

Incidentally, the temperature on the light source was 50° C. and illuminance was 8,000 Lux. The results were shown as a relative value when Sample 1 was 100.

(Evaluation of Silver Tone)

The resultant silver images were visually evaluated and the silver tone was graded based on the criteria below.

A: silver tone was optimal for visual diagnosis

B: silver tone resulted in no practical problem for visual diagnosis

C: silver tone tended to result in eye fatigue and was Problematic for diagnosis

TABLE 1

| Sample No. | Silver Halide No. | Sensitizer No. | Added Amount of Sensitizer mol/mol of Ag | Reducible Silver Behenate Dispersion | Content Ratio in mol percent | Reducible Silver Dicarboxylate Dispersion | Silver Dicarboxylate | Content Ratio in mol percent | General Formulas (1-1)–(4-2) | Added Amount mol/mol of Ag | Remarks |
|---|---|---|---|---|---|---|---|---|---|---|---|
| 1 | 1a | — | — | Dispersion-1 | 100 | — | — | — | — | — | Comp. |
| 2 | 1b | — | — | Dispersion-1 | 90 | Dispersion-2 | I-286 | 10 | — | — | Inv. |
| 3 | 1c | — | — | Dispersion-1 | 70 | Dispersion-3 | I-172 | 30 | — | — | Inv. |
| 4 | 1d | 4 | $10^{-5}$ | Dispersion-1 | 50 | Dispersion-4 | I-27 | 50 | — | — | Inv. |
| 5 | 1e | 30 | $10^{-4}$ | Dispersion-1 | 50 | Dispersion-5 | I-85 | 50 | — | — | Inv. |
| 6 | 1f | 31 | $10^{-4}$ | Dispersion-1 | 50 | Dispersion-6 | I-228 | 50 | — | — | Inv. |

TABLE 1-continued

| Sample No. | Silver Halide No. | Sensitizer No. | Added Amount of Sensitizer mol/mol of Ag | Reducible Silver Behenate Dispersion | Content Ratio in mol percent | Reducible Silver Dicarboxylate Dispersion | Silver Dicarboxylate | Content Ratio in mol percent | General Formulas (1-1)–(4-2) | Added Amount mol/mol of Ag | Remarks |
|---|---|---|---|---|---|---|---|---|---|---|---|
| 7 | 1g | 33 | $10^{-4}$ | Dispersion-1 | 50 | Dispersion-4 | I-27 | 50 | — | — | Inv. |
| 8 | 1h | 30 | $8 \times 10^{-5}$ | Dispersion-1 | 50 | Dispersion-5 | I-85 | 50 | — | — | Inv. |
| | | 38 | $2 \times 10^{-5}$ | | | | | | | | |
| 9 | 1d | 4 | $10^{-4}$ | Dispersion-1 | 100 | — | — | — | 3 | $5.0 \times 10^{-4}$ | Inv. |
| 10 | 1e | 30 | $10^{-4}$ | Dispersion-1 | 100 | — | — | — | 8 | $5.0 \times 10^{-4}$ | Inv. |
| 11 | 1e | 30 | $10^{-4}$ | Dispersion-1 | 50 | Dispersion-4 | I-27 | 50 | 12 | $5.0 \times 10^{-4}$ | Inv. |
| 12 | 1e | 30 | $10^{-4}$ | Dispersion-1 | 50 | Dispersion-5 | I-85 | 50 | 46 | $5.0 \times 10^{-4}$ | Inv. |
| 13 | 1e | 30 | $10^{-4}$ | Dispersion-1 | 50 | Dispersion-6 | I-228 | 50 | 56 | $5.0 \times 10^{-4}$ | Inv. |
| 14 | 1e | 30 | $10^{-4}$ | Dispersion-1 | 40 | Dispersion-5 | I-85 | 30 | 3 | $2.5 \times 10^{-4}$ | Inv. |
| | | | | | | Dispersion-6 | I-228 | 30 | 8 | $2.5 \times 10^{-4}$ | |

Comp.: Comparative Example
Inv.: Present Invention

TABLE 2

| Sample No. | Dmin | Photographic Speed | Lightfastness ΔDmin | Storage Stability ΔDmin | Storage Stability ΔPhotographic Speed | Silver Tone | Remarks |
|---|---|---|---|---|---|---|---|
| 1 | 100 | 100 | 100 | 100 | 100 | C | Comp. |
| 2 | 95 | 102 | 68 | 73 | 77 | B | Inv. |
| 3 | 93 | 97 | 55 | 64 | 81 | B | Inv. |
| 4 | 80 | 109 | 46 | 51 | 60 | A | Inv. |
| 5 | 77 | 118 | 35 | 44 | 53 | A | Inv. |
| 6 | 79 | 116 | 38 | 46 | 57 | A | Inv. |
| 7 | 82 | 114 | 36 | 41 | 54 | A | Inv. |
| 8 | 80 | 119 | 40 | 45 | 56 | A | Inv. |
| 9 | 90 | 110 | 45 | 50 | 58 | B | Inv. |
| 10 | 89 | 109 | 43 | 48 | 59 | B | Inv. |
| 11 | 66 | 121 | 40 | 39 | 44 | A | Inv. |
| 12 | 69 | 123 | 38 | 39 | 41 | A | Inv. |
| 13 | 67 | 120 | 41 | 40 | 45 | A | Inv. |
| 14 | 68 | 122 | 39 | 42 | 43 | A | Inv. |

Comp.: Comparative Example
Inv.: Present Invention

As can be seen from Table 2, samples of the present invention resulted in lower fog and higher photographic speed, and exhibited more desired silver tone, storage stability, and lightfastness. Effects of the present invention are thus assured.

Example 2

Silver salt photothermographic dry imaging materials were prepared based on the methods below.

>>Preparation of Light-Sensitive Silver Halide Emulsions>>

The light-sensitive silver halide elusion of Example 1 was used.

<<Preparation of Reducible Silver Carboxylate>>

In 1457 g of methyl ethyl ketone (MEK) dissolved was 14.57 g of polyvinyl butyral powder (Butvar B-79, produced by Monsanto Co.). While stirring the resultant mixture employing a dissolver type homogenizer, 500 g of each of Powdered Reducible Silver Carboxylate-1 through -6 of Example 1 was gradually added and vigorously blended. Thereafter, the resultant mixture was dispersed at a peripheral rate of 13 m and a retention time of 0.5 minute, employing a media type homogenizer (produced by Gettzmann Co.), loaded with 1 mm diameter beads (produced by Toray Co.), whereby Reducible Silver Carboxylate Dispersions 21-26 were prepared.

<<Preparation of Stabilizer Solution>>

In 14.35 g of methanol, dissolved were 1.0 g of Dye Stabilizer-1 and 0.31 g of potassium acetate. The resultant solution was designated as Stabilizer Solution.

<<Preparation of Infrared Sensitizing Dye Solution>>

In 135 g of MEK, dissolved were 0.025 g of Infrared Sensitizing Dye-1, 0.034 g of Infrared Sensitizing Dye-2, 2.49 g of 2-chlorobenzoic acid, and 21.48 g of Dye Stabilizer-2. The resultant solution was designated as Ultraviolet Sensitizing Dye Solution.

<<Preparation of Reducing Agent Solution>>

In 554 g of MEK, dissolved were 143.6 g of Reducing Agent A, 0.81 g of Reducing Agent B, 7.39 g of 4-methylphthalic acid, and 0.46 g of Infrared Dye. The resultant solution was designated as Reducing Agent Solution.

<<Light-Sensitive Silver Halide Phase Inversion Emulsion>>

Each of Silver Halide Grain Dispersions 1a-1h of aforesaid Example 1 was maintained at 38° C. while stirring, and 5 ml of a 0.34 weight percent 1,2-benzisothiazoline-3-one methanol solution was added. After 40 minutes, the temperature of the resultant mixture was raised to 47° C. After 20 minutes of the temperature increase, a sodium benzenesulfonate methanol solution was added in an amount of $7.6 \times 10^{-5}$ mol per mol of silver, and 5 minutes thereafter, a Tellurium Sensitizer C methanol solution was added in an amount of $2.9\times10^{-4}$ mol per mol of silver. The resultant mixture underwent ripening over a period of 91 minutes. After one minute, 1.3 ml of a 0.8 weight percent N,N'-dihydroxy-N'-diethylmelamine methanol solution was added, and after 4 minutes, a 5-methyl-2-mercaptobenzimidazole methanol solution in an amount of $4.8\times10^{-3}$ mol per mol of silver, a 1-phenyl-2-heptyl-5-mercapto-1,3,4-triazole methanol solution in an amount of $5.4\times10^{-3}$ mol per mol of silver, and an aqueous 1-(3-methylureido)-5-mercaptotetrazole sodium salt in an amount of $8.5\times10^{-3}$ mol per mol of silver were added, whereby Silver Halide Emulsions 1a-1h were prepared.

Under high speed stirring, 250 g of a 10 weight percent behenic acid MEK solution was added to 500 g of each of above chemically sensitized Silver Halide Emulsions 1a-1h, which were dissolved at 40° C. The resultant mixture was gradually added, under high speed stirring, to 250 g of a 5 weight percent polyvinyl acetal resin (at a Tg of 75° C.)/MEK solution maintained at 21° C. Subsequently, at 21° C., aforesaid Stabilizer Solution was added in an amount of $7\times10^{-4}$ mol/mol of silver and stirred for 10 minutes. Thereafter, Infrared Sensitizing Dye Solution was added to reach a dye concentration of $7\times10^{-4}$ mol/mol of Ag and stirred for one hour. Thereafter, the temperature was lowered to 13° C. and a 2 percent Dye Stabilizer-3 MeOH solution was added in an amount of 6.5 g/mol of Ag. Subsequently, stirring was performed for 30 minutes and thereafter, the temperature was maintained at 13° C.

(Preparation of Light-Sensitive Layer Liquid Coating Compositions)

While stirring, a mixture consisting of 50 g of each of aforesaid Silver Carboxylate Dispersions 21-26 and 15.11 g of MEK was maintained at 13° C. After 30 minutes, bis(dimethylacetamido)dibromobromate (2.50 ml of a 10 percent methanol solution) was added and stirred for one hour. Further, calcium bromide (4 ml of a 10 percent methanol solution) was added and stirred for 15 minutes. After adding 10.45 g of a polyvinyl acetal resin (at a Tg of 75° C.) as a binder resin, stirring was performed for 30 minutes. Thereafter, 1.1 g of tetrachlorophthalic acid (being a 13 percent MEK solution) was added and stirred for 15 minutes. Under further continued stirring, 2.33 g of a 22 percent Desmodule N3300 (aliphatic isocyanate, produced by Mobay Co.) MEK solution, 21.2 g of Reducing Agent Solution, 3.34 g of a 12.74 percent phthalazine MEK solution, 4.0 g of Antifogging Agent (being a 7 percent MEK solution), and 3.5 g of potassium toluenethiosulfonate (being a 1 percent MEK solution) were added. Further, as shown in Table 3, compounds represented by General Formulas (1-1)-(4-2) were added. Just prior to coating, the aforesaid light-sensitive silver halide phase conversion emulsion was added to result in a coated weight of 0.145/m$^2$ and stirred, whereby Light-sensitive Layer Liquid Coating Compositions Em-15-Em-22 were obtained.

(Surface Protective Layer Liquid Coating Composition)

While stirring, added to 865 g of MEK were 96 g of cellulose acetate butyrate (CAB171-15, produced by Eastman Chemical Co.), 4.5 g of polymethyl methacrylic acid (Paraloid A-21, produced by Rohm and Haas Corp.), 1.5 g of benzotriazole, and 1.0 g of a F-based surface active agent (Surfron KH40, produced by Asahi Glass Co. Ltd.) and dissolved. Subsequently, 30 g of the matting agent dispersion described below was added while stirring and subsequently, Compound O was added to result in 0.0-45 g/m$^2$, whereby a Surface Protective Layer Liquid Coating Composition was prepared.

(Preparation of Matting Agent Dispersion)

In 42.5 g of MEK dissolved was 7.5 g of cellulose acetate butyrate (CAB171-15, produced by Eastman Chemical Co.), and 5 g of calcium carbonate (Super-Pflex 200, produced by Speciality Minerals Co.) was added. The reluctant mixture was dispersed at 8,000 rpm over a period of 30 minutes employing a dissolver type homogenizer, whereby a matting agent dispersion was obtained.

(Preparation of Back Surface Liquid Coating Composition)

While stirring, added to 830 g of MEK were 84.2 g of cellulose acetate butyrate (CAB381-20, produced by Eastman Chemical Co.) and 4.5 g of a polyester resin (Vitel PE2200B, produced by Bostic Co.) and dissolved. An infrared dye was added to the resulting solution so that the absorbance-(abs) at the absorption maximum of the infrared dye in the back surface coated sample reached 0.3, and 4.5 g of a fluorine based surface active agent (Surfron KH40, produced by Asahi Glass Co., Ltd,) and 2.3 g of a fluorenone based surface active agent (Megafag F120K, produced by Dainippon Ink and Chemicals Inc.) were added and stirring was sufficiently performed until they were dissolved. Finally, 75 g of silica (Siloid 64×6000, produced by W. R. Grace Co.) which was dispersed into MEK at a concentration of 1 weight percent, employing a dissolver type homogenizer, was added and stirred, whereby a back surface liquid coating composition was prepared.

<<Preparation of Support>>

Both sides of a polyethylene terephthalate film base (of a thickness of 175 μm), blue tinted at a density of 0.170, were subjected to corona discharge treatment of 0.15 kV·A·minute/m$^2$. Subbing Layer a was formed by applying Subbing Liquid Coating Composition A, described below, onto one side to result in a dried layer thickness of 0.2 μm. Further, Subbing Layer b was formed by applying Subbing Liquid Coating Composition B described below onto the other side to result in a dried layer thickness of 0.1 μm. Thereafter, thermal treatment was performed at 130° C. for 15 minutes in a thermal processing system oven having a film conveying device composed of plural groups of rollers.

(Subbing Liquid Coating Composition A)

Mixed were 270 g of a butyl acrylate/t-butyl acrylate/styrene/2-hydroxyethyl acrylate (at a 30/20/25/25 percent ratio) copolymer latex liquid composition (solids 30 percent), 0.6 g of a surface active agent (UL-1), and 0.5 g of methylcellulose. Further, a dispersion was added which was prepared by dispersing a mixture of 1.3 g of silica particles (Siloid 350, produced by Fuji Silysia Chemical Ltd.) with 100 g of water over a period of 30 minutes, employing an ultrasonic homogenizer (Ultrasonic Generator, at a frequency of 25 kHz and 600 W, produced by ALEX Corporation), and finally, the total volume was brought to 1,000 ml by the addition of water. The resultant dispersion was designated as Subbing Liquid Coating Composition A.

Dye Stabilizer-1

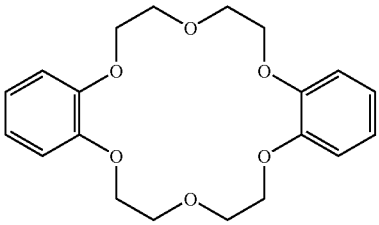

Dye Stabilizer-2

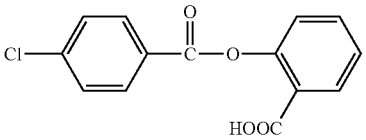

Dye Stabilizer-3

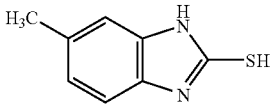

Antifogging Agent

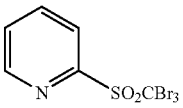

Infrared Dye

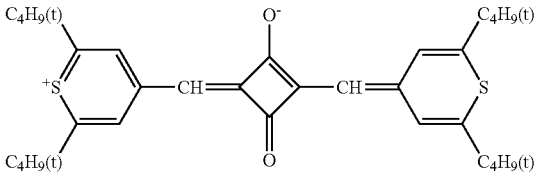

UL-1

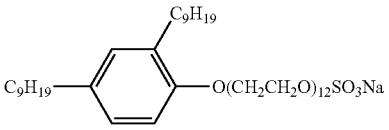

Infrared Sensitizing Dye-1

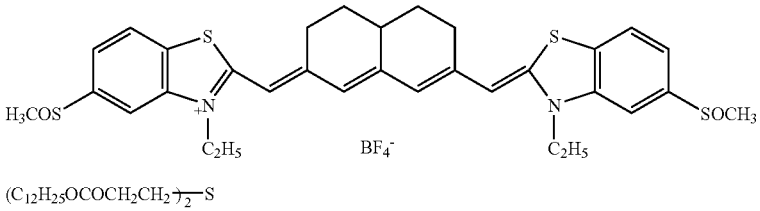

Compound O

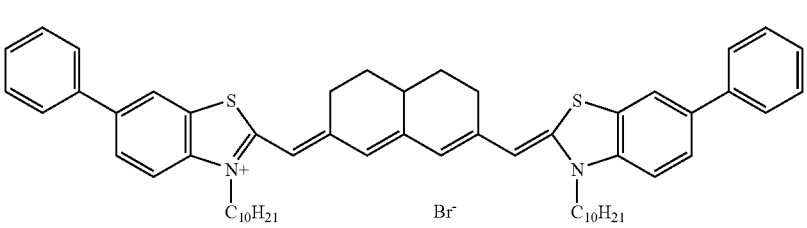

Infrared Sensitizing Dye

Reducing Agent A

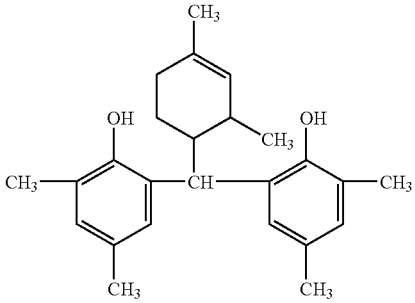

Reducing Agent B

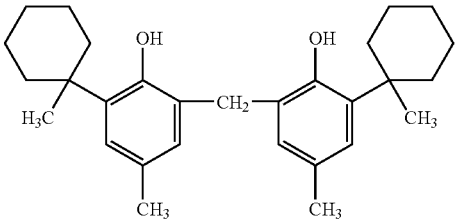

(Subbing Liquid Coating Composition B)

Mixed were 37.5 g of the colloidal tin oxide dispersion described below, 3.7 g of a butyl acrylate/t-butyl acrylatr/styrene/2-hyroxyethyl acrylate (20/30/25/25 percent ratio) copolymer latex liquid composition (30 percent solids), 14.8 g of a butyl acrylate/styrene/glycidyl methacrylate (at a 40/20/40 percent ratio) copolymer latex liquid composition, and 0.1 g of Surface Active Agent (UL-1) and the total volume was brought to 1,000 ml by the addition of water. The resultant mixture was designated as Subbing Liquid Coating Composition B.

<Colloidal Tin Oxide Dispersion>

In 2,000 ml of a water/ethanol mixed solution dissolved was 65 g of stannic chloride hydrate to result in a uniform solution. Subsequently, the resultant solution was boiled to obtain co-precipitates. The resultant precipitates were collected by decantation and washed several times with distilled water. By dripping a silver nitrate solution into distilled water which washed the precipitates, no reaction with chloride ions was confirmed. Thereafter, distilled water was added to the washed precipitates so that the total volume reached 2,000 ml. Further, 40 ml of 30 percent ammonia water was added. Thereafter, the resultant mixture was boiled to reduce the volume to 470 ml, whereby a colloidal tin oxide dispersion was prepared.

<<Preparation of Silver Salt Photothermographic Dry Imaging Material>>

Combinations on the light-sensitive layer side and combinations on the back layer side, described in Table 3, were applied on both surfaces of the aforesaid subbed support and subsequently dried, whereby a silver salt photothermographic dry imaging material was prepared.

By employing each of the light-sensitive layer liquid coating compositions and each of the surface protective layer liquid coating compositions, prepared as above, a light-sensitive layer and a surface protective layer were simultaneously coated on the support side while employing an individual extrusion coater, whereby photothermographic materials (Sample Nos. 15-22) were prepared. Incidentally, the coated silver weight was 1.3 g/m$^2$, and drying was performed at 80° C. for 5 minutes employing a drying air flow at a dew point temperature of 10° C. The coating was performed so that the dried layer thickness of the surface protective layer resulted in 1.5 μm.

(Coating of Back Surface Side)

Each of the back surface liquid coating compositions, prepared as above, was coated employing an extrusion coater to result in a dried layer thickness of 3 μm and subsequently dried. Drying was performed over a period of 5 minutes at a drying temperature of 100° C., employing a drying air flow at a dew point temperature of 10° C.

Silver salt photothermographic dry imaging materials (Samples 15-22), prepared as above, are detailed in Table 3.

Density of each of the thermally developed samples as described above was determined employing an optical densitometer (PD-82, produced by Konica Corp.), and a characteristic curve based on density D and exposure amount E was prepared. Subsequently, minimum density (Dmin equivalent to fog density) as well as photographic speed was determined. Incidentally, the photographic speed was defined as a logarithm of the reciprocal of the exposure amount to yield a density which was higher 1.0 than the minimum density, while the results were shown by relative values when Sample 1 was 100.

ΔDmin=(fog density of the sample which was subjected to accelerated aging)−(fog density of the sample which was subjected to normal aging)

ΔPhotographic speed=(photographic speed of the sample which was subjected to normal aging)−(photographic speed of the sample which was subjected to accelerated aging)

(Evaluation of Image Lightfastness)

Each of the samples which had been thermally developed employing the above methods was allowed to stand on a light source or under a fluorescent lamp for 7 days in a room at 50° C. and 55 percent relative humidity, and the optical density of the minimum density portion (Dmin portion) prior to and after exposure to the above light source was determined, and variation (ΔDmin) of the minimum density (Dmin) was obtained based on the formula below. The resultant variation was used as a measure of storage stability. In practice, the results were shown as a relative value when Sample 1 was 100.

TABLE 3

| Sample No. | Silver Halide No. | Sensitizer No. | Added Amount of Sensitizer mol/Ag | Reducible Silver Behenate Dispersion | Content Ratio mol % | Reducible Silver Dicarboxylate Dispersion | Silver Dicarboxylate | Content Ratio mol % | General Formulas (1-1)–(4-2) | Added Amount (mol/mol of Ag) | Remarks |
|---|---|---|---|---|---|---|---|---|---|---|---|
| 15 | 1a | — | — | Dispersion-21 | 100 | — | — | — | — | — | Comp. |
| 16 | 1b | — | — | Dispersion-21 | 90 | Dispersion-22 | I-286 | 10 | — | — | Inv. |
| 17 | 1c | — | — | Dispersion-21 | 70 | Dispersion-23 | I-172 | 30 | — | — | Inv. |
| 18 | 1d | 4 | $1.0 \times 10^{-5}$ | Dispersion-21 | 100 | — | — | — | 3 | $5.0 \times 10^{-4}$ | Inv. |
| 19 | 1e | 31 | $1.0 \times 10^{-4}$ | Dispersion-21 | 100 | — | — | — | 8 | $5.0 \times 10^{-4}$ | Inv. |
| 20 | 1f | 30 | $1.0 \times 10^{-4}$ | Dispersion-21 | 50 | Dispersion-26 | I-228 | 50 | 56 | $5.0 \times 10^{-4}$ | Inv. |
| 21 | 1g | 33 | $1.0 \times 10^{-4}$ | Dispersion-21 | 50 | Dispersion-24 | I-27 | 50 | 46 | $5.0 \times 10^{-4}$ | Inv. |
| 22 | 1h | 30 | $8.0 \times 10^{-5}$ | Dispersion-21 | 20 | Dispersion-25 | I-85 | 40 | 3 | $2.5 \times 10^{-4}$ | Inv. |
| | | 40 | $2.0 \times 10^{-5}$ | | | Dispersion-24 | I-27 | 40 | 8 | $2.5 \times 10^{-4}$ | |

Comp.: Comparative Example
Inv.: Present Invention

Silver salt photothermographic dry imaging materials (Samples 15-22), prepared as above, were evaluated employing the methods below.

(Measurement of Dmin and Photographic Speed)

After cutting each sample to a Hansetsu size (34.5 cm×43.0 cm), each of the cut samples was subjected to image exposure employing a semiconductor laser at 810 nm. Incidentally, the angle of the exposed plane to the laser beam was set at 80 degrees, the laser output was set at 30 mW at 45 mm/second, and high frequency superposition was outputted in a longitudinal multi mode. Thermal development was performed at 123° C. for 5 seconds, employing a heating drum so that heat was uniformly applied.

ΔDmin=(Dmin after exposure to a fluorescent lamp)−(Dmin prior to exposure to the fluorescent lamp)

Incidentally, the temperature on the light source was 50° C. under an illuminance of 8,000 Lux. The results were shown as a relative value when Sample 1 was 100.

(Evaluation of Silver Tone)

Evaluation was performed in the same manner as Example 1.

Table 4 shows the results.

TABLE 4

| Sample No. | Dmin | Photo-graphic Speed | Light-fastness ΔDmin | Storage Stability ΔDmin | Storage Stability ΔPhoto-graphic Speed | Silver Tone | Re-marks |
|---|---|---|---|---|---|---|---|
| 15 | 100 | 100 | 100 | 100 | 100 | C | Comp. |
| 16 | 94 | 101 | 77 | 88 | 94 | B | Inv. |
| 17 | 89 | 102 | 63 | 81 | 87 | B | Inv. |
| 18 | 74 | 109 | 52 | 70 | 74 | B | Inv. |
| 19 | 76 | 111 | 49 | 73 | 78 | B | Inv. |
| 20 | 44 | 125 | 32 | 58 | 63 | A | Inv. |
| 21 | 46 | 126 | 36 | 61 | 60 | A | Inv. |
| 22 | 45 | 123 | 34 | 59 | 64 | A | Inv. |

Inv.: Present Invention
Comp.: Comparative Example

From the results in Table 4, it is shown that the samples of the present invention exhibit low fog, high speed, high light fastness, and high storage stability. They also show good silver tone from visual observation.

Example 3

<<Preparation of Subbed Photographic Supports>>

A photographic support comprised of a 175 μm thick biaxially oriented polyethylene terephthalate film with blue tinted at an optical density of 0.170 (determined by Densitometer PDA-65, manufactured by Konica Corp.), which had been subjected to corona discharge treatment of 8 W·minute/$m^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the image forming layer side (designated as Subbing Layer A-1) was formed. Further, subbing liquid coating composition b-1 described below was applied, as a backing layer subbing layer, onto the opposite side at 22° C. and 100 m/minute to result in a dried layer thickness of 0.12 μm and dried at 140° C. An electrically conductive subbing layer (designated as Subbing Lower Layer B-1), which exhibited an antistatic function, was applied onto the backing layer side. The surface of Subbing Lower Layer A-1 and Subbing Lower Layer B-1 was subjected to corona discharge treatment of 8 W·minute/$m^2$. Subsequently, subbing liquid coating composition a-2 was applied onto Subbing Lower Layer A-1 was applied at 33° C. and 100 m/minute to result in a dried layer thickness of 0.03 μm and dried at 140° C. The resulting layer was designated as Subbing Upper Layer A-2. Subbing liquid coating composition b-2 described below was applied onto Subbing Lower Layer B-1 at 33° C. and 100 m/minute to results in a dried layer thickness of 0.2 μm and dried at 140° C. The resulting layer was designated as Subbing Upper Layer B-2. Thereafter, the resulting support was subjected to heat treatment at 123° C. for two minutes and wound up under the conditions of 25° C. and 50 percent relative humidity, whereby a subbed sample was prepared.

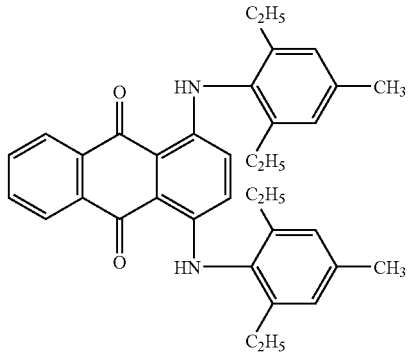

(Preparation of Water-Based Polyester A-1)

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent transesterification at 170-220° C. under a flow of nitrogen while distilling out methanol. Thereafter, 0.04 part by weight of trimethyl phosphate, 0.04 part by weight of antimony trioxide, and 6.8 parts by weight of 4-cyclohexanedicarboxylic acid were added. The resulting mixture underwent esterification at a reaction temperature of 220-235° C. while distilling out a nearly theoretical amount of water.

Thereafter, the reaction system was subjected to pressure reduction and heating over a period of one hour and was subjected to polycondensation at a final temperature of 280° C. and a maximum pressure of 133 Pa for one hour, whereby Water-soluble Polyester A-1 was synthesized. The intrinsic viscosity of the resulting Water-soluble Polyester A-1 was 0.33, the average particle diameters was 40 nm, and Mw was 80,000-100,000.

Subsequently, 850 ml of pure water was placed in a 2-liter three-necked flask fitted with stirring blades, a refluxing cooling pipe, and a thermometer, and while rotating the stirring blades, 150 g of Water-soluble Polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allow to stand overnight, whereby Water-based Polyester A-1 Solution was prepared.

(Preparation of Modified Water-Based Polyester B-1 and B-2 Solutions)

Placed in a 3-liter four-necked flask fitted with stirring blades, a reflux cooling pipe, a thermometer, and a dripping funnel was 1,900 ml of the aforesaid 15 percent by weight Water-based Polyester A-1 Solution, and the interior temperature was raised to 80° C., while rotating the stirring blades. Into this added was 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby Modified Water-based Polyesters B-1 Solution (vinyl based component modification ratio of 20 percent by weight) at a solid concentration of 18 percent by weight was obtained.

Modified Water-based Polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene:glycidyl methacrylate: acetacetoxyethyl methacrylate:n-butyl acrylate=39.5:40:20: 0.5.

(Preparation of Acryl Based Polymer Latexes C-1-C-3)

Acryl Based Polymer Latexes C-1-C-3 having the monomer compositions shown in the following table were synthesized employing emulsion polymerization. All the solid concentrations were adjusted to 30 percent by weight.

TABLE

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate:acetacetoxyethyl methacrylate = 40:40:20 | 50 |

<<Water Based Polymers Containing Polyvinyl Alcohol Units>>

D-1: PVA-617 (Water Dispersion (5 percent solids): degree of saponification of 95, manufactured by Kuraray Co., Ltd.)

(Subbing Lower Layer Liquid Coating Composition a-1 on Image Forming Layer Side)

| | |
|---|---|
| Acryl Based Polymer Larex C-3 (30 percent solids) | 70.0 g |
| Water dispersion of ethoxylated alcohol and ethylene homopolymer (10 percent solids) | 5.0 g |
| Surface Active Agent (A) | 0.1 g |

A coating liquid composition was prepared by adding water to make 1,000 ml.

<<Image Forming Layer Side Subbing Upper Layer Liquid Coating Composition a-2>>

| | |
|---|---|
| Modified Water-based Polyester B-2 (18 percent by weight) | 30.0 g |
| Surface Active Agent (A) | 0.1 g |
| Spherical silica matting agent (Sea Hoster KE-P50, manufactured by Nippon Shokubai Co., Ltd.) | 0.04 g |

A coating liquid composition was prepared by adding water to make 1,000 ml.

(Backing Layer Side Subbing Lower Layer Liquid Coating Composition b-1)

| | |
|---|---|
| Acryl Based Polymer Late C-1 (30 percent solids) | 30.0 g |
| Acryl Based Polymer Late C-2 (30 percent solids) | 7.6 g |
| $SnO_2$ sol | 180 g |

(the solid concentration of $SnO_2$ sol synthesized employing the method described in Example 1 of Japanese Patent Publication 35-6616 was heated and concentrated to reach a solid concentration of 10 percent by weight, and subsequently, the pH was adjusted to 10 by the addition of ammonia water)

| | |
|---|---|
| Surface Active Agent (A) | 0.5 g |
| 5 percent by weight of PVA-613 (PVA, manufactured by Kuraray Co., Ltd.) | 0.4 g |

A coating liquid composition was prepared by adding water to make 1,000 ml.

(Backing Layer Side Subbing Upper Layer Liquid Coatings Composition b-2)

| | |
|---|---|
| Modified Water-based Polyester B-1 (18 percent by weight) | 145.0 g |
| Spherical silica matting agent (Sea Hoster KE-P50, manufactured by Nippon Shokubai Co., Ltd.) | 0.2 g |
| Surface Active Agent (A) | 0.1 g |

A liquid coating composition was prepared by adding water to make 1,000 ml.

Incidentally, a back coat layer and a back coat layer protective layer of the compositions described below were applied onto Subbing Upper Layer A-2 of the aforesaid support provided with the subbing layer.

Surface Active Agent (A)

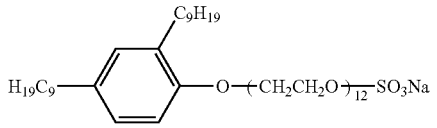

<Preparation of Back Coat Layer Liquid Coating Composition>

While stirring, added to 830 g of methyl ethyl ketone (MEK) were 84.2 g of cellulose acetate propionate (CAP482-20, produced by Eastman Chemical Co.) and 4.5 g of a polyester resin (Vitel PE2200B, produced by Bostic Co.), and dissolved. Subsequently, 0.30 g of Infrared Dye 1 below was added to the resultant solution, and 4.5 g of a fluorine based surface active agent (Surfron KH40, produced by Asahi Glass Co., Ltd.), were dissolved in 43.2 g of methanol, and 2.3 g of a fluorine based surface active agent (Megafag F120K, produced by Dainippon Ink and Chemicals, Inc.) were added and vigorously stirred until they were dissolved. Subsequently, 2.5 g of oleyl oleate was added thereto while stirring, whereby a back coat layer liquid coating composition was prepared.

Infrared Dye 1

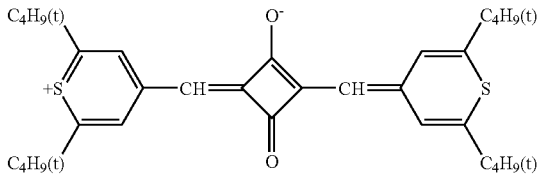

<Preparation of Back Coat Layer Protective Layer (Surface Protective Layer) Liquid Coating Composition>

A back coat layer protective layer was prepared at the composition ratio describe below in the same manner as the back coat layer liquid coating composition. A one percent silica in MEK was dispersed employing a dissolver type homogenizer and finally added.

| | |
|---|---|
| Cellulose acetate propionate (CAP482-20, produced by Eastman Chemical Co., Ltd.) (10 percent MEK solution) | 15 g |
| Monodispersed silica of a degree of monodispersion of 15 percent (at an average particle diameter of 10 μm) (surface-treated with 1 percent aluminum with respect to the total weight of silica) | 0.03 g |
| Monodispersed spherical silica at a degree of monodispersion of 15 percent (at an average diameter of 12 μm) | 0.01 g |
| $C_8F_{17}(CH_2CH_2O)_{12}C_8F_{17}$ | 0.05 g |
| Fluorine based surface active agent (SF17) | 0.01 g |
| Stearic acid | 0.1 g |
| Oleyl oleate | 0.1 g |
| α-Alumina (at a Mohs hardness of 9) | 0.1 g |

(Preparation of Light-Sensitive Halide Emulsion A1)

| | |
|---|---|
| (A1) | |
| Phenylcarbamoylated gelatin | 88.3 g |
| 10 percent aqueous Compound (AO-1) methanol solution | 10 ml |
| Potassium bromide | 0.32 g |
| Water to make | 5429 ml |
| (B1) | |
| 0.67 mol/L aqueous silver nitrate solution | 2635 ml |
| (C1) | |
| Potassium bromide | 50.69 g |
| Potassium iodide | 2.66 g |
| Water to make | 660 ml |
| (D1) | |
| Potassium bromide | 151.6 g |
| Potassium iodide | 7.67 g |
| Potassium hexachloroirridate (IV) (1 percent aqueous solution) | 0.93 ml |
| Potassium hexacyanoiron (II) | 0.004 g |
| Potassium hexachloroosmium (IV) | 0.004 g |
| Water to make | 1982 ml |

-continued

| | |
|---|---|
| (E1) | |
| 0.4 mol/L aqueous potassium bromide solution | an amount to achieve the silver potential below |
| (F1) | |
| Potassium hydroxide | 0.71 g |
| Water to make | 20 ml |
| (G1) | |
| 56 percent aqueous acetic acid solution | 18.0 ml |
| (H1) | |
| Sodium carbonate anhydride | 1.72 g |
| Water to make | 151 ml |

AO-1: $HO(CH_2CH_2O)_n[CH(CH_3)CH_2O]_{17}(CH_2CH_2O)_mH$ (m + n = 5 − 7)

Employing the stirrer shown in Japanese Patent Publication No. 58-58288, 1/4 of Solution (B1) and all of Solution (C1) were added to Solution (A1) at 20° C. over a period of 4 minutes 45 seconds by employing a double-jet method while controlling pAg to 8.09, whereby nuclei were formed. After one minute, all of Solution (F1) was added. During this, pAg was suitably controlled employing (E1). After 6 minutes, 3/4 of Solution (B1) and all of Solution (D1) were added to Solution (A1) at 20° C. over a period of 14 minutes 15 seconds by employing a double-jet method while controlling pAg to 8.09. After stirring for 5 minutes, the temperature was lowered to 40° C., and all of Solution (G1) was added, whereby the silver halide emulsion was sedimented. The supernatant was removed while leaving 2,000 ml of the sedimented portion to which 10 L of water was added. After stirring, the silver halide emulsion was re-sedimented. The supernatant was removed while leaving 1,500 ml of the sedimented portion to which 10 L of water was added. After stirring, the silver halide was again sedimented. The supernatant was removed while leaving 1500 ml of the sedimented portion. Thereafter, Solution (H1) was added and the temperature was raised to 60° C. Stirring was continued for an additional 120 minutes. Finally, the pH was controlled to reach 5.8 and water was added so that the volume per mol of Ag reached 1,161 g, resulting Light-sensitive Silver Halide Emulsion A.

This emulsion was constituted of monodispersed cubic silver iodobromide grains of an average grain size of 25 nm, a grain size variation coefficient of 12 percent, and a [100] plane ratio of 92 percent (at a content ratio of 3.5 mol percent AgI).

(Preparation of Light-Sensitive Silver Halide Emulsion A2)

Light-sensitive Silver Halide Emulsion A2 was prepared in the same manner as above Light-sensitive Silver Halide Emulsion A1, except that 5 ml of a 0.4 percent aqueous lead bromide solution was added to Solution D1.

Incidentally, this emulsion was constituted of monodispersed cubic silver iodobromide grains of an average grain size of 25 nm, a grain size variation coefficient of 12 percent, and a [100] plane ratio of 92 percent (at a content ratio of 3.5 mol percent AgI).

(Preparation of Light-Sensitive Silver Halide Emulsion A3)

Light-sensitive Silver Halide Emulsion A3 was prepared in the same manner as above Light-sensitive Silver Halide Emulsion A1, except that after formation of nuclei, all of Solution F1 was added and subsequently, 40 ml of a 5 percent aqueous 4-hydroxy-6-methyl-1,3,3a,7-tetraazaindene solution was added.

Incidentally, this emulsion was constituted of monodispersed cubic silver iodobromide grains of an average grain size of 25 nm, a grain size variation coefficient of 12 percent, and a [100] plane ratio of 92 percent (at a content ratio of 3.5 mol percent AgI).

(Preparation of Light-Sensitive Silver Halide Emulsion A4)

Light-sensitive Silver Halide Emulsion A4 was prepared in the same manner as above Light-sensitive Silver Halide Emulsion A1, except that after formation of nuclei, all of Solution F1 was added and subsequently, 4 ml of a 0.1 percent compound below (ETTU) methanol solution was added.

Incidentally, this emulsion was constituted of monodispersed cubic silver iodobromide grains of an average grain size of 25 nm, a grain size variation coefficient of 12 percent, and a [100] plane ratio of 92 percent (at a content ratio of 3.5 mol percent AgI).

ETTU

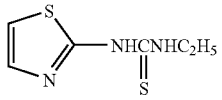

(Preparation of Light-Sensitive Silver Halide Emulsion A5)

Light-sensitive Silver Halide Emulsion A5 was prepared in the same manner as above Light-sensitive Silver Halide Emulsion A1, except that after formation of nuclei, all of Solution F1 was added and subsequently, 4 ml of a 0.1 percent 1,2-benzisothiazoline methanol solution was added.

This emulsion was constituted of monodispersed cubic silver iodobromide grains of an average grain size of 25 nm, a grain size variation coefficient of 12 percent, and a [100] plane ratio of 92 percent (at a content ratio of 3.5 mol percent AgI).

<Preparation of Light-Sensitive Silver Halide Emulsion B1)

Light-sensitive Silver Halide Emulsion B1 was prepared in the same manner as above Light-sensitive Silver Halide Emulsion A1, except that the temperature during addition employing the double-jet mixing method was altered to 45° C. This emulsion was constituted of monodispersed cubic silver iodobromide grains of an average grain size of 55 nm, a grain size variation coefficient of 12 percent, and a [100] plane ratio of 92 percent (at a content ratio of 3.5 mol percent AgI).

<Preparation of Light-Sensitive Silver Halide Emulsion B2)

Light-sensitive Silver Halide Emulsion B2 was prepared in the same manner as above Light-sensitive Silver Halide Emulsion B1, except that after formation of nuclei, all of Solution F1 was added, and subsequently, 4 ml of a 0.1 percent the above compound (ETTU) methanol solution was added. This emulsion was constituted of monodispersed cubic silver iodobromide grains of an average grain size of 55 nm, a grain size variation coefficient of 12 percent, and a [100] plane ratio of 92 percent (at a content ratio of 3.5 mol percent AgI).

<Preparation of Powdered Organic Silver Salt A>

In 4,720 ml of pure water at 80° C. dissolved was 259.9 g of behenic acid. Subsequently, 540.2 ml of a 5 mol/L aqueous sodium hydroxide solution was added. After adding 6.9 ml of concentrated nitric acid, the temperature was lowered to 55° C., whereby a fatty acid sodium salt solution was obtained. While maintaining the above fatty acid sodium salt solution at 55° C., 36.2 g of Light-sensitive Silver Halide Emulsion A1, 9.1 g of Silver Halide Emulsion B1, and 450 ml of water were added and the resultant mixture was stirred for 5 minutes.

Subsequently, 468.4 ml of a 1 mol/L silver nitrate solution was added over a period of two minutes and was stirred for 10 minutes, whereby an organic silver salt dispersion was obtained. Thereafter, the resultant organic silver salt dispersion was transferred to washing to which deionized water was added. After stirring, the resultant mixture was allowed to stand and the organic silver salt dispersion was allowed to float and be separated, and water soluble salts in the lower portion were removed. Thereafter, washing with deionized water was repeated until the electric conductivity of the effluent reached 2 μS/cm. After centrifugal dehydration, the resultant organic silver salt cake was dried to reach a moisture content of 0.1 percent, employing a flash jet dryer (produced by Seishin Kikaku Co.) under an ambience of nitrogen gas and driving conditions (65° C. at the inlet and 40° C. at the outlet) of dryer hot air temperature, whereby Dried Powdered Organic Silver Salt A was obtained. Heat Developable Light-sensitive Materials (1-16) (described below) were analyzed employing an electron microscope, resulting in tabular particles of an average particle diameter (being the equivalent circular diameter) of 0.08 μm, an aspect ratio of 5, and a degree of monodispersibility of 10 percent.

The moisture content of the organic silver salt compositions was determined employing an infrared moisture meter.

(Preparation of Powdered Organic Silver Salt P1-1-A1)

Preparation was performed in the same manner as for aforesaid Powdered Organic Silver Salt A, except that 259.9 g of behenic acid was replaced with 259.9 g of P1-1.

(Preparation of Powdered Organic Silver Salt P1-1-A2)

Preparation was performed in the same manner as for aforesaid Powdered Organic Silver Salt A, except that 259.9 g of behenic acid was replaced with 259.9 g of P1-1, 36.2 g of Light-sensitive Silver Halide A1 was replaced with 36.2 g of Light-sensitive Silver Halide A2, and 9.1 g of Light-sensitive Silver Halide B1 was replaced with 9.1 g of Light-sensitive Silver Halide B2.

(Preparation of Powdered Organic Silver Salt P1-1-A3)

Preparation was performed in the same manner as aforesaid Powdered Organic Silver Salt P1-1-A2, except that 362 g of Light-sensitive Silver Halide A2 was replaced with 36.2 g of Light-sensitive Silver Halide A3.

(Preparation of Powdered Organic Silver Salt P1-1-A4)

Preparation was performed in the same manner as for aforesaid Powdered Organic Silver Salt P1-1-A2, except that 362 g of Light-sensitive Silver Halide A2 was replaced with 36.2 g of Light-sensitive Silver Halide A4.

(Preparation of Powdered Organic Silver Salt P1-1-A5)

Preparation was performed in the same manner as for aforesaid Powdered Organic Silver Salt P1-1-A2, except that 362 g of Light-sensitive Silver Halide A2 was replaced with 36.2 g of Light-sensitive Silver Halide A5.

(Preparation of Powdered Organic Silver Salt P1-2-A4)

Preparation was performed in the same manner as for aforesaid Powdered Organic Silver Salt P1-1-A4, except that P1-1 was replaced with P1-2.

(Preparation of Powdered Organic Silver Salt P1-3-A4)

Preparation was performed in the same manner as for aforesaid Powdered Organic Silver Salt P1-1-A4, except that P1-1 was replaced with P1-3.

(Preparation of Powdered Organic Silver Salt P1-4-A4)

Preparation was performed in the same manner as for aforesaid Powdered Organic Silver Salt P1-1-A4, except that P1-1 was replaced with P1-4.

(Preparation of Powdered Organic Silver Salt P1-5-A4)

Preparation was performed in the same manner as for aforesaid Powdered Organic Silver Salt P1-1-A4, except that P1-1 was replaced with P1-5.

(Synthesis of Polyurethanes P1-1-P1-5)

In a vessel fitted with a refluxing cooler and a stirrer, of which interior was replaced with nitrogen, the diol component described below was dissolved in a 30 percent cyclohexane solution at 60° C. under a nitrogen flow. Subsequently dibutyl tin laurate was added to result in 60 ppm and dissolved over a period of 15 minutes. Further, the polyisocyanate compounds described below were added, and the resultant mixture underwent reaction at 90° C. for 6 hours, whereby Polyurethane Resin Solutions P1-P1-5 were obtained. The molecular weight and Tg of the resultant polyurethanes are listed below.

P1-1: 2-2-bis(hydroxylmethyl)propionic acid/diphenylmethane diisocyanate at 50/50 (mol ratio) of a weight average molecular weight of 36,000, and a Tg of 120° C.

P1-2: 2-2-bis(hydroxylmethyl)propionic acid/hexamethylene diisocyanate at 50/50 (mol ratio) of a weight average molecular weight of 38,000, and a Tg of 100° C.

P1-3: 2-2-bis(hydroxylmethyl)propionic acid/trilene diisocyanate at 50/50 (mol ratio) of a weight average molecular weight of 37,000, and a Tg of 110° C.

P1-4: 2-2-bis(hydroxylmethyl)propionic acid/dimer diol/hydrogenated bisphenol A/sulfoisophthalic acid ethylene oxide addition product/diphenylmethane diisocyanate at 50/20/30/2/100 (mol ratio) of a weight average molecular weight of 42,000, and a Tg of 110° C.

P1-5: 2-2-bis(hydroxylmethyl)propionic acid/dimer diol/hydrogenated bisphenol/sulfoisophthalic acid ethylene oxide addition product/diphenylmethane diisocyanate at 50/5/45/2/100 (mol ratio) of a weight average molecular weight of 41,000, and a Tg of 130° C.

<Preparation of Preliminary Dispersion A>

In 1,457 g of MEK dissolved was 14.57 g of $SO_3K$ containing polyvinyl butyral (at a Tg of 75° C. and containing a —$SO_3K$ group in an amount of 0.2 millimol/g). While stirring employing Dissolver DISPERMAT Type CA-40M, produced by VMA-GETZMANN Co., 500 g of the aforesaid Powdered Organic Silver Salt A was added, whereby Preliminary Dispersion A was prepared.

<Preparation of Preliminary Dispersion P1-1-A1>

Preparation was performed in the same manner as for Preliminary Dispersion A, except that 500 g of Organic Silver Salt A was replaced with 500 g of Organic Silver Salt P1-1-A1.

<Preparation of Preliminary Dispersion P1-1-A2>

Preparation was performed in the same manner as for Preliminary Dispersion A, except that 500 g of Organic Silver Salt A was replaced with 500 g of Organic Silver Salt P1-1-A2.

<Preparation of Preliminary Dispersion P1-1-A3>

Preparation was performed in the same manner as for Preliminary Dispersion A, except that 500 g of Organic Silver Salt A was replaced with 500 g of Organic Silver Salt P1-1-A3.

<Preparation of Preliminary Dispersion P1-1-A4>

Preparation was performed in the same manner as for Preliminary Dispersion A, except that 500 g of Organic Silver Salt A was replaced with 500 g of Organic Silver Salt P1-1-A4.

<Preparation of Preliminary Dispersion P1-1-A5>

Preparation was performed in the same manner as for Preliminary Dispersion A, except that 500 g of Organic Silver Salt A was replaced with 500 g of Organic Silver Salt P1-1-A5.

<Preparation of Preliminary Dispersion P1-2-A4>

Preparation was performed in the same manner as for Preliminary Dispersion P1-1-A4, except that 500 g of Organic Silver Salt P1-1 A4 was replaced with 500 g of Organic Silver Salt P1-2-A4.

<Preparation of Preliminary Dispersion P1-3-A4>

Preparation was performed in the same manner as for Preliminary Dispersion P1-1-A4, except that 500 g of Organic Silver Salt P1-1-A4 was replaced with 500 g of Organic Silver Salt P1-3-A4.

<Preparation of Preliminary Dispersion P1-4-A4>

Preparation was performed in the same manner as for Preliminary Dispersion P1-1-A4, except that 500 g of Organic Silver Salt P1-1-A4 was replaced with 500 g of Organic Silver Salt P1-4-A4.

<Preparation of Preliminary Dispersion P1-5-A4>

Preparation was performed in the same manner as for Preliminary Dispersion P1-1-A4, except that 500 g of Organic Silver Salt P1-1-A4 was replaced with 500 g of Organic Silver Salt P1-5-A4.

<Preparation of Light-Sensitive Emulsion Dispersion A>

Preliminary Dispersion A was fed to a media type homogenizer DISPERMAT Type SL-C12EX (produced by VMA-GETZMANN Co.) in which 80 percent of the interior volume was filled with 0.5 mm diameter zirconia beads (Torecerum, manufactured by Toray Co.) and dispersed at a peripheral rate of 8 m/second so that the retention time in the mill reached 1.5 minutes, whereby Light-sensitive Emulsion Dispersion A was prepared.

<Preparation of Light-Sensitive Emulsion Dispersions P1-1-A1-P1-1-A5, P1-2-A4, P1-3-A4, P1-4-A4, and P1-5-A4>

Preparation was performed in the same manner as for Light-sensitive Emulsion Dispersion A, except that Preliminary Dispersion A was replaced with each of Preliminary Dispersions P1-1-A1-P1-1-A5, P1-2-A4, P1-3-A4, P1-4-A4, and P1-5-A4.

<Preparation of Stabilizer Solution>

In 4.97 g of methanol were dissolved 1.0 g of a stabilizer and 0.31 g of potassium acetate.

<Preparation of Infrared Sensitizing Dye Solution A>

In a dark place, 9.6 mg of Infrared Sensitizing Dye 1, 9.6 mg of Sensitizing Dye 2, 1.488 g of 2-chlorobenzoic acid, 2.779 g of Stabilizer 2, and 365 mg of 5-methyl-2-mercaptobenzimidazole were dissolved in 31.3 ml of MEK.

<Preparation of Addition Solution a>

In 110 g of MEK dissolved were a reducing agent (the amount of the reducing agent represented by General Formulas (1) and (2) shown in Table 2), 0.159 g of Compound (YA-1), represented by General Formula (YB), 0.159 g of cyan forming leuco dye CA-12, 1.54 g of 4-methylphthalic acid, and 0.48 g of aforesaid Infrared Dye. The resultant solution was designated as Addition Solution a.

<Preparation of Addition Solution b>

In 40.9 g of MEK dissolved were 1.56 g of Antifogging Agent 2, 0.5 g of Antifogging Agent 3, 0.5 g of Antifogging Agent 4, 0.5 g of Antifogging Agent 5, and 3.43 g of phthalazine. The resultant solution was designated as Addition Solution b.

<Preparation of Addition Solution c>

In 39.99 g of MEK dissolved was 0.01 g of Silver Saving Agent (A1). The resultant solution was designated as Addition Solution c.

<Preparation of Addition Solution d>

In 9.9 g of MEK dissolved was 0.1 g of Supersensitizer 1. The resultant solution was designated as Addition Solution d.

<Preparation of Addition Solution e>

In 9.0 g of MEK dissolved were 0.5 g of potassium p-toluenethiosulfonate and 0.5 g of Antifogging Agent 6. The resultant solution was designated as Addition Solution e.

<Preparation of Addition Solution f>

In 9.0 g of MEK dissolved was 1.0 g of an antifogging agent containing vinylsulfone [$(CH_2{=}CH{-}SO_2CH_2)_2CHOH$]. The resultant solution was designated as Addition Solution f.

<Preparation of Image Forming Layer Liquid Coating Composition>

Under an ambience of inactive gas (97 percent nitrogen), while stirring, 1,000 μl of Chemical Sensitizer S-5 (a 0.5 percent methanol solution) was added to a mixture of 50 g of the aforesaid light-sensitive emulsion dispersion (described in Table 3) and 15.11 g of MEK, while maintained at 21° C., and after two minutes, 390 μl of Antifogging Agent 1 (a 10 percent methanol solution) was added and stirred for one hour. Further, 494 μl of calcium bromide (a 10 percent methanol solution) was added and stirred for 10 minutes. Subsequently, Gold Sensitizer Au-5 in an amount equivalent to 1/20 mol of the aforesaid organic chemical sensitizer was added and stirred for an additional 20 minutes. Subsequently, 167 μl of Stabilizer Solution was added and stirred for 10 minutes. Thereafter, 1.32 g of aforesaid Infrared Sensitizing Dye Solution A was added and stirred for one hour. The temperature was then lowered to 13° C., and stirring was performed for 30 minutes. While the temperature was maintained at 13° C., 0.5 g of Addition Solution d, 0.5 g of Addition Solution e, 0.5 g of Addition Solution f, and 13.31 g of the binder employed in Preliminary Dispersion A was added and stirred for 30 minutes. Thereafter, 1.084 g of tetrachlorophthalic acid (a 9.4 percent MEK solution) was added and stirred for 15 minutes. While stirring, 12.43 g of Addition Solution a, 1.6 ml of aliphatic isocyanate of Desmodur N3300, manufactured by Mobay Co. (a 10 percent MEK solution), 4.27 g of Addition Solution b, and 4.0 g of Addition Solution c were successively added, whereby an image forming layer liquid coating composition was obtained.

Structures of additives employed to prepare the stabilizer solution, and each of the liquid coating composition as well as to prepare the image forming layer liquid coating composition are shown below.

Stabilizer 1

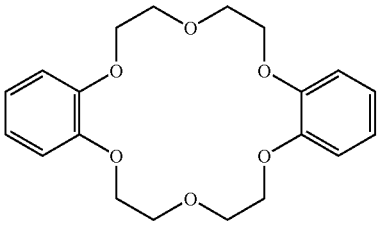

Stabilizer 2

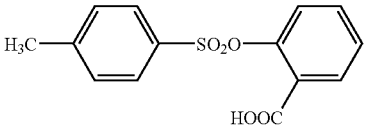

Antifogging Agent 2

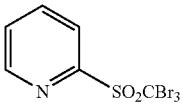

Antifogging Agent 6

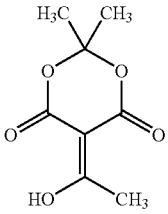

Infrared Sensitizing Dye 1

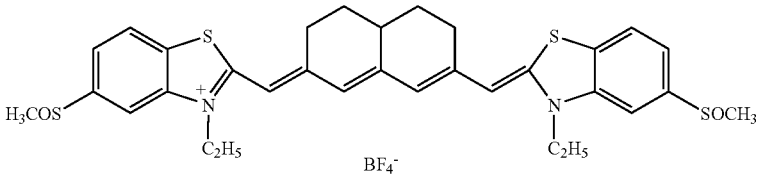

-continued
Infrared Sensitizing Dye 2
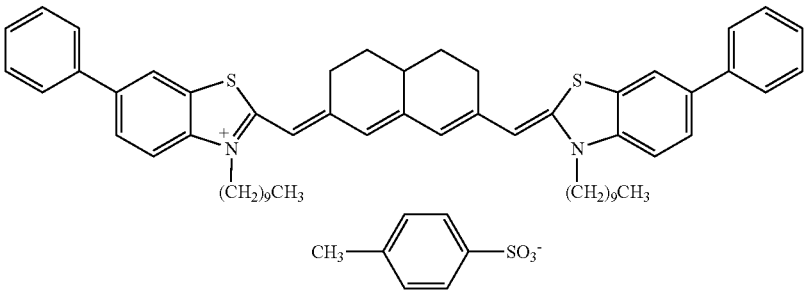
Supersensitizer 1
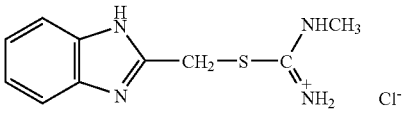
Reducing Agent A
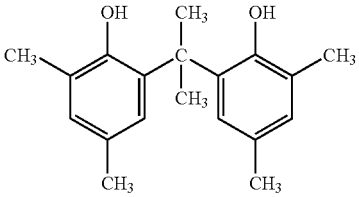
Chemical Sensitizer S-5
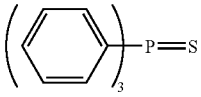
AU-5
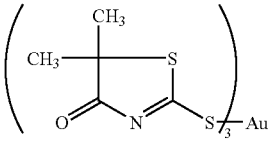
Antifogging Agent 1
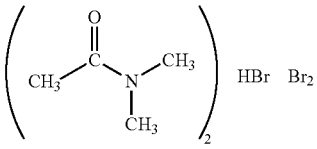
Antifogging Agent 3
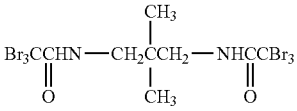
Antifogging Agent 4
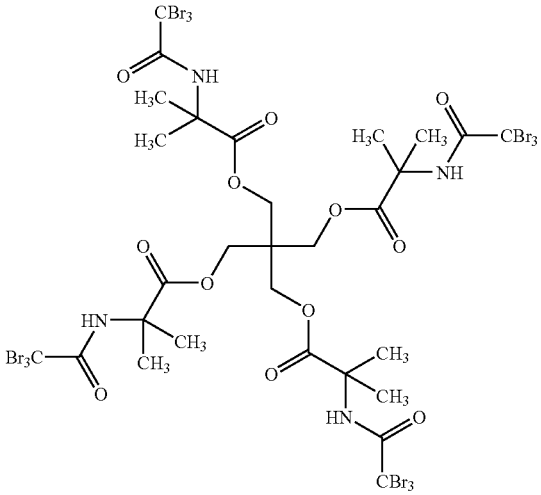
Silver Saving Agent (A1)
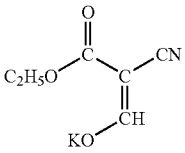
Antifogging Agent 5
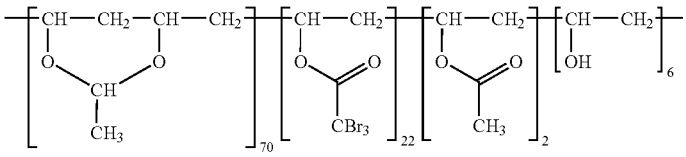
Number average molecular weight 20,000

<Preparation of Image Forming Layer Protective Layer Lower Layer (Surface Protective Layer Lower Layer) Liquid Coating Composition>

| | |
|---|---|
| Acetone | 5 g |
| MEK | 21 g |
| Cellulose acetate propionate (CAP-141-20 at a glass transition temperature of 190° C., produced by Eastman Chemical Co.) | 2.3 g |
| Methanol | 7 g |
| Phthalazine | 0.25 g |
| Monodipsersed silica of a degree of monodispersibility of 15 percent (at an average particle diameter of 3 μm) (1 percent of the total silica weight was subjected to aluminum surface treatment) | 0.140 |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorine based surface active agent (SF-17, described above) | 0.01 g |
| Stearic acid | 0.1 g |
| Butyl stearate | 0.1 g |
| α-Alumina (at a Mohs hardness of 9) | 0.1 g |

<Preparation of Image Forming Layer Protective Layer Upper Layer (Surface Protective Layer Upper Layer) Liquid Coating Composition>

| | |
|---|---|
| Acetone | 5 g |
| Methyl ethyl ketone | 21 g |
| Cellulose acetate propionate (CAP-141-20 at a glass transition temperature of 190° C., produced by Eastman Chemical Co.) | 2.3 g |
| Methanol | 7 g |
| Phthalazine | 0.25 g |
| Monodipsersed silica of a degree of monodispersibility of 15 percent (at an average particle diameter of 3 μm) (1 percent of the total silica weight was subjected to aluminum surface treatment) | 0.140 g |
| $CH_2{=}CHSO_2CH_2CH_2OCH_2CH_2SO_2CH{=}CH_2$ | 0.035 g |
| $C_{12}F_{25}(CH_2CH_2O)_{10}C_{12}F_{25}$ | 0.01 g |
| Fluorine based surface active agent (SF-17, described above) | 0.01 g |
| Stearic acid | 0.1 g |
| Butyl stearate | 0.1 g |
| α-Alumina (of a Mohs hardness of 9) | 0.1 g |

Image Forming Layer Protective Layer Upper Layer and Lower Layer were prepared at the above composition ratio in the same manner as Back Coat layer Liquid Coating Composition. Silica was dispersed was prepared by dispersing at a concentration of 1 percent in MEK employing a dissolver type homogenizer in the same manner as Back Coat Layer Protective Layer Liquid Coating Composition. The resultant silica dispersion was finally added and stirred, whereby Image Forming Layer Protective Layer Upper Layer and Lower Layer were obtained.

<Preparation of Heat Developable Light-Sensitive Materials>

Back Coat Layer Liquid Coating Composition and Back Coat Layer Protective Layer Liquid Coating Composition, prepared as above, were applied onto Subbing Upper Layer B-2 at a coating rate of 50 m/minute to result in a dried layer thickness of 3.5 μm, respectively, employing an extrusion coater. Incidentally, drying was performed over a period of 5 minutes, employing a drying air flow at a drying temperature of 100° C. and a dew point temperature of 10° C.

Aforesaid Image Forming Layer Liquid Coating Composition and Image Forming Layer Protective Layer (Surface Protective Layer) Liquid Coating Composition were simultaneously applied onto Subbing Upper Layer A-2 at a coating rate of 50 m/minute, employing an extrusion coater, whereby Light-sensitive Material Samples 1-1-1-16, listed in Table 2, were prepared. Coating was performed to result in a coated silver weight of 1.2 g/m$^2$ for the image forming layer, a dried layer thickness of 3.0 μm (1.5 μm for the surface protective layer upper layer and 1.5 μm for the surface protective layer lower layer) for the image forming layer protective layer, and subsequently, drying was performed over a period of 10 minutes, employing a drying air flow at a drying temperature of 75° C. and a dew point temperature of 10° C.

The pH and Bekk smoothness of each of the layer surfaces on the image forming side of the resultant heat developable materials (Samples 1-16) were 5.3 and 5,000 seconds, respectively. Further, the surface roughness of each of Samples (1-1)-(1-16) was determined, resulting in Rz(E)/Rz(B)=0.40, Rz=1.4 μm, while Rz(B) was 3.5 μm.

Sample 1-14 was prepared in the same manner as Sample 1-4, except that fluorine based surface active agent SF-17 of Back Coat Layer Protective Layer and Image Forming Layer Protective Layer (Upper Layer as well as Lower Layer) was replaced with $C_8F_{17}SO_3Li$.

Sample 1-15 was prepared in the same manner as Sample 1-4, except that $SO_3K$ group containing polyvinyl butyral (at a Tg of 75° C., containing $SO_3K$ in an amount of 0.2 millimol/g) which was employed as a binder for the image forming layer during preparation of Preliminary Dispersion P1-1-A4 was replaced with $SO_3K$ group containing polyvinyl butyral (at a Tg of 65° C., containing $SO_3K$ in an amount of 0.2 millimol/g).

<Exposure and Development>

Heat Developable Light-sensitive Material Samples 1-1-1-16, prepared as above, were cut into Hansetsu Size (34.5 cm×43.0 cm) and were packaged employing the packaging material below at 25° C. and 50 percent relative humidity. The packaged materials were stored at normal temperature for two weeks and evaluated as described below.

(Packaging Material)

A barrier bag of PET 10 μm/PE 12 μm/aluminum foil 9 μm/Ny 15 μm/polyethylene containing 3 percent carbon 50 μm at an oxygen permeability of 0 ml/atm·m$^2$·25° C.·day and a water permeability of 0 g/atm·m$^2$·25° C.·day. A paper tray was used.

(Evaluation of Samples)

Evaluation was performed as described below, employing the thermal processor shown in FIG. 1.

Each of Heat Developable Light-sensitive Material Samples was picked up from a film tray and conveyed to a laser exposure section. Thereafter, above Sample was subjected to laser scanning exposure on the image forming layer surface side, employing an exposure device which employed, as a laser beam source, a semiconductor laser (at a maximum output of 70 mW by integrating two beams, each having a maximum output of 35 mW) which was subjected to a longitudinal multi-mode of a wavelength of 810 nm at high frequency superposition. During the exposure, images were formed at an angle of 75 degrees between the exposed surface of Heat Developable Light-sensitive Material and the exposure laser beam. Thereafter, exposed Heat Developable Light-sensitive Material was conveyed to a heat development section, was thermally developed at 123° C. for 13.5 seconds in such a manner that the surface of a heating drum was brought into contact with the protective layer on the image forming layer side of above Heat Developable Light-sensitive Material, and subsequently ejected out of the apparatus. A heating drum was employed which had been subjected to surface treatment employing Teflon (a registered trade name). The conveyance rate from the light-sensitive material feeding section to the image exposure section, at the image exposure section, and at the heat development section was 25 m/second. Incidentally, exposure and development were performed in a room at 23° C. and 50 percent relative humidity. Exposure was carried out in steps in such a manner that the amount of exposure energy was decreased by 0.05 in terms of log E from the maximum-output.

Example 4

<<Preparation of Subbed Photographic Support>>

<Preparation of Back Coat layer Liquid Coating Composition>

While stirring, added to 830 g of methyl ethyl ketone (MEK) were 84.2 g of cellulose acetate propionate (CAP482-20, produced by Eastman Chemical Co.) and 4.5 g of a polyester resin (Vitel PE2200B, produced by Bostic Co.), and dissolved. Subsequently, 4.5 g of a fluorine based surface active agent (Surfron KH40, produced by Asahi Glass Co., Ltd.), dissolved in 43.2 g of methanol, and 2.3 g of a fluorine based surface active agent (Megafag F120K, produced by Dainippon Ink and Chemicals, Inc.) were added thereto and vigorously stirred until they were dissolved. Subsequently, 2.5 g of oleyl oleate was added thereto while stirring. Finally, 75 g of silica (at an average diameter of 10 μm) which was dispersed at one percent in MEK, employing a dissolver type homogenizer was added thereto and stirred, whereby a back coat layer liquid coating composition was prepared.

<Preparation of Back Coat Layer Protective Layer (Surface Protective Layer) Liquid Coating Composition>

Preparation was performed in the same manner as Back Coat Layer Liquid Coating Composition, employing the composition ratio below.

| | |
|---|---|
| Cellulose acetate propionate (CAP482-20, produced by Eastman Chemical Co., Ltd.) (10 percent MEK solution) | 15 g |
| Monodipsersed silica of a degree of monodispersibility of 15 percent (at an average particle diameter of 10 μm)(surface-treated with 1 percent aluminum with respect to the total weight of silica) | 0.03 g |
| $C_8F_{17}(CH_2CH_2O)_{12}C_8F_{17}$ | 0.05 g |
| Fluorine based surface active agent (SF-17) | 0.01 g |
| Stearic acid | 0.1 g |
| Oleyl oleate | 0.1 g |
| α-Alumina (at a Mohs hardness of 9) | 0.1 g |

<Preparation of Light-Sensitive Silver Halide Emulsion A1>

Preparation was performed in the same manner as for Light-sensitive Silver Halide Emulsion A1 in Example 1.

<Preparation of Light-Sensitive Silver Halide Emulsion B1>

Preparation was performed in the same manner as for Light-sensitive Silver Halide Emulsion B1 in Example 1.

<Preparation of Light-Sensitive Silver Halide Emulsion C>

Preparation was performed in the same manner as for Light-sensitive Silver Halide Emulsion A1, except that potassium bromide employed during preparation of Light-sensitive Silver Halide Emulsion A1 was replaced with potassium iodide. The resultant emulsion was composed of monodipsersed pure silver iodide grains of an average grain size of 25 nm, a variation coefficient of the particle size of 12 percent, and a [100] plane ratio of 92 percent.

<Preparation of Light-Sensitive Silver Halide Emulsion D>

Preparation was performed in the same manner as for Light-sensitive Silver Halide Emulsion A1, except that some of potassium bromide employed during preparation of Light-sensitive Silver Halide Emulsion A1 was replaced with potassium iodide so that the proportion of silver iodide reached 90 mol percent. The resultant emulsion was composed of monodipsersed silver-iodobromide grains of an average grain size of 25 nm, a variation coefficient of the particle size of 12 percent, and a [100] plane ratio of 92 percent (the proportion of silver iodide was 90 mol percent).

<Preparation of Light-Sensitive Silver Halide Emulsion E>

Preparation was performed in the same manner as for Light-sensitive Silver Halide Emulsion C, except that temperature during addition employing a double-jet method was changed to 45° C. The resultant emulsion was composed of monodipsersed pure silver iodide grains of an average grain size of 55 nm, a variation coefficient of the particle size of 12 percent, and a [100] plane ratio of 92 percent.

<Preparation of Light-Sensitive Silver Halide Emulsion F>

Preparation was performed in the same manner as for Light-sensitive Silver Halide Emulsion D, except that temperature during addition employing a double-jet method was changed to 45° C. The resultant emulsion was composed of monodipsersed silver iodobromide grains of an average grain size of 55 nm, a variation coefficient of the particle size of 12 percent, and a [100] plane ratio of 92 percent.

<Preparation of Light-Sensitive Silver Halide Emulsion G>

Preparation was performed in the same manner as for Light-sensitive Silver Halide Emulsion C, except that after adding all Solution Fl after nuclei formation, 4 ml of 0.1 percent aforesaid compound (ETTU) methanol solution was added.

Incidentally, the resultant emulsion was composed of monodipsersed cubic silver iodobromide grains of an average grain size of 25 nm, a variation coefficient of the particle size of 12 percent, and a [100] plane ratio of 92 percent.

<Preparation of Light-Sensitive Silver Halide Emulsion H>

Light-sensitive Silver Halide Emulsion H was prepared in the same manner as above Light-sensitive Silver Halide Emulsion E, except that after adding all Solution F1 after nuclei formation, 4 ml of 0.1 percent aforesaid compound (ETTU) methanol solution was added.

The resultant emulsion was composed of monodipsersed pure silver iodide grains of an average grain size of 55 nm, a variation coefficient of the particle size of 12 percent, and a [100] plane ratio of 92 percent.

<Preparation of Powdered Organic Silver Salt A>

Preparation was performed in the same manner as for Powdered Organic Silver Salt A in Example 1.

<Preparation of Powdered Organic Silver Salt P1-1-A1>

Preparation was performed in the same manner as for Powdered Organic Silver SaltP-1-A1 in Example 1.

<Preparation of Powdered Organic Silver Salt P1-1-C>

Preparation was performed in the same manner as for aforesaid Powdered Organic Silver Salt A, except that 259.9 g of behenic acid was replaced with 259.9 g of P1-1, 36.2 g of Light-sensitive Silver Halide A1 was replaced with 36.2 g of Light-sensate Silver Halide C, and 9.1 g of Light-sensitive Silver Halide B1 was replaced with 9.1 g of Light-sesntive Silver Halide E.

<Preparation of Powdered Organic Silver Salt P1-1-D>

Preparation was performed in the same manner as for aforesaid Powdered Organic Silver Salt A, except that 259.9 g of behenic acid was replaced with 259.9 g of P1-1, 36.2 g of Light-sensitive Silver Halide A1 was replaced with 36.2 g of Light-sensate Silver Halide D, and 9.1 g of Light-sensitive Silver Halide B1 was replaced with 9.1 g of Light-sesntive Silver Halide F.

<Preparation of Powdered Organic Silver Salt P1-1-G>

Preparation was performed in the same manner as for aforesaid Powdered Organic Silver Salt A, except that 259.9 g of behenic acid was replaced with 259.9 g of P1-1, 36.2 g of Light-sensitive Silver Halide A1 was replaced with 36.2 g of Light-sensate Silver Halide G, and 9.1 g of Light-sensitive Silver Halide B1 was replaced with 9.1 g of Light-sesntive Silver Halide H.

<Preparation of Powdered Organic Silver Salt P1-2-C>

Preparation was performed in the same manner as for aforesaid Powdered Organic Silver Salt P1-1-C, except P1-1 was replaced with P1-2.

<Preparation of Powdered Organic Silver Salt P1-3-C>

Preparation was performed in the same manner as for aforesaid Powdered Organic Silver Salt P1-1-C, except P1-1 was replaced with P1-3.

<Preparation of Powdered Organic Silver Salt P1-4-C>

Preparation was performed in the same manner as for aforesaid Powdered Organic Silver Salt P1-1-C, except P1-1 was replaced with P1-4.

<Preparation of Powdered Organic Silver Salt P1-5-C>

Preparation was performed in the same manner as for aforesaid Powdered Organic Silver Salt P1-1-C, except P1-1 was replaced with P1-5.

<Preparation of Powdered Organic Silver Salt P1-2-D>

Preparation was performed in the same manner as for aforesaid Powdered Organic Silver Salt P1-1-D, except P1-1 was replaced with P1-2.

<Preparation of Powdered Organic Silver Salt P1-3-D>

Preparation was performed in the same manner as for aforesaid Powdered Organic Silver Salt P1-1-D, except P1-1 was replaced with P1-3.

<Preparation of Powdered Organic Silver Salt P1-4-D>

Preparation was performed in the same manner as for aforesaid Powdered Organic Silver Salt P1-1-D, except P1-1 was replaced with P1-4.

<Preparation of Powdered Organic Silver Salt P1-5-D>

Preparation was performed in the same manner as for aforesaid Powdered Organic Silver Salt P1-1-D, except P1-1 was replaced with P1-5.

<Preparation of Powdered Organic Silver Salt P1-2-D>

Preparation was performed in the same manner as for aforesaid Powdered Organic Silver Salt P1-1-G, except P1-1 was replaced with P1-2.

<Preparation of Powdered Organic Silver Salt P1-3-G>

Preparation was performed in the same manner as for aforesaid Powdered Organic Silver Salt P1-1-G, except P1-1 was replaced with P1-3.

<Preparation of Powdered Organic Silver Salt P1-4-G>

Preparation was performed in the same manner as for aforesaid Powdered Organic Silver Salt P1-1-G, except P1-1 was replaced with P1-4.

<Preparation of Powdered Organic Silver Salt P1-5-G>

Preparation was performed in the same manner as for aforesaid Powdered Organic Silver Salt P1-1-G, except P1-1 was replaced with P1-5.

<Preparation of Preliminary Dispersion A>

Preparation was performed in the same manner as for Preliminary Dispersion A in Example 1.

<Preparation of Preliminary Dispersion P1-1-A1>

Preparation was performed in the same manner as for Preliminary Dispersion A, except that 500 g of Organic Silver Salt A was replaced with 500 g of Organic Silver Salt P1-1-A1.

<Preparation of Preliminary Dispersion P1-1-C>

Preparation was performed in the same manner as for Preliminary Dispersion A, except that 500 g of Organic Silver Salt A was replaced with 500 g of Organic Silver Salt P1-1-C.

<Preparation of Preliminary Dispersion P1-2-C>

Preparation was performed in the same manner as for Preliminary Dispersion A, except that 500 g of Organic Silver Salt A was replaced with 500 g of Organic Silver Salt P1-2-C.

<Preparation of Preliminary Dispersion P1-3-C>

Preparation was performed in the same manner as for Preliminary Dispersion A, except that 500 g of Organic Silver Salt A was replaced with 500 g of Organic Silver Salt P1-3-C.

<Preparation of Preliminary Dispersion P1-4-C>

Preparation was performed in the same manner as for Preliminary Dispersion A, except that 500 g of Organic Silver Salt A was replaced with 500 g of Organic Silver Salt P1-4-C.

<Preparation of Preliminary Dispersion P1-5-C>

Preparation was performed in the same manner as for Preliminary Dispersion A, except that 500 g of Organic Silver Salt A was replaced with 500 g of Organic Silver Salt P1-5-C.

<Preparation of Preliminary Dispersion P1-1-D>

Preparation was performed in the same manner as for Preliminary Dispersion A, except that 500 g of Organic Silver Salt A was replaced with 500 g of Organic Silver Salt P1-1-D.

<Preparation of Preliminary Dispersion P1-2-D>

Preparation was performed in the same manner as for Preliminary Dispersion A, except that 500 g of Organic Silver Salt A was replaced with 500 g of Organic Silver Salt P1-2-D.

<Preparation of Preliminary Dispersion P1-3-D>

Preparation was performed in the same manner as for Preliminary Dispersion A, except that 500 g of Organic Silver Salt A was replaced with 500 g of Organic Silver Salt P1-3-D.

<Preparation of Preliminary Dispersion P1-4-D>

Preparation was performed in the same manner as for Preliminary Dispersion A, except that 500 g of Organic Silver Salt A was replaced with 500 g of Organic Silver Salt P1-4-D.

<Preparation of Preliminary Dispersion P1-5-D>

Preparation was performed in the same manner as for Preliminary Dispersion A, except that 500 g of Organic Silver Salt A was replaced with 500 g of Organic Silver Salt P1-5-D.

<Preparation of Preliminary Dispersion P1-1-G>

Preparation was performed in the same manner as for Preliminary Dispersion A, except that 500 g of Organic Silver Salt A was replaced with 500 g of Organic Silver Salt P1-1-G.

<Preparation of Preliminary Dispersion P1-2-G>

Preparation was performed in the same manner as for Preliminary Dispersion A, except that 500 g of Organic Silver Salt A was replaced with 500 g of Organic Silver Salt P1-2-G.

<Preparation of Preliminary Dispersion P1-3-G>

Preparation was performed in the same manner as for Preliminary Dispersion A, except that 500 g of Organic Silver Salt A was replaced with 500 g of Organic Silver Salt P1-3-G.

<Preparation of Preliminary Dispersion P1-4-G>

Preparation was performed in the same manner as for Preliminary Dispersion A, except that 500 g of Organic Silver Salt A was replaced with 500 g of Organic Silver Salt P1-4-G.

<Preparation of Preliminary Dispersion P1-5-G>

Preparation was performed in the same manner as for Preliminary Dispersion A, except that 500 g of Organic Silver Salt A was replaced with 500 g of Organic Silver Salt P1-5-G.

<Preparation of Light-Sensitive Emulsion Dispersion A>

Light-sesntive Emulsion Dispersion A was prepared by feeding Preliminary Dispersion A to a media type homogenizer DISPERMAT Type SL-C12EX (produced by VMA-GETZMANN Co.) charged with 0.5 mm diameter zirconia beads (Torecerum, produced by Toray Co., Ltd.) up to 80 percent of the inner volume and dispersed at a peripheral rate of the mill of 8 m/second.

<Preparation of Light-Sensitive Emulsion Dispersions P1-1-A1, P1-1-C, P1-2-C, P1-3-C, p1-4-C, P1-5-C, P1-1-D, P1-2-D, P1-3-D, P1-4-D, P1-5-D, P1-1-G, P1-2-G, P1-3-G, P1-4-G, and P1-5-G>

Preparation was performed in the same manner as for Light-sensitive Emulsion Dispersion A, except that Preliminary Dispersion was replaced with each of Preliminary Dispersion Light-sensitive Emulsion Dispersions P1-1-A1, P1-1-C, P1-2-C, P1-3-C, P1-4-C, P1-5-C, P1-1-D, P1-2-D, P1-3-D, P1-4-D, P1-5-D, P1-1-G, P1-2-G, P1-3-G, P1-4-G, and P1-5-G.

<Preparation of Stabilizer Solution>

A stabilizer solution was prepared by dissolving 1.0 g of Stabilizer 1 and 0.31 g of potassium acetate in 4.97 g of methanol.

<Preparation of 2-Chlorobenzoic Acid Solution>

A 2-chlorobenzoic acid solution was prepared by dissolving 1.488 g of 2-chlorobenzoic acid, 2.779 g of Stabilizer 2, and 365 mg of 5-methyl-2-mercaptobenzimodazole in 31.3 ml of MEK in a darkened place.

<Preparation of Addition Solution a>

In 110 g of MEK were dissolved each of the reducing agents (compounds (reducing agents) in an amount described in Table 3), 0.159 g of a yellow forming leuco dye YA-1), 0.159 g of a cyan forming leuco dye (CA-10), and 1.54 g of 4-methylphthalic acid. The resultant solution was designated as Addition Solution a.

<Preparation of Addition Solution b>

In 40.9 g of MEK were dissolved 1.56 g of Antifogging Agent 2, 0.5 g of Antifogging Agent 3, 0.5 g of Antifogging Agent 4, 0.5 g of Antifogging Agent 5, and 3.43 g of phthalazine. The resultant solution was designated as Addition Solution b.

<Preparation of Addition Solution c>

In 39.99 g of MEK was dissolved 0.01 g of Silver Saving Agent A(1). The resultant solution was designated as Addition Solution c.

<Preparation of Addition Solution d>

In 9.0 g of MEK was dissolved 1 g of potassium p-toluenethiosulfonate. The resultant solution was designated as Addition Solution d.

<Preparation of Addition Solution e>

In 9.0 g of MEK was dissolved 1 g of vinylsulfone [$(CH_2{=}CH{-}SO_2CH_2)_2CHOH$]. The resultant solution was designated as Addition Solution e.

<Preparation of Image Forming Layer Liquid Coating Composition>

Under an ambience of inactive gas (97 percent nitrogen), while stirring, 1,000 μl of Chemical Sensitizer S-5 (a 0.5 percent methanol solution) was added to a mixture of 50 g of the aforesaid light-sensitive emulsion dispersion (described in Table 3) and 15.11 g of MEK, maintained at 21° C., and after two minutes, 390 μl of Antifogging Agent 1 (at a 10 percent methanol solution) was added and stirred for one hour. Further, 494 μl of calcium bromide (at a 10 percent methanol solution) was added and stirred for 10 minutes. Subsequently, Gold Sensitizer Au-5 in an amount equivalent to 1/20 mol of the aforesaid organic chemical sensitizer was added and stirred for an additional 20 minutes. Subsequently, 16711 of Stabilizer Solution was added and stirred for 10 minutes. Thereafter, 1.32 g of aforesaid 2-Chlorobenzoic Acid Solution was added and stirred for one hour. The temperature was then lowered to 13° C., and stirring was performed for 30 minutes. While the temperature was maintained at 13° C., 0.5 g of Addition Solution d, 0.5 g of addition Solution e, 0.5 g of Addition Solution f, and 13.31 g of the binder employed in Preliminary Dispersion A was added and stirred for 30 minutes. Thereafter, 1.084 g of tetrachlorophthalic acid (at a 9.4 percent MEK solution) was added and stirred for 15 minutes. While stirring, 12.43 g of Addition Solution a, 1.6 ml of aliphatic isocyanate of Desmodur N3300, manufactured by Mobay Co. (at a 10 percent MEK solution), 4.27 g of Addition Solution b, and 4.0 g of Addition Solution c were successively added, whereby an image forming layer liquid coating composition was obtained.

<Preparation of Image Forming Layer Protective Layer Lower Layer (Surface Protective Layer Lower Layer)>

Added to a mixture consisting of 500 g of acetone, 2,100 g of MEK, and 700 g of methanol was 230 g of cellulose acetate butyrate (CAB-171-15S, produced by Eastman Chemical Co.). The resultant mixture was blended employing a dissolver and dissolved. Subsequently, 25 g of phthalazine, 3.5 g of $CH_2{=}CHSO_2CH_2CH_2OCH_2CH_2SO_2CH{=}CH_2$, 1 g of $C_{12}F_{25}(CH_2CH_2O)_{10}C_{12}F_{25}$, 1 g of Compound SF-17 represented by General Formula (SF), 10 g of stearic acid, and 10 g of butyl stearate were added while stirring and dissolved. Finally, 280 g of monodipsersed silica particles (at an average particle size of 3 μm, being subjected to surface treatment with aluminum in an amount of one percent of the total silica weight) at a degree of monodispersibility of 15 percent, which was dispersed at a concentration of 5 percent in MEK, employing a dissolver type homogenizer was added and subsequently stirred, whereby an image forming layer protective layer lower layer liquid coating composition was prepared.

<Preparation of Image Forming Layer Protective Layer Upper Layer (Surface Protective Layer Upper Layer)>

Added to a mixture consisting of 500 g of acetone, 2,100 g of MEK, and 700 g of methanol was 230 g of cellulose acetate butyrate (CAB-171-15S, produced by Eastman Chemical Co.). The resultant mixture was blended employing a dissolver and dissolved. Subsequently, 25 g of phthalazine, 3.5 g of $CH_2{=}CHSO_2CH_2CH_2OCH_2CH_2SO_2CH{=}CH_2$, 1 g of $C_{12}F_{25}$ $(CH_2CH_2O)_{10}C_{12}F_{25}$, 1 g of Compound SF-17 represented by General Formula (SF), 10 g of stearic acid, and 10 g of butyl stearate were added while stirring and dissolved. Finally, 280 g of monodipsersed silica particles (at an average particle size of 3 μm, being subjected to surface treatment with aluminum in an amount of one percent of the total silica weight) at a degree of 15 percent monodispersibility, which was dispersed at a concentration of 5 percent in MEK, employing a dissolver type homogenizer, as well as 180 g (at an average particle size of 5 μm) of monodipsersed spherical silica particles at a degree of 15 percent monodispersibility, which were dispersed at a concentration of 5 percent in MEK, employing a dissolver type homogenizer, were added and subsequently stirred, whereby an image forming layer protective layer upper layer liquid coating composition was prepared.

<Preparation of Heat Developable Light-Sensitive Materials>

Back Coat Layer Liquid Coating Composition and Back Coat Layer Protective Layer Liquid Coating Composition, prepared as above, were applied onto Subbing Upper Layer B-2 at a coating rate of 50 m/minute to result in a dried layer thickness of 3.5 μm, employing an extrusion coater. Drying was performed over a period of 5 minutes, employing an air flow at a drying temperature of 100° C. and a dew point temperature of 10° C.

Aforesaid Image Forming Layer Liquid Coating Composition and Image Forming Layer Protective Layer (Surface Protective Layer) Liquid Coating Composition were simultaneously applied onto Subbing Upper Layer A-2 at a coating rate of 50 m/minute, employing an extrusion coater, whereby Light-sensitive Material Samples (2-1)-(2-23), listed in Table 2, were prepared. Coating was performed to result in a coated silver weight of 1.2 g/m$^2$ for the image forming layer, a dried layer thickness of 3.0 μm (1.5 μm for the surface protective layer upper layer and 1.5 μm for the surface protective layer lower layer) for the image forming layer protective layer, and subsequently, drying was performed over a period of 10 minutes, employing an air flow at a drying temperature of 75° C. and a dew point temperature of 10° C.

The pH and Bekk smoothness of each of the layer surfaces on the image forming side of the resultant heat developable materials (Samples 2-23) were 5.3 and 5,000 seconds, respectively, while the pH and Bekk smoothness of each of the layer surfaces on the back coat layer side were 5.5 and 6,000 seconds, respectively. Further, the surface roughness of each of Samples (2-1)-(2-23) was determined, resulting in Rz(E)/Rz(B)=0.40, Rz=1.4 μm, while Rz(B) was 3.5 μm.

Sample (2-20) was prepared in the same manner as for Sample (2-1), except that fluorine based surface active agent SF-17 of Back Coat Layer Protective Layer and Image Forming Layer Protective Layer (Upper Layer as well as Lower Layer) was replaced with $C_8F_{17}SO_3Li$.

Sample (2-21) was prepared in the same manner as for Sample (2-1), except that $SO_3K$ group containing polyvinyl butyral (at a Tg of 75° C., containing $SO_3K$ in an amount of 0.2 millimol/g) which was employed as a binder for the image forming layer during preparation of Preliminary Dispersion A was replaced with $SO_3K$ group containing polyvinyl butyral (at a Tg of 65° C., containing $SO_3K$ in an amount of 0.2 millimol/g).

<Exposure and Development>

Heat Developable Light-sensitive Material Samples (2-1)-(2-23), prepared as above, were cut into Hansetsu Size (34.5 cm×43.0 cm) and were processed as described below, employing a thermal processor shown in FIG. 1.

Each of Heat Developable Light-sensitive Material Samples was picked up from a film tray and conveyed to the laser exposure section. Thereafter, the image forming layer surface of the above light-sanative material was exposed to a laser beam while changing its amount between 1 and 1,000 mW/mm$^2$, employing an exposure device which employed, as a laser beam source, a semiconductor laser (NLHV3000E, produced by Nichia Corp.) of an emitting wavelength of 405 nm. Thereafter, the exposed material was conveyed to a heat development section, was thermally developed at 123° C. for 13.5 seconds in such a manner that the surface of a heating drum was brought into contact with the protective layer on the image forming layer side of above Heat Developable Light-sensitive Material, and subsequently discharged to the exterior. At that time, the conveyance rate from the light-sensitive material feeding section to the image exposure section, at the image exposure section, and at the heat development section was 20 m/second, respectively. Incidentally, exposure and development were performed in a room at 23° C. and 50 percent relative humidity. Exposure was carried out stepwise in such a manner that the amount of exposure energy was decreased from the maximum output by 0.05 in terms of logE.

(Packaging Material)

PET 10 μm/PE 12 μm/aluminum foil 9 μm/Ny 15 μm/polyethylene containing 3 percent carbon 50 μm at an oxygen permeability of 0 ml/atm·m$^2$·25° C.·day and a water permeability of 0 g/atm·m$^2$·25° C.·day. A paper tray was used.

(Evaluation of Performance)

Each of the thermally developed images was evaluated for the performance described below.

<<Image Density>>

The maximum density of images prepared under the above conditions was determined employing a densitometer. The resultant value was represented as image density.

<<Photographic Speed>>

The density of images prepared under the above conditions was determined employing a densitometer, and a characteristic curve composed of abscissa as the exposure amount and ordinate as the density was prepared. In the resultant characteristic curve, photographic speed was defined as the reciprocal of the exposure amount which yielded density which was 1.0 higher than the a density of the unexposed portion. Photographic speed was determined. based on this definition. The photographic speed was represented as a relative value when the photographic speed of Sample (1-1) or (2-1) was 100.

Note: The numerical value in the parenthesis in the column of Relative Photographic Speed is obtained as follows. Photographic speed was determined for the case in which before a light-sensitive material was exposed to white light, the light-sensitive material was thermally processed at the thermal development temperature and thereafter, the light-sensitive material was exposed to white light (at 4874 K for 30 seconds) through an optical wedge. On the other hand, photographic speed was also determined for the case in which without thermal processing prior to exposure, the light-sensitive martial was exposed to white light under the same conditions as above and thermally developed. The photographic speed of the former was represented as a relative value when the photographic speed of the latter was 100. Incidentally, in this relative comparison, it was confirmed that the main reason for the decrease in the relative photographic speed of the light-sensitive material, which was processed at the thermal development temperature before the light-sensitive material was exposed to white light, was due to variation of the relative relationship between the surface photographic speed and the internal photographic speed of grain caused by elimination or decrease in spectral sensitization effects through observation/measurement of the variation of spectral photographic speed.

<<Lightfastness of Images>>

Each of heat developable light-sensitive material samples was exposed and developed in the same manner as above, and subsequently pasted on a viewing box at a luminance of 1,000 lux, and allowed to stand for 10 days. Thereafter, variation of images was visually evaluated by 0.5 based on the criteria below.

5: negligible variation was noted

4: slight tone variation was noted

3: practical tone variation, as well as an increase in fog, was noted

2: tone variation as well as an increase in fog was noted in a large portion

1: pronounced tone variation, as well as an increase in fog was noted and marked uneven density occurred on the entire portion <<Tracking Properties>>

Photographic processing was performed 50 times employing a thermal processor, and frequency of poor tracking was noted and recorded.

<<Uneven Density During Heat Development>>

Uneven density after development was visually evaluated base on the criteria below.

5: no uneven density was noted

4: slight uneven density resulted

3: weak uneven density resulted partly

2: marked uneven density resulted partly

1: marked uneven density resulted in the entire portion

<<Abrasion on the Surface of Light-Sensitive Materials after Heat Development>>

5: no abrasion was noted

4: slight abrasion resulted

3: weak abrasion resulted partly

2: marked abrasion resulted partly

1: a number of marked abrasion resulted

<<Increase in Fog during Storage at High Temperature>>

Heat developable light-sensitive materials, prepared as above, were placed in a tightly sealed vessel, the interior of which was maintained at 55° C. and 55 percent humidity and stored for three days (being forced aging). For comparison, the same heat developable light-sensitive materials were stored in a light-shielded vessel the interior of which was maintained at 25° C. and 55 percent humidity for three days. The resultant samples were processed in the same manner as for the sensitometric evaluation and the density of fog portions was determined. Subsequently, an increase in fog was recorded based on the formula below.

$$\Delta D\text{min (increase in fog)}=(\text{fog after forced aging})-(\text{fog after comparison aging})$$

Table 1 shows the results.

<<Evaluation of Surface Roughness>>

The surface roughness of samples prior to heat development was determined based on the method below, employing a non-contact 3-dimensional surface analyzer (RST/PLUS available from WYKO Co.)

1) Objective lens: ×10.0, Intermediate lens: ×1.0

2) Measurement range: 463.4 μm×623.9 μm

3) Pixel size: 238×368

4) Filter: Cylindrical Correction and Slope Correction

5) Smoothing: Medium Smoothing

6) Scanning speed: Low

The definition of Rz follows JIS Surface Roughness (B 0601). An area of 10 cm×10 cm of each sample was divided into 100 squares at an interval of 1 cm, such as a checked pattern, and the center of each of the squares was measured. The measurement was repeated one hundred times and an average value was calculated. As a result, all Rz(E)/Rz(B) values of samples of the present invention were 0.4.

Tables 5 and 6 show the results.

TABLE 5

| Sample No. | Type of Light-sensitive Emulsion Dispersion | Type of Reducing Agent Represented by General Formula (1) and Amount (kg) | Type of Reducing Agent Represented by General Formula (2) and Amount (kg) | Image Density | Relative Photographic Speed | Light-fastness | Uneven Density during Heat Development | Tracking Property | Abrasion of Surface of Light-sensitive Material | Increase in Fog during Storage at High Temperature | Remarks |
|---|---|---|---|---|---|---|---|---|---|---|---|
| (1-1) | P1-1-A1 (Comp.) | (1-1) = 4.20 | (2-6) = 23.78 | 4 | 100 (17) | 3 | 3 | 5 | 3.5 | 0.014 | Comp. |
| (1-2) | P1-1-A2 (Inv.) | (1-1) = 4.20 | (2-6) = 23.78 | 4 | 102 (5) | 4.5 | 4.5 | 1 | 4.5 | 0.006 | Inv. |
| (1-3) | P1-1-A3 (Inv.) | (1-1) = 4.20 | (2-6) = 23.78 | 4 | 101 (5) | 4.5 | 4.5 | 1 | 4.5 | 0.005 | Inv. |
| (1-4) | P1-1-A4 (Inv.) | (1-1) = 4.20 | (2-6) = 23.78 | 4.2 | 102 (4) | 5 | 5 | 1 | 4.5 | 0.005 | Inv. |
| (1-5) | P1-1-A5 (Inv.) | (1-1) = 4.20 | (2-6) = 23.78 | 4.1 | 102 (4) | 5 | 5 | 1 | 4.5 | 0.005 | Inv. |
| (1-6) | P1-2-A4 (Inv.) | (1-1) = 4.20 | (2-6) = 23.78 | 4.2 | 101 (4) | 5 | 4.5 | 1 | 4.5 | 0.005 | Inv. |
| (1-7) | P1-3-A4 (Inv.) | (1-1) = 4.20 | (2-6) = 23.78 | 4.2 | 101 (4) | 5 | 4.5 | 1 | 4.5 | 0.005 | Inv. |
| (1-8) | P1-4-A4 (Inv.) | (1-1) = 4.20 | (2-6) = 23.78 | 4 | 100 (5) | 5 | 4 | 0 | 5 | 0.003 | Inv. |
| (1-9) | P1-5-A4 (Inv.) | (1-1) = 4.20 | (2-6) = 23.78 | 4 | 99 (5) | 5 | 4 | 0 | 5 | 0.003 | Inv. |
| (1-10) | P1-1-A4 (Inv.) | (1-7) = 4.20 | (2-6) = 23.78 | 4.1 | 100 (4) | 5 | 4.5 | 1 | 4.5 | 0.005 | Inv. |
| (1-11) | P1-1-A4 (Inv.) | (1-10) = 4.20 | (2-6) = 23.78 | 4.5 | 100 (4) | 5 | 4.5 | 1 | 4.5 | 0.005 | Inv. |
| (1-12) | P1-1-A4 (Inv.) | (1-10) = 4.20 | (2-1)/(2-6) = 11.89/11.89 | 4.4 | 101 (4) | 4.5 | 4.5 | 1 | 4.5 | 0.006 | Inv. |
| (1-13) | P1-1-A4 (Inv.) | (1-10) = 4.20 | (2-2)/(2-6) = 11.89/11.89 | 4.5 | 101 (4) | 5 | 4.5 | 1 | 4.5 | 0.005 | Inv. |
| (1-14) | P1-1-A4 (Inv.) | (1-1) = 4.20 | (2-6) = 23.78 | 4.2 | 100 (4) | 5 | 5 | 1 | 4.5 | 0.005 | Inv. |
| (1-15) | P1-1-A4 (Inv.) | (1-1) = 4.20 | (2-6) = 23.78 | 4.2 | 101 (4) | 5 | 5 | 2 | 4 | 0.007 | Inv. |
| (1-16) | A(Comp.) | (1-1) = 4.20 | (2-6) = 23.78 | 4 | 101 (18) | 2.5 | 3 | 7 | 2.5 | 0.018 | Comp. |

Comp.: Comparative Example
Inv.: Present Invention

TABLE 6

| Sample No. | Type of Light-sensitive Emulsion Dispersion | Type of Reducing Agent Represented by General Formula (1) and Amount (kg) | Type of Reducing Agent Represented by General Formula (2) and Amount (kg) | Image Density | Relative Photographic Speed | Light-fastness | Uneven Density during Heat Development | Tracking Property | Abrasion of Surface of Light-sensitive Material | Increase in Fog during Storage at High Temperature | Remarks |
|---|---|---|---|---|---|---|---|---|---|---|---|
| (2-1) | P1-1-C (Inv.) | (1-1) = 4.20 | (2-6) = 23.78 | 4.1 | 100 (15) | 4 | 4.5 | 1 | 4.5 | 0.004 | Inv. |
| (2-2) | P1-2-C (Inv.) | (1-1) = 4.20 | (2-6) = 23.78 | 4.2 | 100 (16) | 4 | 4.5 | 1 | 4.5 | 0.004 | Inv. |
| (2-3) | P1-3-C (Inv.) | (1-1) = 4.20 | (2-6) = 23.78 | 4.1 | 102 (15) | 4 | 4.5 | 1 | 4.5 | 0.004 | Inv. |
| (2-4) | P1-4-C (Inv.) | (1-1) = 4.20 | (2-6) = 23.78 | 4 | 98 (14) | 4 | 4.5 | 0 | 5 | 0.003 | Inv. |
| (2-5) | P1-5-C (Inv.) | (1-1) = 4.20 | (2-6) = 23.78 | 4 | 98 (14) | 4 | 4.5 | 0 | 5 | 0.002 | Inv. |
| (2-6) | P1-1-D (Inv.) | (1-1) = 4.20 | (2-6) = 23.78 | 4.1 | 101 (15) | 4 | 4.5 | 1 | 4.5 | 0.004 | Inv. |
| (2-7) | P1-2-D (Inv.) | (1-1) = 4.20 | (2-6) = 23.78 | 4.1 | 100 (15) | 4 | 4.5 | 1 | 4.5 | 0.004 | Inv. |
| (2-8) | P1-3-D (Inv.) | (1-1) = 4.20 | (2-6) = 23.78 | 4.1 | 102 (16) | 4 | 4.5 | 1 | 4.5 | 0.004 | Inv. |
| (2-9) | P1-4-D (Inv.) | (1-1) = 4.20 | (2-6) = 23.78 | 3.9 | 99 (14) | 4 | 4.5 | 0 | 5 | 0.003 | Inv. |
| (2-10) | P1-5-D (Inv.) | (1-1) = 4.20 | (2-6) = 23.78 | 3.9 | 98 (13) | 4 | 4.5 | 0 | 5 | 0.003 | Inv. |
| (2-11) | P1-1-G (Inv.) | (1-1) = 4.20 | (2-6) = 23.78 | 4.2 | 102 (4) | 5 | 5 | 1 | 4.5 | 0.004 | Inv. |
| (2-12) | P1-2-G (Inv.) | (1-1) = 4.20 | (2-6) = 23.78 | 4.2 | 102 (5) | 5 | 5 | 1 | 4.5 | 0.004 | Inv. |
| (2-13) | P1-3-G (Inv.) | (1-1) = 4.20 | (2-6) = 23.78 | 4.2 | 101 (4) | 5 | 5 | 1 | 4.5 | 0.004 | Inv. |
| (2-14) | P1-4-G (Inv.) | (1-1) = 4.20 | (2-6) = 23.78 | 4.1 | 99 (4) | 5 | 5 | 0 | 5 | 0.002 | Inv. |
| (2-15) | P1-5-G (Inv.) | (1-1) = 4.20 | (2-6) = 23.78 | 4.1 | 98 (4) | 5 | 5 | 0 | 5 | 0.002 | Inv. |
| (2-16) | P1-1-C (Inv.) | (1-7) = 4.20 | (2-6) = 23.78 | 4.2 | 101 (15) | 4 | 4.5 | 1 | 4.5 | 0.004 | Inv. |
| (2-17) | P1-1-C (Inv.) | (1-10) = 4.20 | (2-6) = 23.78 | 4.6 | 102 (16) | 4 | 4.5 | 1 | 4.5 | 0.004 | Inv. |
| (2-18) | P1-1-C (Inv.) | (1-10) = 4.20 | (2-1)/(2-6) = 11.89/11.89 | 4.6 | 101 (15) | 4 | 4 | 1 | 4.5 | 0.004 | Inv. |
| (2-19) | P1-1-C (Inv.) | (1-10) = 4.20 | (2-2)/(2-6) = 11.89/11.89 | 4.6 | 101 (15) | 4 | 4.5 | 1 | 4.5 | 0.004 | Inv. |
| (2-20) | P1-1-C (Inv.) | (1-1) = 4.20 | (2-6) = 23.78 | 4.1 | 100 (16) | 4 | 4.5 | 1 | 4.5 | 0.004 | Inv. |
| (2-21) | P1-1-C (Inv.) | (1-1) = 4.20 | (2-6) = 23.78 | 4.1 | 101 (16) | 4 | 4.5 | 2 | 4 | 0.006 | Inv. |
| (2-22) | P1-1-A1 (Comp.) | (1-1) = 4.20 | (2-6) = 23.78 | 3.5 | 100 (19) | 3 | 3 | 4 | 3 | 0.013 | Comp. |
| (2-23) | A(Comp.) | (1-1) = 4.20 | (2-6) = 23.78 | 3.6 | 100 (21) | 2.5 | 3 | 7 | 2.5 | 0.017 | Comp. |

Inv.: Present Invention
Comp.: Comparative Example

As can clearly be seen from Tables 5 and 6, compared to Comparative Examples, Samples of the present invention exhibited excellent lightfastness of images, minimized uneven density during heat development, exhibited excellent tracking properties as well as excellent abrasion resistance, and minimized increase in fog after storage at high temperatures, while maintaining higher density.

Further, when Sample (1-14) was compared to Sample (1-4), it was found that Sample (1-4) possessed more desirable characteristics in terms of tracking properties as well as environmental adaptability (accumulation properties in vivo).

Further, when Sample (2-20) was compared to Sample (2-1), it was found that Sample (2-1) possessed more desirable characteristics in terms of tracking properties as well as environmental adaptability (accumulation properties in vivo).

According to the present invention, it is possible to provide a heat developable light-sensitive material and an image forming method which minimize uneven density, result in excellent tracking properties, minimize abrasion as well as an increase in fog during storage at high temperatures, while maintaining high density, even in cases when quick processing is performed. Further, if desired, it is possible to provide a heat developable light-sensitive material and an image forming method which result in excellent retaining properties during storage at high temperature, or excellent film tracking properties as well as excellent environmental adaptability.

What is claimed is:

1. A photothermographic imaging material comprising a support having thereon an image forming layer containing light-insensitive organic silver salt grains, photosensitive silver halide grains, a reducing agent for silver ions and a binder, wherein:

(i) each of the photosensitive silver halide grains produces a larger number of latent images in a surface portion of the grain than in an inner portion of the grain by exposure to light;

(ii) each of the photosensitive silver halide grains produces a larger number of latent images in the inner portion of the grain than in the surface portion of the grain after being subjected to a thermal development;

(iii) a surface photographic speed of each of the photosensitive silver halide grains decreases after being subjected to the thermal development, the surface photographic speed of the photosensitive silver halide grains after being subjected to the thermal development is not more than 1/10 of the surface photographic speed of the photosensitive silver halide grains prior to thermal development; and (iv) the photothermographic imaging material contains a reducible silver salt compound represented by General Formula (I):

$M^1O_2C\text{-}L^1\text{-}CO_2M^2$ General Formula (I)

wherein $L^1$ represents a divalent group selected from the group consisting of an alkylene group, an alkenylene group, an alkynylene group, a cycloalkylene group, an arylene group, a divalent heterocyclic group, —C(=O)—, —O—, —S—, —S(=O)—, —S(=O)$_2$—, and —N($R^1$)— or a combined group thereof; $R^1$ represents a hydrogen atom, an alkyl group, an alkenyl group, an alkynyl group, an aryl group, a heterocyclic group, an acyl group or a sulfonyl group; $M^1$ and $M^2$ each represents a hydrogen atom or a counter ion, provided that at least one of $M^1$ and $M^2$ represents a silver ion.

2. A photothermographic imaging material comprising a support having thereon an image forming layer containing light-insensitive organic silver salt grains, photosensitive silver halide grains, a reducing agent for silver ions and a binder, wherein:

(i) each of the photosensitive silver halide grains produces a larger number of latent images in a surface portion of the grain than in an inner portion of the grain by exposure to light;

(ii) each of the photosensitive silver halide grains produces a larger number of latent images in the inner portion of the grain than in the surface portion of the grain after being subjected to a thermal development;

(iii) a surface photographic speed of each of the photosensitive silver halide grains decreases after being subjected to the thermal development; and (iv) the photothermographic imaging material contains a compound represented by one of the following General Formulas (1-1) to (1-5), (2-1), (3-1) and (4-1) to (4-2):

General Formula (1-1)

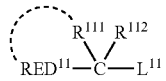

wherein $RED^{11}$ represents a reducing group which undergoes one electron oxidation; $L^{11}$ represents a releasing group; $R^{112}$ represents a hydrogen atom or a substituent; and $R^{111}$ represents a group of non-metallic atoms capable of forming a 5- or 6-membered ring with $RED^{11}$ and a carbon atom bonded with $RED^{11}$, General Formula (1-2)

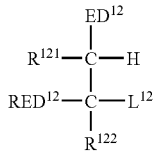

wherein $RED^{12}$ represents a reducing group which undergoes one electron oxidation; $L^{12}$ represents a releasing group; $R^{121}$ and $R^{122}$ independently represent a hydrogen atom or a substituent; and $ED^{12}$ represents an electron donating group, provided that $R^{121}$ and $RED^{12}$, $R^{121}$ and $R^{122}$ or $ED^{12}$ and $RED^{12}$ may join to form a ring, General Formula (1-3)

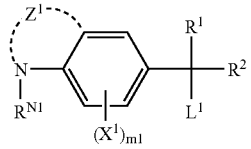

wherein $Z^1$ represents a group of atoms capable of forming a 6-membered ring together with two carbon atoms of a benzene ring and a nitrogen atom; $R^1$, $R^2$, and $R^{N1}$ independently represent a hydrogen atom or a substituent; $X^1$ represents a substitute capable of being substituted on a benzene ring; m1 represents an integer of 0-3; and $L^1$ represents a releasing group, General Formula (1-4)

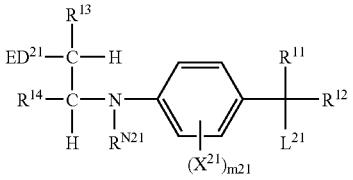

wherein $ED^{21}$ represents an electron donating group; $R^{11}$, $R^{12}$, $R^{N21}$, $R^{13}$, and $R^{14}$ independently represent a hydrogen atom or a substituent; $X^{21}$ represents a substituent capable of being substituted on a benzene ring; m2 represents an integer of 0-3; $L^{21}$ represents a releasing group, provided that $R^{N21}$, $R^{13}$, $R^{14}$, $X^{21}$, and ED may join to form a ring.

General Formula (1-5)

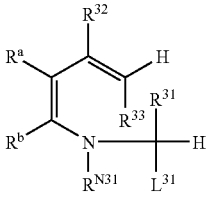

wherein $R^{32}$, $R^{33}$, $R^{31}$, $R^{N31}$, $R^a$ and $R^b$ independently represents a hydrogen atom or a substituent; $L^{31}$ represents a releasing group, provided that when $R^{N31}$ represents a group other than the aryl group, $R^a$ and $R^b$ join to form an aromatic ring, General Formula (2-1)

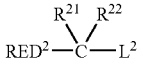

wherein $RED^2$ represents a reducing group which undergoes one electron oxidation; $L^2$ represents a releasing group, provided that when $L^2$ represents a silyl group, a nitrogen containing heterocyclic ring having two or more mercapto groups are present in the molecule; $R^{21}$ and $R^{22}$ independently represent a hydrogen atom or a substituent, provided that $RED^2$ and $R^{21}$ may join to form a ring, $RED^3$-$L^3$-$Y^3$ General Formula (3-1)

wherein $RED^3$ represents a reducing group which undergoes one electron oxidation; $Y^3$ represents a reactive group portion which undergoes reaction after $RED^3$ undergoes one-electron oxidation; and $L^3$ represents a linking group, General Formula (4-1)

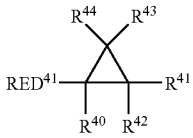

wherein $RED^{41}$ represents a reducing group which undergoes one electron oxidation; $R^{40}$ to $R^{44}$ independently represents a hydrogen atom or a substituent, General Formula (4-2)

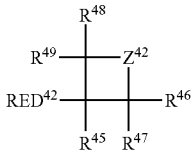

wherein $RED^{42}$ represents a reducing group which undergoes one electron oxidation; $R^{45}$ to $R^{49}$ independently represents a hydrogen atom or a substituent; $Z^{42}$ represents —$CR^{420}R^{421}$—, —$NR^{423}$—, or —O—, wherein $R^{420}$ and $R^{421}$ each represent a hydrogen atom or a substituent, while $R^{423}$ represents a hydrogen atom, an alkyl group, an aryl group, or a heterocyclic group.

3. The photothermographic imaging material of claim 2, further contains a reducible silver salt compound represented by Formula (I) in the image forming layer:

$M^1O_2C$-$L^1$-$CO_2M^2$ Formula (I)

wherein $L^1$ represents a divalent group selected from the group consisting of an alkylene-group, an alkenylene group, an alkynylene group, a cycloalkylene group, an arylene group, a divalent heterocyclic group, —C(═O)—, —O—, —S—, —S(═O)—, —S(═O)$_2$—, and —N($R^1$)— or a combined group thereof; $R^1$ represents a hydrogen atom, an alkyl group, an alkenyl group, an alkynyl group, an aryl group, a heterocyclic group, an acyl group or a sulfonyl group; $M^1$ and $M^2$ each represents a hydrogen atom or a counter ion, provided that at least one of $M^1$ and $M^2$ represents a silver ion.

4. The photothermographic imaging material of claim 1, wherein an average equivalent circle diameter of the photosensitive silver halide grains is 10 to 100 nm.

5. The photothermographic imaging material of claim 2, wherein an average equivalent circle diameter of the photosensitive silver halide grains is 10 to 100 nm.

6. The photothermographic imaging material of claim 1, wherein the binder is water-soluble.

7. The photothermographic imaging material of claim 2, wherein the binder is water-soluble.

8. A method of forming an image comprising the steps of:

exposing the photothermographic imaging material of claim 1 to a laser having a wavelength of 600 to 900 nm; and thermally developing the exposed photothermographic imaging material.

9. A method of forming an image comprising the steps of:

exposing the photothermographic imaging material of claim 2 to a laser having a wavelength of 600 to 900 nm; and thermally developing the exposed photothermographic imaging material.

10. The method of forming an image of claim 8, wherein the thermally developing step is carried out under a temperature of 80 to 150° C. for a period of 5 to 20 seconds.

11. The method of forming an image of claim 9, wherein the thermally developing step is carried out under a temperature of 80 to 150° C. for a period of 5 to 20 seconds.

* * * * *